US012479622B2

(12) United States Patent
Häfliger et al.

(10) Patent No.: US 12,479,622 B2
(45) Date of Patent: Nov. 25, 2025

(54) BRUSH-PRODUCT PACKAGING DEVICE AND TRAY PACKAGING FOR FORMING A RECEPTACLE FOR AT LEAST TWO BRUSH-PRODUCT PACKAGING DEVICES

(71) Applicant: TRISA HOLDING AG, Triengen (CH)

(72) Inventors: Andreas Häfliger, Triengen (CH); Herbert Fischer, Reitnau (CH); Thomas Röthlisberger-Büchli, Willisau (CH)

(73) Assignee: TRISA HOLDING AG, Triengen (CH)

( * ) Notice: Subject to any disclaimer, the term of this patent is extended or adjusted under 35 U.S.C. 154(b) by 92 days.

(21) Appl. No.: 17/608,260

(22) PCT Filed: Apr. 28, 2020

(86) PCT No.: PCT/EP2020/061705
§ 371 (c)(1),
(2) Date: Nov. 2, 2021

(87) PCT Pub. No.: WO2020/225021
PCT Pub. Date: Nov. 12, 2020

(65) Prior Publication Data

US 2022/0219860 A1 Jul. 14, 2022

(30) Foreign Application Priority Data

May 6, 2019 (EP) ..... 19172849

(51) Int. Cl.
*B65D 5/50* (2006.01)
*B65D 5/02* (2006.01)
(Continued)

(52) U.S. Cl.
CPC ..... *B65D 5/5021* (2013.01); *B65D 5/0209* (2013.01); *B65D 5/029* (2013.01);
(Continued)

(58) Field of Classification Search
CPC .... B65D 5/0209; B65D 5/029; B65D 5/2057; B65D 5/4204; B65D 5/4208;
(Continued)

(56) References Cited

U.S. PATENT DOCUMENTS 1,352,759 A 9/1920 Markert
1,451,383 A 4/1923 Wilson
(Continued)

FOREIGN PATENT DOCUMENTS

AT 13627 U1 5/2014
CN 101092198 A 12/2007
(Continued)

OTHER PUBLICATIONS

Nov. 28, 2019 Extended Search Report issued in European Patent Application No. 19172849.2.
(Continued)

*Primary Examiner* — Orlando E Aviles
*Assistant Examiner* — Sanjidul Islam
(74) *Attorney, Agent, or Firm* — Oliff PLC

(57) ABSTRACT

A brush product packaging device for receiving a brush product, in particular a toothbrush, with an application head and with a handle, comprising at least one packaging base body which is configured to form an at least substantially closed receiving region for the brush product and which is implemented at least largely of a paper material.

18 Claims, 27 Drawing Sheets

Figure 1:
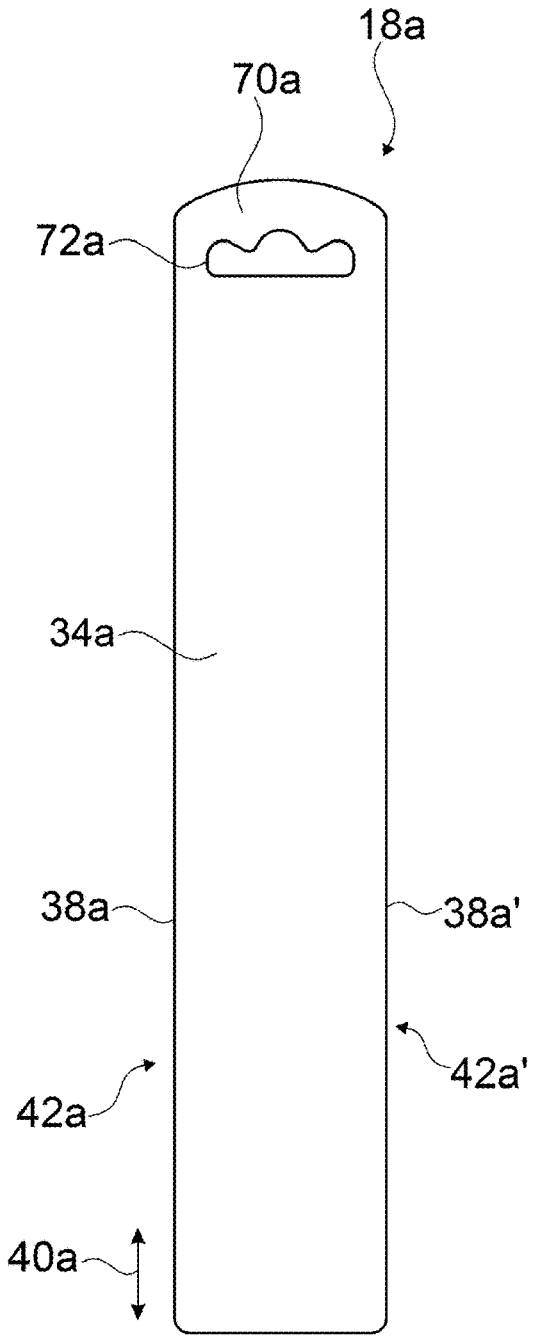

(51) Int. Cl.

| | |
|---|---|
| ***B65D 5/20*** | (2006.01) |
| ***B65D 5/42*** | (2006.01) |
| ***B65D 5/52*** | (2006.01) |
| ***B65D 5/54*** | (2006.01) |
| ***B65D 75/32*** | (2006.01) |
| ***B65D 77/04*** | (2006.01) |

(52) U.S. Cl.
CPC ..... *B65D 5/2057* (2013.01); *B65D 5/4204* (2013.01); *B65D 5/4208* (2013.01); *B65D 5/5007* (2013.01); *B65D 5/5064* (2013.01); *B65D 5/5085* (2013.01); *B65D 5/5293* (2013.01); *B65D 5/542* (2013.01); *B65D 5/5445* (2013.01); *B65D 75/326* (2013.01); *B65D 77/042* (2013.01); *B65D 2577/043* (2013.01)

(58) Field of Classification Search
CPC .. B65D 5/5007; B65D 5/5064; B65D 5/5085; B65D 5/542; B65D 5/5445; B65D 75/326; B65D 77/042; B65D 2577/043
USPC ..... 206/362, 361–362.4
See application file for complete search history.

(56) References Cited

U.S. PATENT DOCUMENTS

| | | | | | |
|---|---|---|---|---|---|
| 1,974,674 | A * | 9/1934 | Halladay | B65D 5/504 | 47/41.01 |
| 1,990,533 | A * | 2/1935 | Eiseman | B65D 5/5021 | 229/162.1 |
| 2,064,321 | A | 12/1936 | Rossum | | |
| 2,259,772 | A * | 10/1941 | Owens | A47F 5/112 | 206/362 |
| 2,313,620 | A * | 3/1943 | Brunner | A47F 5/112 | 211/70.1 |
| 2,663,419 | A | 12/1953 | Velman et al. | | |
| 3,765,594 | A * | 10/1973 | Cramphorn | B65D 5/0209 | 229/128 |
| 4,106,615 | A * | 8/1978 | Hiroshi | B65D 5/4204 | 206/362.2 |
| 4,896,820 | A * | 1/1990 | Harrington | B65D 81/3453 | 229/117.03 |
| 7,159,972 | B2 | 1/2007 | Silverbrook et al. | | |
| D661,180 | S | 6/2012 | Marcinkowski et al. | | |
| D678,053 | S | 3/2013 | Marcinkowski | | |
| 8,522,972 | B2 | 9/2013 | Greene et al. | | |
| 8,821,030 | B2 | 9/2014 | Donaldson et al. | | |
| 10,159,333 | B2 * | 12/2018 | Moskovich | B65D 25/205 | |
| D904,069 | S * | 12/2020 | Juilly | D6/534 | |
| 2008/0029409 | A1 | 2/2008 | Antler | | |
| 2011/0052752 | A1 * | 3/2011 | Saxe | A23K 50/40 | 426/410 |
| 2012/0145567 | A1 * | 6/2012 | Nguyen | B65D 75/366 | 220/270 |
| 2013/0112742 | A1 | 5/2013 | D'Amato | | |
| 2013/0134066 | A1 | 5/2013 | Marcinkowski | | |
| 2017/0137191 | A1 * | 5/2017 | Rorick | A46D 1/0276 | |
| 2019/0359371 | A1 | 11/2019 | Hörenbaum | | |

FOREIGN PATENT DOCUMENTS

| | | | | |
|---|---|---|---|---|
| CN | 106586167 | A | 4/2017 | |
| DE | 33 07 418 | A1 | 9/1984 | |
| DE | 3725018 | A1 | 2/1989 | |
| DE | 9200841 | U1 | 3/1992 | |
| DE | 4305161 | A1 | 9/1994 | |
| DE | 29608541 | U1 | 9/1996 | |
| DE | 195 32 162 | A1 | 3/1997 | |
| DE | 102 19 682 | A1 | 11/2003 | |
| DE | 20 2010 007 121 | U1 | 10/2011 | |
| EP | 1006055 | A2 | 6/2000 | |
| EP | 1 371 567 | A2 | 12/2003 | |
| FR | 797674 | A | 5/1936 | |
| GB | 05205 | A | 11/1912 | |
| GB | 194496 | A | 3/1923 | |
| GB | 604517 | A | 7/1948 | |
| GB | 2511728 | A | 9/2014 | |
| GB | 2 534 989 | A | 8/2016 | |
| JP | H11198929 | A | 7/1999 | |
| WO | 9815461 | A1 | 4/1998 | |
| WO | 2012082099 | A1 | 6/2012 | |
| WO | 2015002638 | A1 | 1/2015 | |
| WO | 2018/149918 | A1 | 8/2018 | |
| WO | WO-2021078838 | A1 * | 4/2021 | B65B 5/024 |

OTHER PUBLICATIONS

Sep. 28, 2020 International Search Report issued in International Patent Application No. PCT/EP2020/061705.
Nov. 2, 2021 International Preliminary Report on Patentability issued in International Patent Application No. PCT/EP2020/061705.
May 13, 2024 Office Action issued in European Patent Application No. 19172849.2.
Jun. 24, 2024 Office Action issued in European Patent Application No. 20724426.0.
May 28, 2024 Office Action issued in European Patent Application No. 19172849.2.
Feb. 4, 2025 Summons issued in European Patent Application No. 19172849.2.
May 8, 2025 Office Action issued in European Patent Application No. 20724426.0.

* cited by examiner

BRUSH-PRODUCT PACKAGING DEVICE AND TRAY PACKAGING FOR FORMING A RECEPTACLE FOR AT LEAST TWO BRUSH-PRODUCT PACKAGING DEVICES

STATE OF THE ART

The invention concerns a brush product packaging device, a system with a brush product packaging device and with a brush product accommodated in the brush product packaging device, and a tray packaging for an accommodation of at least two brush product packaging devices.

From EP 1 371 567 A2, GB 2511728 A and WO 2018/149918 A1 tray packagings for receiving brush product packaging devices are already known.

Furthermore, brush product packaging devices for receiving a brush product, in particular a toothbrush, with an application head and with a handle, comprising at least one packaging base body are already known.

The objective of the invention is in particular to provide a generic device having improved characteristics regarding manufacturability, regarding protection of the brush product and regarding ecological aspects. The objective is achieved according to the invention by the features of patent claim 1 while advantageous implementations and further developments of the invention may be gathered from the subclaims.

Advantages of the Invention

The invention proposes a brush product packaging device for receiving a brush product, in particular a toothbrush, with an application head and with a handle, comprising at least one packaging base body which is configured to form an at least substantially closed receiving region for the brush product and which is implemented at least largely of a paper material. The brush product in particular comprises an application head with a carrier and with a bristle region that is fastened thereto, a handle for holding the brush product as well as a neck for a connection of the handle to the application head.

By a "brush product packaging device" is in particular, in this context, an at least substantially closed device to be understood that is configured to receive a brush product for sales purposes. In particular, the device serves as a sales packaging for a brush product. Preferably the brush product packaging device is in particular configured for horizontal sale and/or upright sale and/or suspended sale. In particular, the brush product packaging device preferably also comprises a euro hole recess for suspending the brush product packaging device. The brush product packaging device is in particular implemented by a primary packaging, i. e. by a product packaging itself. Differently therefrom, there are in particular secondary packagings, which form an outer box which a plurality of primary packagings are collected in. The secondary packagings protect the primary packagings and form a transport unit. The brush product packaging device is in particular configured to accommodate and/or hold the brush products, in particular toothbrushes, transversely, i. e. with their bristle regions aligned perpendicularly to a view direction. In this way in particular tight packing in a secondary packaging is achievable. In the brush product packaging device a head of the brush product is in particular situated top-side.

A "brush product" is in particular to mean an oral hygiene brush and/or a cosmetic brush and/or a hairbrush and/or a household brush. For example, manual toothbrushes, like re-usable toothbrushes, exchangeable-head toothbrushes, one-way toothbrushes or single-tuft brushes, electrical toothbrushes as well as hybrid toothbrushes, interdental cleaners, in particular with twisted-in bristles, implemented in an injection-molded form or as flossers, (that is dental floss attached to an arc), tongue cleaners and/or dental floss are conceivable as oral hygiene brushes. Mascara brushes, nail polish brushes, face brushes, applicators, in particular also hair dye applicators, massaging apparatuses, make-up brushes, make-up sponges, shaving brushes and/or wet razors or other bodycare products are, for example, conceivable as cosmetic brushes. Dishwashing brushes, scrubbers and/or brooms are, for example, conceivable as household brushes. Advantageously the brush product is implemented as a toothbrush, in particular a manual toothbrush, preferentially a children's toothbrush, advantageously a purely manual or a semi-electrical, respectively hybrid, toothbrush, for example with a vibration function or the like. The brush product may also be an electrical toothbrush (rechargeable with battery operation or with exchangeable one-way batteries). The brush product may herein be a one-way toothbrush, a re-usable toothbrush, or an exchangeable-head toothbrush. The brush product in particular has a longitudinal axis that is advantageously arranged at least substantially parallel to a main extension direction of the brush product. Preferentially the longitudinal axis extends at least sectionwise within the brush product and in particular through its center of gravity. In particular, the longitudinal axis of the brush product is a central axis of the brush product and/or a central axis of the handle unit. A toothbrush preferably consists of a head portion with bristles, a neck portion and a handle portion. All sub-elements may be made of at least one hard component and/or one or several soft components. By a "central axis" of an object is in particular an imaginary axis to be understood which runs within the object parallel to a main extension direction of the object, intersecting with the object in maximally two points. "At least substantially parallel" is here in particular to mean an orientation of a direction relative to a reference direction, in particular in a plane, the direction having a deviation from the reference direction that is in particular less than 8°, advantageously less than 5° and especially advantageously less than 2°. By a "main extension direction" of an object is here in particular a direction to be understood which extends parallel to a longest edge of a smallest imaginary rectangular cuboid which just still encloses the object completely.

In particular, the brush product has a length, in particular parallel to the longitudinal axis of the brush product, of at least 110 mm, advantageously at least 130 mm and especially advantageously at least 150 mm, and/or of maximally 250 mm, advantageously no more than 240 mm and especially advantageously no more than 230 mm, wherein other lengths, in particular greater or smaller lengths, are of course also conceivable. In particular, the brush product has a width, in particular parallel to a width axis of the brush product, advantageously perpendicularly to the longitudinal axis and/or parallel to a main extension plane of the brush product and/or the handle unit and a bristle longitudinal axis, of at least 10 mm, advantageously at least 12 mm and especially advantageously at least 15 mm, and/or of maximally 30 mm, advantageously no more than 26 mm and especially advantageously no more than 23 mm. In particular, the brush product has a height, in particular a height measured in parallel to a height axis, respectively the bristle longitudinal axis, of the brush product and/or perpendicularly to the main extension plane of the brush product, that is at least 15 mm, advantageously at least 20 mm and particularly advantageously at least 23 mm, and/or maximally 40 mm, advantageously maximally 35 mm and particularly advantageously no more than 31 mm.

Herein the term "height" in particular refers to a state of the brush product in which it is deposited, for example on a surface like a table plate, a washbasin, a furniture top or the like, in particular deposited in such a way that the longitudinal axis is arranged parallel to the surface. By a "main extension plane" of an object is in particular a plane to be understood which is parallel to a largest side surface of a smallest imaginary rectangular cuboid which just still completely encloses the object, and in particular extends through the center point of the rectangular cuboid.

Advantageously the application head comprises at least one cleaning region, which is configured for a tooth cleaning application, in particular in a user's oral cavity. The cleaning region preferably comprises at least one cleaning element, in particular at least one brush head, advantageously a toothbrush head, preferentially comprising a plurality of bristles and/or bristle bundles. However, the cleaning element may also be implemented, for example, as an interdental brush and/or as a single tuft (e. g. a single large bristle bundle) and/or as an arc spanned with floss, in particular a flosser, and/or as a roll of dental floss, or something like that. Furthermore, the application head advantageously comprises at least one neck element, which is preferentially—in particular directly and/or integrally—connected to the cleaning element. "Integrally" is in particular to mean at least by substance-to-substance bond, for example by a welding process, a gluing process, an injection-molding process and/or a further process that is deemed expedient by someone skilled in the art, and/or advantageously formed in one piece, like for example by a production from a cast and/or by a production in a one-component and/or multi-component injection molding procedure, and advantageously from a single blank. "Configured" is in particular to mean specifically designed and/or equipped. By an object being configured for a certain function is in particular to be understood that the object fulfills and/or executes said certain function in at least one application state and/or operation state.

The brush product in particular has a front side and a rear side, which are in particular arranged facing away from each other. Preferably the cleaning region is arranged on the front side of the brush product. The front side is in particular a side of the brush product visible in a view direction perpendicularly to the longitudinal axis of the brush product and perpendicularly to the width axis of the brush product. The rear side is advantageously equivalent to a side of the brush product that is visible in a view direction that is opposed thereto. The brush product furthermore in particular has an underside on which advantageously, for example, the suction cup is arranged. Moreover, the brush product has an upper side, which is advantageously arranged opposite the underside and in particular in the region of which, for example, the bristle region is attached.

The handle unit preferably comprises at least one handle element, which is advantageously configured for holding with one hand. Preferentially the handle element is implemented so as to be waisted, in particular multiple-waisted. This advantageously allows secure holding and optimizes ergonomics. Especially preferentially the handle element is implemented in an elongate manner, with a longitudinal axis of the handle element advantageously being equivalent to the longitudinal axis of the brush product. The handle element is advantageously implemented partly of a soft component and partly of a hard component. In particular, the handle element advantageously comprises at least a thumb gripping region and/or at least a hand gripping region. Advantageously the thumb gripping region is arranged on the front side of the brush product and in particular on a front side of the handle element. It is conceivable that the thumb gripping region and/or the handle gripping region comprise/comprises at least one element and/or a surface structure that is made of a soft component.

By a "packaging base body" is in particular, in this context, a base body of the brush product packaging device to be understood which in particular forms at least a large portion of a material volume of the brush product packaging device. In particular, the packaging base body forms at least 50%, preferably at least 70% and especially preferentially at least 90% of a material volume of the brush product packaging device. Preferably the packaging base body delimits the receiving region for the brush product. In particular, the packaging base body completely forms a material delimitation of the receiving region. Furthermore, in this context, by an "at least substantially closed receiving region" is in particular a packaging volume of the brush product packaging device to be understood that is materially delimited by the packaging base body at least by 80%, preferably at least by 90%, preferentially at least by 95% and especially preferentially at least by 99%. Preferably the packaging base body serves to avoid a direct contact, respective contamination, of a brush product received in the receiving region from outside the packaging, wherein due to manufacturing reasons there may be folding gaps and/or perforations which make a complete tightness of the packaging base body difficult.

By "at least largely" is in particular to be understood that at least a major portion of a material of the packaging base body is a fiber and/or paper material. Preferably at least 50 weight percent, preferably at least 70 weight percent and especially preferentially at least 90 weight percent of the packaging base body are implemented of a paper material. Particularly preferentially the packaging base body is implemented completely of a paper material. Moreover, a "paper material" is in particular, in this context, to mean a planar material implemented essentially of fibers of organic and/or plant origin. Preferably the material is produced from cellulose, groundwood and/or wastepaper. The material may herein be implemented in a one-layered or in a multi-layered fashion. Multi-layer paper material is implemented of several layers of paper with different thicknesses and/or at least partially of different material/s. The layers may herein be produced by gluing together or pressing together, in particular without using glue. The grammage of the paper material is herein in particular between 50 $g/m^2$ and 1000 $g/m^2$, preferably between 150 $g/m^2$ and 600 $g/m^2$. Preferably the paper material is implemented of fresh fibers and/or secondary fibers. A fresh fiber, respectively primary fiber, is herein implemented of new material, like for example FSC wood. A secondary fiber is in particular implemented of a recycled paper and/or cardboard. Alternatively or additionally further filling materials are conceivable, like other organic fibers, for example grass for grass paper. Preferably the paper material has a recycled content of at least 80%, wherein the paper material may contain a fraction of primary fibers. Using new material allows keeping the characteristics of the paper material within a closer range. Different paper materials deemed expedient by someone skilled in the art are conceivable for the packaging base body. In particular, the packaging base body is made of solid cardboard, in particular of packaging cardboard. An implementation in corrugated cardboard is also conceivable, in particular of corrugated cardboard with a low height. Beyond this, different surfaces are conceivable for the paper material. The paper material may in particular be painted, i. e. coated, as well as unpainted, i. e. uncoated. It is moreover conceivable that the paper material is structured, like for example by a three-dimensional contour. A structuring in particular allows improving a grippability of the brush product packaging device. In particular, the structuring may be realized in the paper material itself, like for example by a surface treatment and/or embossing, as well as in a printing.

The paper material may, for example, have a printing that is implemented of water-based varnishes, which are ecological with respect to customary varnishes.

The paper material may be refined. By a "refinement" is here a surface treatment of the paper material to be understood which, for example, results in the paper material having a high-grade appearance. The refinement may be applied/realized respectively partially in one or several places or on the complete surface. The refinement may, for example, enable a realization of metallic effects, optical distinctions or product letterings. By an appropriate coating, furthermore a reduction or avoidance of water intake by the paper material is also achievable. The paper material may thus be also suitable for multiple use. For example, a refinement may be a varnishing, wherein for example a UV high-gloss varnish, a structured varnish, a soft-touch varnish or glitter varnish may be applied. Film lamination and/or hot film stamping may be used to connect several layers, for example connecting cardboard to a film. Herein matt films, gloss films or structured films may be used. Stampings/stamp-film printing may be used, wherein in particular flat or relief stamping is possible. Lamination or sealing in may also be utilized for a refinement.

The paper material as well as further parts of the packaging, like for example a separate holding member made of plastic, may as well be scented, such that the packaging is provided with a scent which is in particular released upon opening. Furthermore, corresponding parts may also be provided with an antibacterial substance, which allows overall sanitizing of the packaging, wherein in particular certain packaging elements which are in contact with the product, for example in the region of the application head, are provided therewith.

"Configured" is in particular to mean specifically programmed, designed and/or equipped. By an object being configured for a certain function is in particular to be understood that the object fulfills and/or executes said certain function in at least one application state and/or operation state.

The implementation according to the invention in particular allows providing a packaging that can be produced in an advantageously simple and cost-efficient manner. In particular, an advantageously flexibly producible and printable brush product packaging device can be provided. Furthermore, an advantageously high level of protection of an accommodated brush product is achievable. It is in particular possible to provide an advantageously stable brush product packaging device. Beyond this, an advantageously high-grade ecology of the brush product packaging device is achievable. In particular when using recycled paper material, a high-grade ecology is achievable. It is moreover possible to provide a brush product packaging device implemented of sustainable materials.

It is further proposed that the brush product packaging device comprises at least one holding unit, which protrudes at least partly into the receiving region and is configured to hold the brush product, in particular by the handle or by a neck, at least partly in a position relative to the receiving region, and which is implemented at least largely of a paper material. Preferably the holding unit may be realized by a separate unit, like for example by at least one insert, and may also be realized integrally with the packaging base body. In particular, the holding unit may be implemented merely by a shaping of the packaging base body. It would in particular be conceivable that the holding unit is realized by a shaping of the packaging base body. Furthermore, the holding unit may preferably have a universal shape and be thus utilizable for different brush products, or it may alternatively have an individual shape and be thus adapted to a specific brush product and a specific packaging base body. By a "holding unit" is in particular, in this context, a unit to be understood which is configured for an at least partial fixation of the brush product in the receiving region of the brush product packaging device. The holding unit may have a certain pre-tension onto the brush product. This pre-tension is preferably exerted on the handle and/or the neck, with the brush head, respectively the bristles, preferably remaining free of pre-tension. The applied pre-tension is sufficient for holding the brush product in its position during transport. For this pre-tension forces of less than 100 g, preferably less than 50 g, especially preferentially less than 20 g, are usually sufficient. Brush products are mostly implemented of hard synthetic materials, soft synthetic materials and bristles. In order to provide maximum protection, a possible pre-tension is preferably exerted substantially onto the hard synthetic material of the handle and less preferably onto the soft synthetic material of the handle, but not onto the bristles, respectively the bristle region. A fixation is herein in particular achievable by an accommodation of a portion of the brush product in a holding recess of the holding unit and/or by a clamping of the brush product in the receiving region, for example relative to the inner face of the packaging base body. Preferably the holding unit is configured to reduce a movement tolerance of the brush product in the receiving region in contrast to a missing holding unit. In particular, the holding unit is configured to reduce a damaging and/or a deformation of the bristles of an application head of the brush product by a movement of the brush product within the receiving region. In particular, a rattling noise caused by a movement of the brush product within the brush product packaging device, in particular when the brush product packaging device is shaken and/or transported, can be avoided by means of the holding element. It is further possible to achieve a protective function. In particular, product parts like the brush head, respectively the bristle region, can be protected by the brush being supported/held in such a way that there is no load on the bristles. It is also possible to protect deformable product parts which are made of a soft synthetic material, like suction cups, tongue cleaners and handle elements. This in particular allows achieving a reliable securing of the brush product in the brush product packaging device. In particular, damaging of the brush product during transport is avoidable.

In particular, different holding units are conceivable which are deemed expedient by someone skilled in the art. It would in particular be conceivable that the holding unit is combined with a rip-open tab of a perforation strip, such that the holding unit is removed when the product is ripped open, and thus a clamping, respectively the pre-tension, is released upon opening. It would also be conceivable that the holding unit comprises at least one element that is formed in the receiving region of the brush product packaging device when the packaging base body is uprighted. Such an element may, for example, be glued in and may protrude into the receiving region as a projection. While this would in particular have no influence on a tightness of the packaging base body in regard to dust, additional cardboard would be required. Such an element may in particular be fastened over an edge, the element being fastened on two sides respectively, with creasings and/or perforations being provided in between. When the sides are uprighted relative to each other, the element will rise and a clamping element will be formed. Alternatively or additionally it would be conceivable that the holding unit comprises a double-adhesive, in particular a double-faced adhesive tape, which is for example attached on a bottom of the packaging base body, such that the brush product is fixed by the adhesive strip. The adhesive strip is designed in such a way that, while it is well anchored on the brush product packaging device, yet the brush product can be released therefrom with little force input and no residue will be left on the brush product. The brush product is herein releasable simply by lifting it off the adhesive strip, wherein a possibility of movement is restricted. However, depending on a filling of the brush product packaging device, introducing the double adhesive and/or the brush product may be encumbered, in particular in case of a filling from an underside or from an upper side. Alternatively or additionally, it would be conceivable that the holding unit comprises an additional component as a holding member, which is adapted to a shape of the product, which is laid into the packaging base body in advance and/or is produced together with the packaging base body and/or is introduced together with the brush product. In case of a filling from an underside or from an upper side, it would in particular be conceivable that the additional component is brought together with the brush product before introduction into the packaging base body, and this combined unit is introduced as a whole into the packaging base body, respectively into the receiving region. The additional component in particular has a close-fitting shape. The additional component may furthermore be glued and/or sealed into the packaging base body, or may be clamped in the packaging base body without a firm fixation and/or anchoring, or it is possibly not fixed at all. In particular, the additional component may also be implemented as a formed blister and/or as a formed deep-drawn piece, which is preferably produced from a synthetic film, said film being preferably produced from a sustainable synthetic material, namely in particular based on a recycled material or a renewable raw material.

Furthermore, an implementation of a holding unit is possible, which is introduced along the main extension direction of the brush product packaging device, respectively of the packaging base body, into the brush product packaging device which is implemented correspondingly. This may be utilized, for example, if the brush product packaging device is implemented as a rectangular-cuboid-shaped sleeve. The holding unit is herein preferably implemented in such a way that it forms one, two or even more fixation regions, which fix the brush products or other parts which are packaged together with the brush products. The fixation regions may in this case have different shapes, which are in each case adapted to the brush product that is to be fixed. Herein, for example, different brush products may be packed in a brush product packaging device, for example an exchangeable-head toothbrush with a plugged-on exchangeable head and one or several further exchangeable head/s parallel thereto. The holding unit is herein designed in such a way that it fits exactly into the sleeve when it is loaded. For this purpose, in a prepared state the outer contour is designed to fit into the inner volume of the sleeve, such that no displacement of the holding unit will occur in this X-Y plane. For a positioning in the Z-plane of the height, sidewise tabs may be formed on the holding unit, which fix the unit of brush product and holding unit together with the possibly protruding brush product in the respective direction.

The sidewise tabs are herein molded at least on two opposite-situated sides. Herein the tabs are preferably molded on the sides having the largest extents, i. e. on the sides implemented in parallel to the main extension direction. The tabs on the other sides may also be molded, such that in total preferably between two and four tabs are formed, which are formed over the entire length of the holding unit. For an optimum fixation of the holding unit it is also possible to align two tabs with the front side and two tabs with the rear side of the brush product packaging device, such that the holding unit is optimally fixed in all directions.

It furthermore possible to realize the tabs at least partly by the creasing of the folding, such that a partial tab is formed on both sides of the creasing. In this way a fixation of the holding unit is achievable in the height direction.

The tabs may of course also be divided up, such that quasi several tabs are formed for each side. This may, for example, serve to release respective counter geometries. For example, the tab may be divided in two perpendicularly to the main extension direction if, for example, an inward-projecting element is implemented that encumbers the tab. Or a tab may be recessed, allowing the corresponding brush product being fix well in the holding unit. It is also possible that fixation regions for brush products extend up to the margin of the holding unit, resulting in interrupted tabs.

The sleeve may also, for example, be equipped with one or several viewing window/s, wherein the holding unit with the fixation region/s is preferably implemented in such a way that at least a portion of the brush product can be identified through a viewing window.

In a context of the utilization of a sleeve, a larger implementation of the holding unit may provide further advantages. For example, the sleeve may be equipped with an opening aid, which is implemented in such a way that it enables for example re-closing. In a brush product packaging device with a plurality of brush products inserted therein, it is in this way achievable, for example, that the holding unit can be pulled out, the required products are removed and the remaining products can be stored in a cleanly packaged manner.

This product structure may also be used, for example if only one product is packed, as a travel pouch.

Beyond this, a holding unit implemented in the manner set forth above may also be used for a brush product packaging device that is filled from the front side and/or from the rear side. The above-mentioned implementation, among others, of the tabs may also be realized as described.

In particular, implementation of rather complex holding units is enabled, which take up greater dimensions and are in particular also capable of holding/accommodating several different products.

One complex holding unit is implemented in such a way that it forms at the same time the packaging base body. For this purpose, the blank is cut accordingly in regard to a contour; it is creased and is equipped with special functions like (a) viewing window/s and printing, such that both the innards and the outer shape are created with an appropriate folding. During production, the packaging is prepared and uprighted accordingly, such that the product can eventually be slid into the packaging from above or below. A portion of the packaging may in particular be implemented as an empty space—in order to achieve a standardized packaging size.

This is in particular achieved parallel to the main extension direction of the brush product packaging device next to the product and/or directly adjoining the product at the top in a main extension direction, in each case separated off by the corresponding portion of the blank. The empty space is in the main extension direction delimited by a portion of the blank that is fastened to the inner portion and by the outer sleeve. The holding unit may also comprise recesses which improve a fixation of the product. For example, product portions which protrude a bit can be held in recesses, such that the product is securely held/fixed. It is furthermore possible to create delimitation portions which also serve for a secure positioning of the product.

A further complex holding unit is implemented in such a way that it forms an inner geometry that is subsequently slid into a rectangular-cuboid-shaped sleeve-like cardboard box/packaging base body. The packaging base body is herein formed in the shape of a rectangular cuboid and is provided with corresponding openings and tabs, such that the holding unit can be slid into the sleeve-like packaging base body along the main extension direction. The holding unit is therefore realized as a blank that is separate from the packaging base body. The holding unit may comprise elements for holding a brush product—which is, for example, presented in a viewing window of the packaging base body. The holding unit may further comprise elements for holding accessory parts or replacement part, like plug-on brushes. The holding unit is loaded with the products already before it is slid into the packaging base body.

The slid-in holding units may have elements/geometries in their blanks which serve to permit pulling out of the sleeve. It is for example possible that die cuts are introduced which can be pushed in, such that the holding unit can be gripped with a finger.

Principally the packaging base bodies may in all their variants also be implemented so as to enable a sliding-in transversely to the main extension direction.

The respectively created empty space may be used for extras related to the product and for product accessories. It is thus for example possible to accommodate mains adapters, charging stations, manuals, replacement heads, hygienic caps, etc. in the empty space such that they are packaged with the product but do not appear visually.

In both complex versions of the holding unit described above, an identical outer appearance of the brush product packaging devices is achievable. As described, the structures of the brush product packaging devices may of course differ as well as the contents of the brush product packaging devices.

It is further proposed that the at least one holding unit is implemented at least partly integrally with the packaging base body. Preferably the at least one holding unit is implemented completely integrally with the packaging base body. "At least partly integrally" is in particular to mean, in this context, that at least one component of at least one object and/or at least one first object is implemented integrally with at least one component of at least one further object and/or integrally with at least one further object. "Integrally" is in particular to mean at least connected by substance-to-substance bond, for example by a welding process, a gluing process, an injection-molding process and/or another process that is deemed expedient by someone skilled in the art, and/or advantageously formed in one piece, like for example by a production from one cast, in particular from one blank, and/or by a production in a one-component or multi-component injection-molding procedure, and advantageously from a single blank. This in particular allows keeping a number of components small. In particular, simple and fast production of the brush product packaging device is achievable.

Beyond this it is proposed that the at least one holding unit comprises at least one holding member, which is formed by an indentation in the packaging base body. Preferably the holding member is implemented by a waist in the packaging base body, in particular in a hood element of the packaging base body. In particular, the brush product is pressed into the intended position, respectively held in the intended position, by means of the holding member via a pre-tension. In particular, the brush product is pressed to an inner face of the packaging base body by means of the holding member. Principally, it would also be conceivable that several, in particular two or three, respective holding members are provided, which are arranged, for example, on opposite-situated edges of the packaging base body and/or on the same edge of the packaging base body. It would also be conceivable that the indentation is laid over the rear edge, such that the resulting contour protrudes into the side surface and the rear side of the packaging base body. In particular, the at least one holding member is realized by a creasing, respectively by a formed edge, in the packaging base body. The resulting indentation may herein also bring about a deformation of the remaining surface, such that for example a rear side is no longer flat. Alternatively or additionally, the at least one holding member may also be embodied as a clamping element in the hood element. Such a clamping element may in particular be realized, for example, by two cuts over an edge of the packaging base body, the edge being in particular folded inwards, thus forming an inwards-projecting ledge. The holding element is in particular produced by a deformation. Such a clamping element will result in relatively large openings of the cuts. In this way in particular a reliable securing of the brush product in the brush product packaging device is achievable. In particular, damaging of the brush product during transport can be avoided. It is thus in particular achievable that the brush product may as well be secured subsequently, in particular after packaging, by a deformation of the packaging base body.

It is also proposed that the at least one holding unit comprises at least one holding member, which is formed of existing portions of the brush product packaging device. It is herein for example possible that elements, like dust tabs, sealing margins or gluing tabs, are formed in such a way that they are partially implemented as holding members, thus supporting the product in the packaging. It is furthermore also possible, in particular with dust tabs, that they are used for purposes other than intended. This means that dust tabs are for example used no longer as dust tabs but as holding members, for example if they are folded into the receiving region of the packaging base body. Preferably the dust tabs are in at least one implementation embodied as holding members of the holding unit and are configured to hold the brush product, in particular by its handle or neck, at least partly in a position relative to the receiving region.

Furthermore, it is proposed that the at least one holding unit comprises at least one folding element. Preferably the folding element is implemented by a separate component that differs from the packaging base body. The holding unit may in particular comprise one or several folding element/s. In particular if there are several brush products in the same receiving region, several folding elements may be expedient. It is however also conceivable that several folding elements are necessary, depending on a brush geometry of the brush product. If there are several folding elements, the brush product may in particular be once laid-in and once clamped, or several times laid-in and several times clamped. By a "folding element" is in particular, in this context, an element to be understood that is realized by folding a paper material. In particular, the folding element is produced from a flat blank, in which the folding options are already incorporated, in particular in the form of creases and/or perforations. Preferably, the folding element is implemented by an insert piece for the packaging base body. In particular, the folding element is configured to be arranged in the receiving region of the brush product packaging device. In particular, the folding element is configured for a fixation of the brush product in the receiving region. As has been described, a fixation may herein in particular be achieved by pre-tensioning, respectively clamping and holding, the brush product between the folding element and the inner face of the packaging base body, and may also be achieved by a recess in the folding element, which the brush product is laid in directly. Principally, a combined folding element with a recess and with a clamping possibility would also be conceivable. A "crease" is in particular to mean a deformation in a piece of cardboard produced by a forming process. For example, the piece of cardboard is weakened in advance in its fold by a so-called crease line in order to facilitate folding of cardboard sheets. Herein, in particular a line-shaped material displacement takes place in order to create improved bendability. A "perforation" is in particular to mean, in this context, that holes are formed in hollow bodies or flat objects. This in particular allows achieving a reliable securing of the brush product in the brush product packaging device. In particular, damaging of the brush product during transport can be avoided. In particular, in this way an optimized fixation of different brush products is achievable independently from the packaging base body. It is in particular possible to package different brush products in the same packaging base body.

It is also conceivable that, depending on a folding angle of the folding element, different heights of the folding element can be realized, which will of course result in differences in the length and width dimensions, said dimensions increasing in a same component due to reduced height. In this way different effective dimensions of an accommodation may preferably be realized with the same folding element, thus enabling a fixation of different brush products having different shapes, respectively geometries. Fastening and positioning of the folding element may be brought about in different ways which are deemed expedient by someone skilled in the art. The folding element may be merely laid in, and may be positioned, for example, by clamping between the side surfaces. This may, however, result in slipping. Alternatively, the folding element may be fixed, like for example by gluing, by hooking-in, by clamping-in in recesses and/or cutouts, and/or by sealing.

The position for a fixation of the brush product is in particular variable. The position in particular depends on a geometry of the receiving region and a geometry of the brush product. A preferred position for a fixation of the brush product is in particular a neck of the brush product. It is here in particular possible to achieve both reliable fixation and reliable protection of the bristle region.

It is further proposed that the at least one folding element forms at least one recess for receiving a neck of a brush product. In particular, the folding element forms a groove-shaped recess. Preferentially the recess is introduced in at least two surfaces of the folding element. In particular, at least two surfaces of the folding element in each case have a recess, said recesses being connected to each other on at least one side. The recess may have different shapes. Preferably, in a folded state of the folding element, the recess tapers conically from a free end, which in particular enables better clamping. Especially preferentially the recess is trapezoid-shaped or semi-oval-shaped. In particular, the groove has in a lower region a width of 3 mm to 10 mm, preferably of 3 mm to 6 mm. Furthermore, the recess has on a free, open end with a width of in particular 4 mm to 15 mm, preferably of 5 mm to 10 mm. The depth of the recess is, measured on the surface of the folding element, in particular 3 mm to 12 mm, preferably 5 mm to 10 mm. In this way in particular advantageously direct securing of the brush product in the brush product packaging device is achievable. In particular, damaging of the brush product during transport can be avoided.

Moreover, it is proposed that the at least one folding element comprises at least one fixation section, which is configured to tension a neck of a brush product against the packaging base body. Preferentially the fixation section may in particular be provided in addition to a groove, in particular so as to enable a fixation of different brush products having different shapes, respectively geometries, with the same folding element. This in particular allows packaging different brush products with the same brush product packaging devices, preferably with different printings. The folding element preferably has three regions, namely a first fastening region, in which the folding element is connected to the packaging base body, a fixation region, in which the folding element is configured for a fixation of the brush product, and a second fastening region, in which the folding element is connected to the packaging base body. Preferably the fixation region is arranged between the first fastening region and the second fastening region. Preferentially the fixation region of the folding element forms an elevation. Particularly preferentially the fixation section is formed by a side contour of the fixation region. In particular, the fixation section forms together with a side wall of the packaging base body a narrowing in the receiving region, in which the brush product can be fixed. By a "fixation section" is in particular, in this context, a contour, in particular an outer contour, of the folding element to be understood which is configured for directly contacting the brush product. Preferably the contour is configured for a clamping of the brush product and/or for applying a pre-tension to the brush product between the contour and a side wall of the packaging base body. This in particular allows achieving an advantageously direct securing of the brush product in the brush product packaging device. In particular, damaging of the brush product during transport can be avoided.

It is also proposed that the at least one folding element is implemented so as to be connected to the packaging base body. Preferably the at least one folding element is implemented so as to be glued into the packaging base body. Preferably the folding element is glued planarly with the packaging base body in the at least two fastening regions. In particular, the folding element is glued on an inner face of the packaging base body on a base side of a hood element. In this way in particular a slipping of the folding element can be avoided. In particular, a selective positioning of the brush product in the receiving region is achievable.

It is moreover proposed that, in a state when arranged in the packaging base body, the at least one folding element has an approximately circular base surface. Preferably, in a state when arranged in the packaging base body, the folding element is realized to be mounted and folded. Preferably, in its non-folded state, the at least one folding element has an egg-shaped outer shape, the outer shape being implemented such that it has a circular base surface in the folded state. A circular base surface provides the advantage that the folding element is arrangeable in a position in any desired orientation. Due to the circular shape, the folding element can in particular be positioned as desired, in particular in regard to an angle between an accommodation of the folding element and the longitudinal axis of the brush product. In this way, it is in particular possible to cover different neck thicknesses in regard to the opening. The same also applies in particular with a clamping of the brush product on an outer face of the folding element. Alternatively, it would also be conceivable that the folding element has a shape approximated to a circle shape, like in particular an n-edge polygonal shape. In this way an advantageous positioning of the folding element would be achievable if the folding element adjoins an edge of an inner face of the packaging. In particular, the circular or approximately circular geometry of the folding element allows a positioning of the folding element in any desired angle to the longitudinal axis. The angle may herein in particular be adapted to and may also differ from a clamped or laid-in brush product, depending on a respective application. Alternatively, it would also be conceivable that the at least one folding element has a rectangular outer shape. In this way in particular advantageous clamping of the folding element in the receiving region would be achievable. It would in particular be conceivable that the folding element, for example, extends from one side of the receiving region to the other side, as a result of which the folding element is arranged at least partly in a positionally stable manner. This would in particular enable a mounting without gluing. However, a rectangular outer shape in particular provides less variability in regard to positioning, application, in particular in regard to clamping, and/or to a possibility of orientation. In the case of the rectangular outer shape, it would however be conceivable that for elevation purposes, the folding is oriented in an angle relative to the outer shape that differs from 90°.

It is furthermore proposed that, in a state when arranged in the packaging base body, the at least one folding element has a maximum extension of 10 mm to 50 mm. A non-folded blank of the folding element in particular has a length of 20 mm to 50 mm, preferably of 30 mm to 40 mm. The non-folded blank of the folding element in particular has a width of 10 mm to 30 mm, preferably of 9 mm to 13 mm. In a folded and mounted state, the folding element in particular has a circular base surface. A diameter of the base surface is in particular 10 mm to 30 mm, preferably 9 mm to 13 mm. A height of the folding element in a folded and mounted state is in particular 8 mm to 16 mm, preferably 9 mm to 13 mm. This in particular allows providing an advantageous folding element.

If the folding element occupies a large portion of the receiving region, it is proposed that, in a state when arranged in the packaging base body, the at least one folding element has a maximum longitudinal extension of 170 mm to 210 mm and a maximum transversal extension of 35 mm to 55 mm. A height of the folding element is in a folded and mounted state in particular 8 mm to 25 mm. This in particular allows providing an advantageous folding element.

Beyond this it is proposed that the at least one packaging base body comprises a planar card element and a folded hood element superimposed on the card element, which are respectively implemented at least largely of a paper material. Preferably, in a mounted state, the hood element is firmly connected to the card element. Preferentially, an extent of the hood element along the main extension direction of the brush product packaging device is at least substantially equivalent to an extension of the card element along the main extension direction of the brush product packaging device. The card element is in particular arranged on a front side of the brush product packaging device and in particular has a euro hole recess at an upper end. The card element may in particular also be implemented as a rear side, such that the hood element forms the front side, respectively the visible side. Preferably the card element is implemented at least substantially rectangular. Principally, the card element may be implemented having a contour, but only outside the sealing. Furthermore, the card element is preferably flat. This in particular allows realizing a sealing margin in a plane. However, it would principally also be conceivable that the card is angled, respectively has one or several folds. For this the sealing tool needs to be structured in several planes, such that the sealing surface is angled. Depending on an implementation, this allows creating sub-optimal stacking, which is however also dependent on an implementation of the hood element. The hood element is in particular arranged on a rear side of the brush product packaging device. The hood element in particular comprises delimiting surfaces delimiting the receiving region as well as sealing margins connected to the delimiting surfaces and configured for a connection to the card element. The sealing margins are in particular connected to the delimiting surfaces via perforations and/or creasings. In the case of perforations, these have a cut length that is in particular 1.5 mm to 7 mm, preferably 2.5 mm to 5.5 mm, and a holding length that is 1 mm to 4 mm, preferably 1.5 mm to 3 mm. The perforation should herein in particular be stable, such that it will not rupture due to shocks during transport. In the case of creasing, in particular a notch is introduced mechanically into a paper-containing or cardboard-containing material, which results in a crease, and thus the material can be folded in this place in a defined manner with less force input. Preferably, in the transitions to the sealing margins the hood element does not have a pure creasing but merely a creasing with perforation. This in particular allows providing an advantageously manufacturable packaging base body. In particular, advantageous loading of the packaging base body is achievable. In particular, laying-in of the brush product from a front side is achievable. In particular, a tub formed by the hood element is accessible from the top, thus enabling top-loading, i. e. filling the hood element from above. In this way advantageous automatization is achievable.

Preferably, a cardboard blister over several different products of similar type can be provided by way of the brush product packaging device. It would in particular be conceivable that the hood element is on its rear side identical for all brush products while the card element varies on the front side, for example in regard to its contour. Different brush products are in particular fixed using different fixing elements or using variable fixing elements, which are adapted to the product during the packaging process. In particular, simple manufacturing is achievable as machines need to be re-adjusted only slightly between products.

Preferentially the packaging base body is produced of solid fiberboard. The card element in particular has a length of 50 mm to 300 mm, preferably of 100 mm bis 260 mm. The card element further has a width of 20 mm to 150 mm, preferably of 35 mm to 135 mm. The grammage of the card element is in particular 200 g/m$^2$ to 500 g/m$^2$, preferably 250 g/m$^2$ to 450 g/m$^2$. Preferably the hood element has the same material thickness as the card element. It would however also be conceivable that the card element is more stable than the hood element, like in particular due to higher grammage and/or greater material thickness. For example, the card element could have a grammage of 300 g/m$^2$ while the hood element has a grammage of 250 g/m$^2$. In a flat state, the hood element in particular has a length of 70 mm to 320 mm, preferably of 110 mm to 280 mm, in particular including the euro hole recess. Furthermore, the hood element has in a flat state a width that is in particular 40 mm to 150 mm, preferably 50 mm to 120 mm. Herein the width is composed, in a sequence from side to side, of a sealing margin, a side height, a tub width, the side height and a further sealing margin. In a formed state of the hood element, the inner dimensions of the tub that forms the receiving region, on a side facing toward the card element, constitute a length of 50 mm to 250 mm, preferably of 100 mm to 200 mm, and a width of 15 mm to 60 mm, preferably of 20 mm to 40 mm. The hood element has, from a side facing the card element toward a bottom, a conicity, the conicity being in particular identical on opposite-situated sides. An angle of the conicity is in particular 2° to 20°, preferably 2° to 10°. This implementation enables a stable structure providing sufficient protection of the product during transport. Furthermore, the height of the hood element is in a formed state in particular 10 mm to 25 mm, preferably 14 mm to 20 mm. The total height of the packaging base body is in particular 8 mm to 35 mm, preferably 12 mm to 25 mm. Preferably this constitutes a multiplier, in particular a multiplier of 9.13 mm, which is a flute distance of a tray packaging. In the case of a deviation from the multiplier, it is in particular possible to create a clearance or a bunching in the secondary packaging. The grammage of the hood element is in particular 200 g/m$^2$ to 500 g/m$^2$, preferably 250 g/m$^2$ to 450 g/m$^2$. Preferably the front side and the rear side of the packaging base body are parallel. In this way an optimized space for putting up as well as a certain stackability are given. When putting up, in particular putting up in a tray is enabled with as little clearance, respectively distance, as possible. The packagings may in particular be put up adjoining one another. In this way, the stability of the primary and secondary packagings is maximized. Alternatively, it would also be conceivable that the packaging base body is parallel top and bottom, and has less height in its center. In this way, a clearance, respectively a distance, is created in particular in the center. Principally it would also be conceivable that the front side and the rear side of the packaging base body are not parallel, i. e. have, for example, a conical shape. In such a case, interlaced stacking is possible in order to avoid clearance, respectively large distances, in the packaging. This in particular offers neither optimum product presentation nor optimum storage. Alternatively, it would also be conceivable that the packaging base body is parallel in one region and is not parallel in another region, like in particular with a conical shape. Herein in particular implementations are possible in which hollows or the like do not extend beyond the parallel portion, which allows optimized stacking. It would in particular be conceivable that the hood element is not angular but arched and/or even has a contour with concave, respectively convex, elements, in particular for example like an air-supported structure. Herein a creasing could be implemented, in particular in the highest point, in order to improve an implementation of the contour. The edges of the hood element could be sealed further. It should, however, be taken into account that such a contour cannot be shaped with high accuracy, which may result in shape tolerances. The hood element could for this purpose be deformed during the packaging process by heat and/or pressure and/or feeding in humidity (e. g. steam).

The brush product packaging device may in particular serve as a single pack, as a twin pack or as a three-pack. In an implementation as a twin pack or three-pack, in particular several independent or interconnected hood elements may be provided, which are superimposed on a card element, wherein in particular each hood element can be opened separately. The card element may be implemented in such a way that it is separable between the hood elements, e. g. by means of a perforation. The hood elements are herein in particular implemented identically. It would however also be conceivable that only one hood element with subdivisions for several brush products is provided. Preferably, in this case several brush products are arranged in a tub of the hood element. Herein it would in particular be conceivable that the hood element is openable and reclosable. In particular, a plurality of holding members and/or folding elements may be provided. Depending on a number of brush products and depending on an arrangement of the brush products in the tub of the hood element, the dimensions of the hood element and the size of the card element change accordingly.

The brush product packaging device for a multiple pack may be implemented in such a way that the individual hood elements are formed in such a way that they can be severed off separately. Herein the individual hood elements assigned to the products are sealed individually. The respective sealing regions are spaced apart by 1 mm to 5 mm. In this region a perforation is implemented allowing the separating off of individual hood elements, and thus also of individual products. In such a case a perforation may possibly continue over the entire card up to and beyond the euro hole recess; the grammage of the card and the position of the perforation relative to the euro hole recess should be selected such that stability is still ensured.

Besides the brush product, further different products may be introduced into the packaging, which is in the broadest sense of the term kind of a multiple pack. These are, for example, a further exchangeable head of an exchangeable-head toothbrush, a miniature toothpaste tube, replacement battery/batteries, flosser/s, interdental brushes, several exchangeable heads for plug-on brushes. Moreover, a manual or other product documentation may be inserted. These could be fixed, for example, by means of a holding unit.

A multiple pack may furthermore also be achieved by fixing a plurality of products on a holding unit, as has been described above.

It is also proposed that the at least one packaging base body comprises, on at least two opposite-situated edges which extend at least substantially parallel to a main extension direction, respectively one guiding section having a reduced depth extent. Preferably, the guiding sections in each case have a reduced depth extent relative to the total depth extent. Preferentially, the packaging base body has in the at least two guiding sections straight outer edges, which are parallel to each other. The guiding sections in particular serve for an accommodation of the brush product packaging device in a tray packaging. Herein the brush product packaging device is in particular inserted into guides of the tray packaging. Preferably a lower edge connecting the two guiding sections is implemented straight in order to enable improved standing of the brush product packaging device in a tray packaging. As a result, in particular a support is enabled. Preferably, in the guiding sections the edges are in each case implemented not rectangular but rounded, thus enabling favorable insertability and/or introducibility into a guide. A maximum thickness of the packaging base body is in the guiding sections in particular 0.2 mm to 2.5 mm, preferably 0.3 mm to 1 mm. For an accommodation in a plastic base of a tray packaging, the thickness of the guiding sections is in particular approximately 1 mm. If there is a packaging insert of the tray packaging made of corrugated fiberboard, a greater thickness tolerance is possible and there are larger free spaces. The width of the guiding sections is in particular 1.5 mm to 6 mm, preferably 2.5 mm to 4.5 mm. For an accommodation in a plastic base of a tray packaging, the width of the guiding sections is in particular approximately 3 mm. The width of the guiding sections is here in particular defined by the area until the thickness of the packaging base body increases substantially, in particular until the tub of the hood element begins. If there is a packaging insert of the tray packaging that is made of corrugated fiberboard, a height of the guiding sections is adapted to the height of the packaging insert. It would, however, also be conceivable that the guiding sections extend over the entire main extent of the packaging base body. It would also be conceivable that two opposite-situated edges, which extend at least substantially parallel to a main extension direction, have a conicity toward the lower end. Principally, it would also be conceivable that the guiding sections have a rounded contour, wherein preferably there is a straight partial section at a lower edge. In this way in particular advantageous insertability of the brush product packaging device in a tray packaging is achievable.

Furthermore, it is proposed that the at least one packaging base body is in the guiding sections in each case implemented at least partly in a multi-layered manner. Preferably, both the card element and the hood element are arranged in the guiding sections. It is further proposed that the card element and the hood element are arranged in the guiding sections in each case at least partly overlapping. In particular, in the guiding sections the sealing margins of the hood element respectively overlap the card element. It is also possible that for example, with corresponding dimensional differences, only the card element is present in the guiding sections. This means that the card element has a much greater width than the hood element, and the guiding sections are eventually formed only on the hood element. Alternatively, the packaging base body is respectively folded concertina-wise in the guiding sections. Herein it would in particular be conceivable that the packaging base body has a lentiform cross section in a lower region, in particular a handle region, that faces away from the euro hole recess, wherein the guiding sections are respectively arranged in the pointedly tapering sides of the lentiform cross section. This in particular allows achieving an advantageously high stability of the guiding sections.

Beyond this it is proposed that the packaging base body comprises a handle region accommodating the handle of the brush product and a head region accommodating the head of the brush product, wherein the guiding sections are arranged exclusively in a handle region of the packaging base body. Preferably a shape, in particular a cross section, of the packaging base body in the handle region differs from a shape, in particular a cross section, of the packaging base body in the head region. This in particular permits an advantageously large implementation of the packaging base body in the head region. It is in particular possible to do without a guiding section in the head region.

Optionally the card element may be implemented in a double fashion. This means that the card element is formed, on the one hand, as a card element and, on the other hand, as an outer frame of the card element, wherein these two parts are connected to each other via a folding. The card element is connected to the outer frame, i. e. the recess is connected to the hood element. In this way the hood is stabilized and the product is eventually removable from the receiving region through the recess. The card element connected via the folding is laid over the card element with the recess by way of the folding, with the outer geometries being identical and the difference in size being less than 5 mm, preferably less than 2 mm. After the connection and the filling of the packaging, using the folding, the card element is laid upon the card element having the recess and is connected thereto, for example by adhesive strips which are guided over the outer margin. It is furthermore also possible that the card element has already been laid upon the card element having the recess and has been connected, for example, via a perforation. In this case the hood element would be formed and filled with the product; and the card element prepared as described above would be laid upon the hood element and connected thereto. The packaging formed in this way may be implemented so as to be reclosable and may also be used in this manner.

It is moreover proposed that the at least one packaging base body comprises at least two converging edges, which in each case extend substantially parallel to a main extension direction. Preferably the at least one packaging base body comprises at least two converging edges on opposite-situated sides, said edges in each case extending substantially parallel to a main extension direction. Preferably, the converging edges extend in each case over a substantial portion of a main extension of the packaging base body, wherein the converging edges in particular peter out in a handle region. Preferentially the four converging edges form in a head region in each case one of the four side edges of a rectangular cross section of the packaging base body. Preferably the edges of the packaging base body in each case converge towards the guiding section. In particular, the edges are waisted with respect to the front side and the rear side. Particularly preferentially, between the respectively at least two converging edges in each case a further folding edge is arranged, said folding edges extending in each case substantially parallel to a main extension direction. The further folding edges in each case in particular form the edge of one of the guiding sections. In this way it is in particular advantageously possible to form the guiding sections. As a result, the guiding sections can in particular be implemented advantageously thin, such that an insertion into a tray packaging is reliably enabled. In particular, a change of a cross section of the packaging base body along the main extension direction is achievable.

Furthermore, it is proposed that the at least one packaging base body comprises a handle region accommodating the handle of the brush product and a head region accommodating the head of the brush product, wherein the receiving region has in the handle region a cross section perpendicularly to the main extension direction that is substantially different from a cross section of the receiving region in the head region. Preferably a cross section of the receiving region changes continuously from a lower end of the receiving region toward an upper end of the receiving region. As a result, in particular an advantageously adapted receiving region is achievable.

It is also proposed that the receiving region has in the handle region at least one lentiform cross section perpendicularly to the main extension direction. A "lentiform cross section" is in particular to mean, in this context, a cross section having the shape of a cross section of a biconvex collecting lens. Preferably, the cross section has two convexly-curved sides which in each case taper pointedly at both ends to form an edge. By the lentiform implementation, in particular a fixation of a handle, respectively an advantageous pre-tension onto the handle of the brush product, is achievable in the handle region. The brush product, in particular in the case of toothbrushes, is clamped in the handle region, in particular in an insert-free manner. It is in particular possible to do without a separate additional insert piece. Preferably a fixation of the handle of the brush product is achieved, in particular depending on an implementation, by a pre-tension of the lentiform cross section. The pre-tension allows packaging of handles having different shapes, respectively geometries, in the same packaging base body. The packaging base body in particular forms part of the holding unit in the lentiform cross section. In the case of brush products having rather flat handles, this is oriented such that they are clamped in the lower region and the bristle region faces to the front. The clamping and the orientation are realized in particular by the lentiform cross section. In the case of brush products having a rather roundish handle, the clamping is in particular realized by the lentiform cross section, wherein the brush product is no longer capable of turning due to the forces. In particular, in such a case a brush head will face towards a side. It would however also be conceivable that the brush head, with a corresponding handle shape, is arranged at a different angle (e. g. up to 45°, preferably up to 30°), with the bristles not getting crushed in this configuration either. Moreover, the lentiform cross section in particular permits achieving insertability of the brush product packaging device as well as improving ergonomics. In particular, a modern design can be created.

It is further proposed that the receiving region has in the head region at least one substantially rectangular cross section perpendicularly to the main extension direction. The rectangular shape in particular enables protection of a bristle region. In particular, an outside load on the bristle region of the brush product can be avoided. In particular, no parts running into an angle are provided in the head region of the brush product packaging device.

It is also proposed that a cross section of the receiving region perpendicularly to the main extension region transitions, in particular continuously, along the main extension direction from the head region to the handle region from a rectangular cross section to a lentiform cross section. Preferably the packaging base body is implemented integrally. Alternatively, the packaging base body may be realized in two connected parts. The entire brush product packaging device is in particular manufacturable from a single blank. The packaging base body is in particular embodied in a folded fashion. In particular, creasings are provided at the edges, which support folding. However, it would also be conceivable that no creasings or only partial creasings are provided, which would in particular mean losing advantages in regard to delivery and/or storage. In this way, in particular a simple forming process is achievable.

Preferably, in a corresponding implementation, the packaging base body has a decreasing height profile from its front side to its rear side and from a top downward, there being in particular a wedge shape and in addition a curvature. In particular, the packaging base body is on its front side and on its rear side respectively straight at the top and curved at the bottom. Additionally, it would be conceivable that auxiliary creasings are provided, which support a molding of the curvature. The auxiliary creasings are preferably implemented on the front side and/or on the rear side. The auxiliary creasings preferably do not extend over the entire length of the packaging base body. They support a molding of a curvature optimally if they mold a portion of the surface in the curved part. The auxiliary creasings may be formed in a straight-lined or curved manner or in a combination of straight-lined and curved; preferably they are formed on the respective surface symmetrically to the central longitudinal axis of the respective surface. An underside of the packaging base body in particular has an upward curvature. Preferably, the underside of the packaging base body is slit from the front side to the rear side, wherein in particular one side is folded upwards and the other one is folded downwards. The slitting provides stability, but is also an opening. Principally, it would also be conceivable that several slits are realized. The slitting in particular simplifies an uprighting. Furthermore, in particular a left-to-right creasing is provided on the underside. Furthermore, front-to-rear creasings are also possible, which also simplify an uprighting, together with the slits or without slits. By means of the underside, in particular an uprighting of the packaging base body is achieved during a filling. The upper side of the packaging base body in particular comprises a straight planar surface, which forms a closure of the rectangular cross section.

A corresponding brush product packaging device has, in a flat unformed state, a length of in particular 120 mm to 300 mm, preferably of 160 mm to 280 mm. The brush product packaging device further has, in the flat, unformed state, a length of in particular 120 mm to 200 mm, preferably of 150 mm to 180 mm. In a formed state the brush product packaging device, with a euro hole tab in which the euro hole recess is implemented, has a length of in particular 100 mm to 260 mm, preferably of 140 mm to 240 mm, and without a euro hole tab a length of in particular 75 mm to 235 mm, preferably of 115 mm to 215 mm. The brush product packaging device further has, in the formed state, a width of in particular 25 mm to 90 mm, preferably of 35 mm to 75 mm, wherein a width of the brush product packaging device is in a handle region in particular adapted to an interface of a tray packaging. A height of the brush product packaging device is in a formed state in particular 8 mm to 35 mm, preferably 12 mm to 25 mm. Preferably, this constitutes a multiplier, in particular a multiplier of 9.13 mm, of a flute distance of a tray packaging. If there is a deviation from the multiplier, in particular a space, respectively a distance can be created or a bunching can be obtained. The grammage of such a brush product packaging device is in particular 200 $g/m^2$ to 500 $g/m^2$, preferably 250 $g/m^2$ to 450 $g/m^2$, and it is preferably made of solid fiberboard.

A corresponding brush product packaging device may in particular serve as a single pack, but also as a twin pack or as a three-pack. In an implementation as a twin pack or as a three-pack, in particular a plurality of brush products can be accommodated in the receiving region. Herein the brush product packaging device is, depending on an implementation, in particular openable only once and not reclosable. The brush products may in particular be arranged in the recess lying side by side. In the case of a plurality of brush products, in particular no separate fixing elements are provided. Fixing elements are in particular not practicable due to the opening technology. In the case of a plurality of brush products, in particular the dimensions of the brush product packaging device change depending on an arrangement and a number of brush products in the recess. However, in particular only the width of the brush product packaging device changes.

Besides the brush product, further different products may be introduced in the packaging, which is in the broadest sense kind of a multipack. These are, for example, a further exchangeable head of an exchangeable-head toothbrush, a miniature toothpaste tube, replacement battery/batteries, flosser/s, interdental brushes, several plug-on brush exchangeable heads. Furthermore, a manual or other product documentation may be inserted. These may be fixed, for example, by means of a holding unit.

Preferentially, a euro hole recess is provided on the packaging base body on an upper side. The euro hole recess is in particular implemented in an upward-protruding tab. The tab in particular comprises a double cardboard guidance. This in particular allows achieving a high degree of stability and avoiding rupture when suspending, like for example due to a weight of the product or to careless rough handling by a customer. Herein it is conceivable that the cardboard layers are glued, sealed, or the like, with each other and/or that the tab and/or at least one cardboard layer are/is inserted as a separate element. An insertion may herein be effected from an upper edge or from a side edge. Preferably, the tab is implemented to be folded from the packaging base body. This in particular allows dispensing with gluing tabs, which might affect insertion. In case of a double cardboard guidance, in particular a frontside cardboard layer has a smaller euro hole recess so as to visually obtain an overlap from the front and to compensate manufacturing tolerances. Herein the non-visible rear part may also have a different shape than the euro hole recess, for example an ellipse or a different geometry surrounding the euro hole recess. Preferably the euro hole recesses in particular have a difference in size of 0.5 mm. The euro hole recess is preferably closed in order to ensure stability, and is in particular not open sidewards. Moreover, it is in particular possible that the tab with the euro hole recess can be folded back, such that the tab adjoins the remaining pack and less air, respectively volume, needs to be transported. In the case of a packaging base body with the card element and the hood element, the euro hole recess may in particular be provided in two layers in the card element and in an upper sealing margin of the hood element. Principally, if the packaging base body is not suspended, the euro hole recess may also be dispensed with in order to save material and volume, and thus transport effort. Instead of a double cardboard guidance, alternatively also cardboard with a higher grammage may be used. This will automatically have enhanced stability due to the higher grammage.

The euro hole recess may principally be implemented already in the semi-finished product, such that in the process no further work steps are necessary for a forming of the euro hole recess. It is however also possible that the euro hole recess is created only after the different components of the cardboard packaging have been joined.

Furthermore, it is proposed that the at least one packaging base body comprises at least one circumferential perforated strip, extending transversely to the main extension direction, for an opening of the packaging base body. The perforated strip is preferably embodied as a rip-up perforation. The perforated strip is in particular realized by two perforations running parallel to each other. The perforations of the perforated strip in particular have a cut length of 1.5 mm to 7 mm, preferably of 2.5 mm to 5.5 mm, and have a holding length of 1 mm to 4 mm, preferably of 1.5 mm to 3 mm. Herein the perforation in particular needs to be stable such that it will not rupture in case of shocks during transport. Alternatively or additionally, a herringbone pattern is conceivable, which provides better ripping-up performance. The perforated strip in particular extends circumferentially around a longitudinal axis of the packaging base body. Principally the perforated strip may be arranged in a handle region as well as in a head region of the packaging base body. Preferentially the perforated strip is arranged in a central region, which in particular means that it is not arranged in a peripheral region. It would also be conceivable that the perforated strip is arranged at an angle to the longitudinal axis. Alternatively or additionally, it would also be conceivable that the perforated strip is arranged on an upper side and/or extends over a corner, constituting part of the one surface and part of the other surface, like for example from the upper side to the front side. Especially preferentially the perforated strip comprises in at least one position a rip-up tab providing a possibility for starting the rip-up. Principally, it would also be conceivable that, for example, the euro hole tab serves as a rip-up tab. In the region of the rip-up tab, the perforated strip in particular continues in its contour, without a sealing. In the case of a packaging base body with the card element and the hood element, the perforated strip may in particular be arranged on an upper side and/or an underside of the hood element, such that opening will result in a preferably small aperture. Alternatively, the perforated strip may extend sidewise left or right or on the rear side over the entire hood length or only part of the hood length of the hood element. If the perforated strip extends over the entire hood length, printings on the inner face of the hood element are readable, and a printing is therefore conceivable. Alternatively or additionally, it would also be conceivable that the perforated strip extends over a corner of the hood element, constituting part of the one surface and part of the other surface. Alternatively or additionally, it would also be conceivable that the perforated strip is arranged on the sealing margin, the sealing margin being ripped up on one side. In this way, in particular advantageous openability of the brush product packaging device can be provided. In particular, toolless opening of the brush product packaging device may be enabled.

In this context it would be conceivable that the brush product packaging device furthermore at least partly forms a hygienic cap. It would in particular be conceivable that the cardboard of the brush product packaging device can be separated off in such a way that a hygienic cap is formed. In particular, the cardboard may be specially coated in this portion of the brush product packaging device for the purpose of improving durability. In a combination with the perforated strip, the brush product packaging device can also be utilized entirely or partly as a traveling quiver in which the brush is transportable such that it is protected as a whole.

It is also proposed that the brush product packaging device comprises at least one reclosure unit, which is configured for a reclosing of the packaging base body. Preferably the at least one reclosure unit is implemented at least partly integrally with the packaging base body. Preferentially the reclosure unit comprises a reclosure tab, which can be inserted into a tab receptacle. Especially preferentially the reclosure tab is configured to at least partly latch with the latch receptacle. Preferably the reclosure tab or the tab receptacle is arranged at a folding tab of the packaging base body. The reclosure unit is applicable, for example, with a rectangular-cuboid-shaped packaging base body.

A specific implementation of the reclosure unit is configured such that closure tab is inserted in a tab receptacle for a first closing when the packaging has been filled. For a removal of the product, the closure tab can be separated off and thus is made into a reclosure tab. For this, on the one hand, two latch receptacles are implemented in the region of the tab receptacle. These may have different dimensions and shapes. One tab receptacle is formed for receiving the closure tab and the further tab receptacle is configured for receiving the reclosure tab. The tab receptacle for receiving the closure tab is formed rather less long than the tab receptacle for receiving the reclosure tab.

The tab as a whole has a tapering shape, the tab being connected to the remaining packaging in a bend point, respectively at the creasing/folding. From this point on, the tab is implemented in a tapering fashion, the closure tab being realized as a fluke-shaped, respectively anchor-shaped, widening in the end region of the tab. The widening is implemented in such a way that there is a latching with the tab receptacle and the closure tab is removable once again only with a destruction of the components at the tab or of the tab receptacle. For opening the packaging in spite of that, in order to use the product, the closure tab is connected with the remaining tab via a perforation. Accordingly, the closure tab is separated off at the perforation before a first use of the product, as a result of which the tab is not fixed and the product can be removed. For a reclosure, a further tab receptacle is realized between the tab receptacle of the closure tab and the bending point. This tab receptacle serves for receiving the reclosure tab. The reclosure tab is molded in the "normal", tapering portion of the tab and ends at the perforation to the closure tab. The reclosure tab has no fluke-shaped or anchor-shaped elements which would permit a removal of the reclosure tab from the tab receptacle only with destruction. It is therefore possible to insert and re-remove the reclosure tab several times.

The first portion of the tab—the closure tab—which must be separated off when opening, has approximately the same width as the tab receptacle. The fluke-shaped, anchor-shaped widening can be inserted into the tab receptacle without problems but will get hooked when pulled back due to its geometry. The tab receptacles of this kind are preferably implemented as cuts and not as recesses. It is however also possible to implement a recess, in particular in case of the tab receptacle serving for reclosure. If the tab receptacle is implemented merely as a cut, the retaining by the fluke works better.

A rectangular-cuboid-shaped packaging base body could in particular be implemented such that it is advantageously simply manufacturable. It would be conceivable, for example, that a longitudinal edge can be bought in a pre-glued—and thus already pre-fabricated—manner. In particular, merely an (un)folding of the packaging base body must be carried out before filling. This allows using the brush product packaging device as a transport packaging for the brush product, in particular also after first unpacking of the brush product. The brush product packaging device may in particular be used as a traveling packaging, in particular as a traveling quiver, for the brush product. The brush product packaging device may moreover be implemented as a returnable pack. Herein it would in particular be conceivable that a used product could be packaged and sent, for example, to the manufacturer or to a collecting point for recycling purposes. This in particular allows creating an advantageously sustainable packaging.

One implementation of the brush product packaging device could therefore in particular be a rectangular-cuboid-shaped cardboard box with a euro hole tab. A corresponding brush product packaging device in particular has straight side surfaces at right angles, wherein in an upper region in particular a euro hole tab is provided. A width, a height and a length are therefore in particular constant. Preferentially a corresponding brush product packaging device has a length with the euro hole tab of in particular 100 mm to 260 mm, preferably of 140 mm to 240 mm. Without the euro hole tab, the length is in particular 75 mm to 235 mm, preferably 115 mm to 215 mm. A width of the brush product packaging device is in particular 25 mm to 90 mm, preferably 35 mm to 75 mm. An overall height of the brush product packaging device is in particular 8 mm to 35 mm, preferably 12 mm to 25 mm. The grammage of such a brush product packaging device is in particular 200 g/m$^2$ to 500 g/m$^2$, preferably 250 g/m$^2$ to 450 g/m$^2$, and it is preferably made of solid fiberboard.

A corresponding brush product packaging device may in particular serve as a single pack but also as a twin pack or three-pack. In an implementation as a twin pack or three-pack, in particular several brush products can be accommodated in the receiving region. The brush product packaging device may herein be implemented to be openable and closable once or several times, depending on an implementation. The brush product packaging device is in particular implemented to be reclosable. The brush products may be arranged in the recess lying next to one another, in particular also interlaced. In the case of several brush products, either no separate fixing elements are provided or the fixing elements are realized in such a way that the brush product can be pulled out toward a top. In the case of several brush products, in particular the dimensions of the brush product packaging device are modified depending on an arrangement and a number of brush products in the recess. However, in particular only the width of the brush product packaging device is modified.

Besides the brush product, further and different products can be inserted in the packaging that is in the broadest sense something like a multipack. These are, for example, a further exchangeable head of an exchangeable-head toothbrush, a miniature toothpaste tube, replacement battery/batteries, flossers, interdental brushes, several plug-on brush exchangeable heads. Furthermore, a manual or other documentation regarding the product may be introduced. These may, for example, be fixed via a holding unit.

A corresponding brush product packaging device may also be used in other ways, in particular besides the accommodation of toothbrushes. The brush product packaging device is in particular usable as a dental floss packaging. In particular, a dimensioning may be adapted for this purpose. Furthermore, a knife for cutting the dental floss may be integrated directly in the brush product packaging device. The brush product packaging device is moreover usable as an interdental brush packaging. In particular, a dimensioning may be adapted for this purpose. Furthermore, an insert piece, in particular a fixing element, may be configured for a systematic holding of the interdental brushes. The insert piece may in particular be rake-shaped, with respectively one interdental brush being clamped between respective teeth. Preferably the insert piece in particular has recesses or empty spaces, such that the interdental brushes can be removed.

Beyond this, the brush product packaging device has special hygienic requirements. The brush product packaging device in particular has to be closed, which is achievable, for example, with gluing or with applying adhesive tape. In particular, there should be no open parts. The brush product packaging device in particular has no complete tightness as the brush product packaging device cannot be completely tightly closed. In particular, the brush product packaging device has minimal apertures due to perforations or to non-glued or minimally glued points. An improved tightness is in particular achievable by additional tabs and/or gluings. Preferably, in particular independently from an implementation, the packaging base body comprises dust tabs. The dust tabs are in particular elements on an upper edge, like for example an edge of the hood element, for preventing or reducing entry of dust. In particular, the dust tabs are non-fixed or fixed, like in particular by gluing, sealing or the like, and are then folded and flatted. Principally, dust tabs may be provided on the packaging base body in any places where minimal apertures are provided in the packaging base body. Dust tabs are preferably not separate elements but are formed integrally with other already described components of the packaging base body. In an automatized closing process, on an upper side, over its entire width a long dust tab may be provided, which is implemented completely overlapping, in particular for an improved counterpressure in the gluing process. A "dust tab" is in particular to mean, in this context, a component of a folding box that is configured to prevent entry of dust and other foreign particles into the interior of the box. Moreover, in particular by bringing about a counterpressure, dust tabs prevent breaking of a cover tab into the folding box. In other words, they provide a counterpressure.

Furthermore, there are instruments configured to enable a color recognition as well as a presentation of the brush product in the brush product packaging device. In particular, suitable printing of the brush product packaging device is conceivable, for example by inline printing. It is herein in particular possible to specifically print large areas, wherein the brush product is inserted, in particular in a color-defined manner, before printing and/or a camera recognizes a color of the brush product. Alternatively, it is also possible to specifically print smaller areas, wherein in particular a color selection is printed onto the brush product packaging device and inline a tick is set in the correct place for the color selection. Alternatively or additionally, a viewing window may be provided, wherein possibly no pure cardboard packaging is given any more. To achieve a pure cardboard packaging, there may in particular be just a hole, respectively a recess. The hole may in particular be closed at least partially by the brush product. For example, an area of the handle region may cover the hole, thus showing a color of the brush product. Alternatively or additionally, a hygienic cap protecting the brush head may be provided, respectively attached, on the brush product, said hygienic cap closing the hole. In this way, in particular the bristle region, the type of bristles and the bristle color would be visible and could signalize a color of the product. In such a case in particular the hygienic cap should be adapted such that possible air holes are not situated in the open region, i. e. in the region of the hole. It would however also be conceivable that the hole just remains open. Alternatively or additionally, the hole may also be closed via a fastened film. A closing of the hole may be provided before or after an insertion of the brush product in the packaging base body. Herein a plastic with a high recyclate content, in particular a 100% plastic film made of a recyclate and/or of a renewable raw material, is conceivable which is biodegradable, like cellulose or something similar, and/or transparent paper. Transparent paper may be provided to be translucent or transparent. For plastic materials in particular cellulose-based plastic materials are conceivable, like cellulose hydrate, PLA or PET-A, in particular recycled by 100%. A fastening of the film may be brought about by sealing or gluing, in particular inside the packaging base body, or on its outside. The film may in particular form part of the outer contour, for example as an overhanging label (i. e. certain regions of the film outside the hole have a distance from the packaging base body, and/or are not supported by the packaging base body) or as a reinforcement for the contour of the euro hole recess or as a euro hole recess in the label. The film may in particular be glued on together with a label or as a label, for example on the packaging base body, like in particular on the hood element or the card element. The film may be neutral or printed or may get printed. Herein an application of the film is in particular brought about from the outside when the packaging is already ready-manufactured, in particular sealed. Preferably the label, respectively the film, is provided outside the sealing region. When printing the film, features of the product may be emphasized by corresponding graphics, for example arrows or words. This may be effected on any transparent windows, not only on the label. The film may also substantially envelop the entire packaging base body. It would also be conceivable that the film is not fastened and is, for example, only laid into the packaging base body. The film may as well be laid in and clamped between different cardboard parts in the packaging base body. This would allow easy separability for recycling and disposal. The film may herein be straight or molded, like for example as a U profile or as a three-dimensional shape. A three-dimensional shape could be produced, for example, by deep drawing, and could be an integrated element for a holding of the brush product. It is further conceivable that, for example, the hood element is realized in such a way that a rear side is implemented like an overhanging label, which means that the rear side is also made of part of the side surface. The film herein closes the rear side and the free side surfaces, wherein several "holes" are closed by a film. As a further option, the viewing window may at the same time constitute an opening for a traveling box which can be opened and closed several times. Furthermore, a three-dimensional viewing window would also be conceivable. This could be realized by a hygienic cap protruding through the hole. The viewing window may also extend over a corner. Furthermore, for color recognition also a specific card would be conceivable which shows the color. It would, for example, be conceivable that the brush product is identified inline in the packaging machine, wherein the color is determined, a specific blister card is selected or a specific printing, in particular inline printing, is activated.

The brush product packaging device preferentially comprises a barcode. Preferably the barcode is located in a region in which neither a perforation nor a sealing margin with a ledge is provided. The barcode is in particular printed on a printed ground. In particular, a white background is provided for a black code. The barcode is in particular in accordance with GS1 standard. Thus an unambiguous background with sufficient contrast is provided in this region. In the case of sufficient contrast between background and printing, no priming is necessary. Furthermore, in particular a manufacturer code must be applied, like for example a lot code and/or a batch code. In an implementation of the brush product packaging device with a hood element, the manufacturer code may in particular be provided on the underside of the hood element. Preferably, the orientation of the hood does not matter here, and the manufacturer code is neither bothersome nor is it visible when presented from the front. In an implementation of the brush product packaging device with a lentiform cross section, the manufacturer code may preferably be applied on the rear side. The manufacturer code may in particular be applied in the handle region as well as in the head region. In the case of the rectangular-cuboid-shaped brush product packaging device, the application of the manufacturer code is in particular generally variable. The manufacturer code may advantageously be applied on an underside of the brush product packaging device.

In particular, different implementations of a corresponding brush product packaging device are conceivable. Preferably, in particular a packaging made of 100% cardboard and/or of 100% sustainable materials (e. g. a combination of 100% cardboard and 100% recycling material or a combination of 100% cardboard and 100% bio-based materials) is enabled by the brush product packaging device. The disadvantage of 100% cardboard is in particular that the product is usually not visible, wherein the product may be visualized in particular by imprints on the brush product packaging device. Alternatively, as already described, a viewing window may be implemented in the cardboard. It is also in particular possible to provide the brush product packaging device as a primary packaging, which can in particular be held favorably in a secondary packaging, in particular in a tray packaging. For this purpose, the brush product packaging device in particular comprises the guiding sections, via which the brush product packaging device can be inserted in a flute of a tray packaging. Moreover, an advantageously stable brush product packaging device may in particular be provided. Due to the shaping of the hood element with sealing, and also to a sealing with the card element, due to the dust tabs at the top and the slitting at a bottom or due to the gluings and/or fixings, a very stable packaging is created. In particular, the brush product packaging device may be less sensitive to pressure, such that the brush product is well protected. Furthermore, in particular good printability may be provided. For example, the card element and the hood element may be printed on both sides and thus also in the interior. In particular, large areas are provided for the printing, in particular more than, for example, in a customary blister packaging. A substantial difference is in particular that the packaging base body, in particular for example the hood element, can be printed inside and outside. The packaging base body enables rip-up perforations which allow, after removal of the brush product, folding the packaging base body open to form a flat blank, thus enabling additional area for further lettering, like a description of the product or handling instructions. Variable product arrangement (orientation of the bristle region) of the brush product is also achievable. In particular, a bristle region may be aligned longitudinally or transversely.

The objective of the brush product packaging device is in particular to provide a packaging which is as ecological as possible and which in particular fits into a tray packaging that is described below. Furthermore, as a marketing target, the brush product packaging device should fit onto the existing hook systems in a shop, requiring in particular the same space as a customary brush product packaging device.

The invention is furthermore based on a method for producing the brush product packaging device. Herein different methods are conceivable, in particular depending on an implementation of the brush product packaging device.

In the case of the brush product packaging device with the card element and the hood element, preferably a blank of the card element and of the hood element is manufactured in a first method step. Furthermore, in particular the hood element is formed from a blank. Herein a tub is in particular formed from the flat blank. Herein side elements of the blank are bent. The planar portion of the blank may optionally be deformed as well—as already described—using heat and/or pressure and/or feeding in humidity. Optionally, the tub thus formed may herein be glued and/or sealed or may be held in shape temporarily without a fix connection. It would moreover also conceivable that an insert is introduced, like in particular a folding element of the holding unit. The formed tub is then in particular filled with the brush product. After this, in particular the card element is laid upon the filled tub. The card element is in particular sealed with the sealing margins of the hood element, in particular by hot sealing. The requirement to the sealing wax is herein in particular food-contact compatibility. The sealing wax is furthermore applied on the hood element and on the card element. Theoretically, it is in particular also conceivable that the sealing wax is applied only on one side. Furthermore, in particular a sealable type of cardboard must be selected. Not all types of cardboard are sealable, like for example grass cardboard, which does not seal due to its porosity, the sealing wax being absorbed and thus not available on the surface. To allow usage of grass cardboard, it would be conceivable to treat the grass cardboard such that a sealing wax does not enter the material. The requirements to the sealing margins of the hood element are in particular that they should be situated in one plane. It would however also be conceivable that the sealing margins are situated in different planes, which would however take a greater manufacturing effort as several sealing plates are necessary. It would be also conceivable that the sealing margins which are sealed onto the card can be concealed by an optical design. Alternatively, it would also be conceivable that the sealing margins of the hood element extend up to an edge of the card element such as to reduce visibility of the sealing margins. This in particular results in a tolerance issue as the geometries must tally. There is however also the advantage that there will be no edge on the surface and thus there will be no ledges between the card element and the sealing margins. It would moreover be conceivable that the packaging base body is punched after the sealing in order to make the outer contour flush. The sealing margins extend around the entire elevated contour of the hood element. It would however also be conceivable that the sealing margins are partly interrupted and/or cut in order to create circumferential contours. The width of the sealing margins is in particular 3 mm to 7 mm, preferably 3.5 mm to 5.5 mm. The width of the sealing margins in particular depends on the shape of the margin, respectively of the entire sealing area, and on the weight of the product. The sealing margins furthermore also depend on a ground, i. e. cardboard and sealing wax. Principally it would also be conceivable that the hood element and the card element are connected by welding, in particular ultrasound welding, and/or by gluing.

In the case of the brush product packaging device with the at least partly lentiform cross section, a ready-glued sleeve is bought in addition, which is only to be uprighted, filled and closed. The manufacturing is done from a flat blank, by folding and gluing. A handling, i. e. for example the uprighting, filling and closing of the brush product packaging device, may herein be carried out manually as well as automatedly. The read-glued sleeve of the brush product packaging device in particular already has creasings in its side surface, which in particular allows delivery of the blanks in a flat state. In the flat state, the creases in the side surfaces of the packaging base body form the edge on a left side and a right side. Preferably only one side of the pre-fabricated sleeve is open. Herein in particular the sleeve is uprighted in a first method step. The sleeve is then filled from the open side, and after that the still open side is closed. Closure is effected by gluing the open upper tabs or by insertion of these tabs.

In the case of the rectangular-cuboid-shaped brush product packaging device, a ready-glued sleeve is bought in addition, which can be filled manually or automatedly. The gluing is herein preferably already done along the longitudinal edge of the sleeve. The tabs at the top and bottom of the brush product packaging device may in particular be inserted as well as glued. In a first method step herein in particular the sleeve is uprighted and the lower end is closed. The sleeve is then filled and is closed at the top. Closure is effected manually by latching or by insertion or by gluing the tabs. Depending on a process, the orientation of the brush product packaging device may vary, wherein a closure sequence may also vary. It would, for example, in particular be conceivable that first closure is carried out at the top and then filling is carried out from below. A closure may also be effected parallel, i. e. simultaneously at the top and bottom, instead of the successive closure. Optionally, the closure may therefore also take place only after introduction of the brush product.

As packagings formed in this way are rather inferior to other packagings in regard to dust-tightness, it is possible that the product in the primary packaging is packed in a multiple manner. The product could, for example, be welded in a cellophane packaging. The product in the cellophane packaging would then be introduced into the cardboard packaging described. In order to achieve sustainability, the film used for the cellophane packaging could be made of a sustainable plastic as described above.

For the purpose of creating an even more valuable primary packaging, two packagings may be arranged one inside the other one, such that the packaging directly adjoining the product is also protected. In this way, for example, a hood packaging could be provided which is inserted into a rectangular-cuboid-shaped cardboard packaging, which would mean better protection for the more valuable hood packaging.

The invention is furthermore based on a system with the brush product packaging device and with a brush product, in particular a toothbrush, which is accommodated in the brush product packaging device.

Beyond this the invention is based on a tray packaging for receiving at least two, in particular a plurality of, brush product packaging devices, with at least one secondary packaging base body and with at least one packaging insert, which is arranged in the secondary packaging base body, for a positioning of the brush product packaging devices. It is proposed that the at least one packaging insert is implemented at least largely of a paper material. The tray packaging is in particular implemented by a secondary packaging. The tray packaging in particular comprises an integrated element for product presentation, such as to present products in a uniform manner. In particular, the packaging insert serves for a uniform accommodation and presentation of brush product packaging devices. Furthermore, in the context of tray packagings relevant issues are in particular stackability, such that the tray packaging is favorably stackable for transport; ecology, which in particular means using as little cardboard as possible; and shelf-ready packaging, which means that the tray packaging must be able to serve as a packaging at the point of sale and no shifting around is necessary but only the tray packaging must be opened. In particular, the tray packaging is configured to receive the brush product packaging devices via insertion. Herein part of the packaging geometry of the brush product packaging devices in particular serves for holding. In particular, different brush product packaging devices can be accommodated in the tray packaging. Preferably the brush product packaging devices are in particular inserted in the packaging insert. The packaging insert in particular serves for a defined receiving and guiding of the brush product packaging devices in the tray packaging. Moreover, the packaging insert in particular serves for fixing the brush product packaging devices when a portion of the brush product packaging devices has already been removed from the tray packaging. The packaging insert may herein be configured for an accommodation of a defined size of brush product packaging devices as well as for individual accommodation.

The implementation of the tray packaging according to the invention in particular allows providing a packaging that is advantageously simple and is producible in a cost-efficient manner. In particular, a tray packaging can be provided that is advantageously flexibly producible and printable. Beyond this, an advantageously high ecology of the tray packaging is achievable. A high ecology is achievable in particular using recycled paper material. Furthermore, a tray packaging can be provided that is made of sustainable materials.

In one implementation of the tray packaging, the packaging insert may be embodied, for example, as a grid. Herein the brush product packaging devices can, for example, be inserted individually into the packaging insert that is embodied as a grid. The packaging insert may here in particular have longitudinal walls and transversal walls. The secondary packaging base body in particular forms an outer cardboard box. The grid of the packaging insert may herein be adapted in particular to a size, in particular a width and a height, of the brush product packaging devices which are to be accommodated. In particular, an inclined product presentation due to oblique transversal walls of the packaging insert would also be conceivable, wherein the brush product packaging devices are in particular held obliquely by the packaging insert. Principally, a combination of different packaging inserts would also be conceivable, such that straight and oblique brush product packaging devices could be accommodated in the same tray packaging. For example, brush product packaging devices may be accommodated obliquely at the front and straight at the rear. The tray packaging in particular comprises x, in particular at least two, rows side by side, and x rows behind one another. The tray packaging is in particular configured for an accommodation of 10 items to 100 items, preferably of 15 items to 50 items, of the brush product packaging devices. The tray packaging is in particular configured to accommodate 5 items to 12 items of the brush product packaging devices along its length. Furthermore, the tray packaging is in particular configured to accommodate 2 items to 10 items of the brush product packaging devices along its width. The width of the recess of the grid of the packaging insert is 15 mm to 75 mm, preferably 20 mm to 50 mm, wherein the empty space is equivalent to the width of the packaging plus a tolerance. The length of the recess of the grid of the packaging insert is in particular 12 mm to 40 mm, preferably 15 mm to 30 mm. The grids of the packaging insert in particular extend over the entire inner dimensions of the packaging, such that it is clamped—or at least cannot slip—at the front and at the rear as well as on the left and right sides. Principally, it would also be conceivable that at the front and at the rear and/or on the left and right sides the grids of the packaging insert do not extend up to the margin, the accommodated brush product packaging devices centering the packaging insert. This has the disadvantage that if brush product packaging devices are removed, the brush product packaging devices no longer have the same standing stability. It would furthermore also be conceivable that a plurality of brush product packaging devices are arranged in a grid of the packaging insert, like in particular side by side and/or behind one another. A corresponding tray packaging could in particular be created by uprighting the secondary packaging base body, inserting the packaging insert in the secondary packaging base body, and filling the tray packaging.

In an alternative implementation of the tray packaging it would also be conceivable that a packaging insert may be dispensed with, wherein the brush product packaging devices are accommodated in the tray packaging loosely, in particular stacked in a controlled manner. By means of perforation, the tray packaging may in particular be made into a stand-up display. For this purpose, the brush product packaging devices are in particular stacked in an ordered manner, in order to make optimum use of a space. However, a chaotic accommodation of the brush product packaging devices would also be conceivable. The tray packaging may herein in particular be implemented by a ready-glued case, which is delivered in such a manner that it merely needs to be uprighted. The tray packaging is in particular implemented by a glued blank, which merely needs to be connected at the top and bottom when closing, in particular connected by gluing, like for example by an adhesive strip. The tray packaging is in particular configured for an accommodation of 10 items to 100 items, preferably of 15 items to 50 items, of the brush product packaging devices. The tray packaging is in particular configured to accommodate 5 items to 12 items of the brush product packaging devices along its length. The tray packaging is furthermore in particular configured to accommodate 2 items to 10 items of the brush product packaging devices along its width. A length of the tray packaging is herein in particular be 100 mm to 500 mm, preferably 200 mm to 350 mm. A width of the tray packaging is in particular 150 mm to 450 mm, preferably 200 mm to 300 mm. A height in particular corresponds to the height of the accommodated brush product packaging devices. A corresponding tray packaging could in particular be produced by uprighting the tray packaging, filling the tray packaging and closing the tray packaging.

The rectangular-cuboid-shaped brush product packaging device may, for example, be arranged in a tray packaging that is implemented by a grid. Due to its rectangular-cuboid shape, respectively the rectangular cross section, the brush product packaging device optimally fits into the grid having rectangular recesses for a product accommodation.

The disadvantage of the distances between the brush product packaging devices caused by the grid may be counteracted by constructing the rectangular-cuboid-shaped brush product packaging device with a different orientation of a tab and a euro hole recess. For example, an inverted rectangular-cuboid-shaped brush product packaging device may be introduced into a tray packaging by the tab of the euro hole recess. This means, that it is actually inserted into the tray packaging upside down. Hence the rectangular-cuboid-shaped brush product packaging device can be presented in two ways. Standing up—upside down—and inserted in a tray packaging, or suspended by the euro hole. Both ways are thus combined directly. The graphic design of the surface of the brush product packaging device should of course be implemented accordingly, such that a consumer will not be bothered by the multifunctionality. The implementation of the euro hole recess is in this case facultative, it is also possible that only a tab is realized for an insertion of the rectangular-cuboid-shaped brush product packaging device into a tray packaging. This manner of inserting the rectangular-cuboid-shaped brush product packaging device into a tray packaging provides the advantage that existing widths, lengths and heights of the packaging can be relied on, which allows keeping the existing standards, such that the product may substitute existing products quasi 1:1.

It is also proposed that the at least one packaging insert is implemented such that it is folded at least substantially in a U shape. The packaging insert is in particular U-profile-shaped in a folded state. Preferably the packaging insert has at least one planar base side and two side portions, which are arranged on opposite-situated sides of the base side and in particular extend perpendicularly to the base side. The side portions and the base side are preferably folded from one piece in a one-part implementation, in particular from one cardboard sheet. The side portions are in particular configured to receive and guide guiding sections of the brush product packaging devices. In particular, respectively one guiding section of a brush product packaging device is guided in respectively one side portion. Preferably, in an inserted state, the packaging insert is held in a U shape at least partly by the secondary package base body. Principally, it would also be conceivable that a plurality of packaging inserts are arranged next to one another in a secondary packaging base body, the packaging inserts at least partly holding each other in a U shape. This in particular allows providing an advantageously simply produced packaging insert. Furthermore, in particular an advantageously reliable guiding of brush product packaging devices in the packaging insert is achievable. In particular, it is advantageously possible to adapt a height of the packaging insert, in particular of the side portions, to a brush product packaging device, thus providing an advantageously stable guiding.

It is further proposed that the at least one packaging insert is implemented of a corrugated fiberboard. Preferably, all cardboard elements of the tray packaging are made of corrugated fiberboard. It would however also be conceivable that the secondary packaging base body is made, for example, of a solid fiberboard. Preferably the secondary packaging base body is made at least partially of single-wall corrugated fiberboard, in particular of a recycling material. Preferably the secondary packaging base body is at least partly made of chipboard, in particular of a recycling material. Particularly preferentially the packaging insert is in particular made of a one-sided corrugated fiberboard, i. e. in particular of a corrugated fiberboard consisting of a linerboard and a fluted layer. However, usage of a single-wall fiberboard, a double-wall fiberboard or a triple-wall fiberboard would principally also be conceivable. The flutes of a fluted layer of the corrugated fiberboard are in particular configured to respectively form a guiding groove for the guiding section of the brush product packaging devices. Preferably, each flute valley of the fluted layer of the packaging insert forms a guiding groove. In particular, the flute crests of the fluted layer of the corrugated fiberboard extend, in particular in a packaged state, parallel to a main extension plane of the brush product packaging devices. Preferably the corrugated fiberboard is made of a recycling material. The flute distance of the packaging insert, i. e. the in particular the distance from flute valley to flute valley or from flute crest to flute crest, is in particular 5 mm to 14 mm, preferably 7.5 mm to 11 mm. In particular, the flute distance is precisely 9.13 mm. The height of an individual flute of the packaging insert is in particular 2 mm to 10 mm, preferably 3.5 mm to 8 mm, wherein in particular always the same height is provided per packaging, and in particular also with all tray packagings. It is in particular possible to insert the brush product packaging devices into the packaging insert in different ways. In particular, different insertion distances are possible. In the case of advantageously narrow brush product packaging devices, like in particular for interdental brushes, it is in particular possible that in each flute valley a respective brush product packaging device is inserted. In the case of large brush product packaging devices, like in particular for electrical toothbrushes, a distance of x flutes between neighboring brush product packaging devices is also conceivable. The objective is in particular that the brush product packaging devices are inserted regularly, hence always having the same distances. It is however also conceivable that the brush product packaging devices are inserted irregularly, hence having different distances, in order to compensate, for example, oversize in a head region, and thus a bunching. For example, it would be conceivable that following a first brush product packaging device one flute remains empty, following a further brush product packaging device two flutes remain empty, then once more one flute remains empty, etc.; it is furthermore also possible that following a first brush product packaging device two flutes remain empty and following a further brush product packaging device three flutes remain empty, then once more two flutes remain empty, etc. Therefore, an insertion distance may in particular depend principally on a product height and on the flute distances. The objective is in particular that the brush product packaging device stands as upright as possible, the brush product is not crunched and still volume-optimized storage is given. By a "corrugated fiberboard" is in particular a paper material to be understood, in particular a cardboard, which is implemented of one or several layers of a corrugated paper glued onto a layer or between several layers of a further paper or cardboard. Corrugated fiberboard will preferably result from gluing at least a smooth paper and a corrugated paper together. This most simple version is called a one-sided corrugated fiberboard with an open flute. If a smooth paper, a corrugated paper and a further smooth paper are glued together, this is in particular called a single-wall corrugated fiberboard. It is thus possible, for example, to glue up to seven layers onto one another, thus obtaining a triple-wall corrugated fiberboard. Corrugated fiberboards may preferably differ in the type of flutes, the size of flutes and the material thickness. By a "solid fiberboard" is in particular, in this context, a massive material to be understood, which is implemented substantially of fibers of plant origin and which may be one-layered and couched, also glued together, laminated, impregnated or coated, which is produced as a machine-made board or millboard, and whose area density is greater than for paperboard. The area density of solid fiberboard is in particular in the range of approximately 500 $g/m^2$ to 3,000 $g/m^2$. By the denomination solid fiberboard, the density and the homogeneous structure of this packaging material are described. Solid fiberboard is mostly made of several layers, wherein up to 100% of the mass may consist of recycled fiber mass, which means of processed wastepaper. By a "main extension plane" of a unit is in particular a plane to be understood which is parallel to a largest side surface of a smallest imaginary rectangular cuboid just still completely enclosing the unit, and which in particular extends through the center of the rectangular cuboid. This in particular allows providing a packaging insert produced in an advantageously simple manner. Furthermore, in particular an advantageously reliable guiding of brush product packaging devices in the packaging insert is achievable. Furthermore, in particular an already pre-fabricated material can be used. In particular, a subsequent processing effort can be kept at a low level. It is also in particular possible to provide an advantageously lightweight packaging insert. Moreover, an advantageously high ecology of the tray packaging is achievable. Using recycled paper material allows achieving a high ecology. Furthermore, an in particular universal applicability of the tray packaging is achievable while keeping up high standards.

It is further proposed that the at least one secondary packaging base body comprises at least one shoe element for an accommodation of the at least one packaging insert and at least one hood element for a closure of the shoe element. The shoe element is in particular formed of a rectangular cuboid that is open on one side. It would in particular be conceivable that individual walls of the shoe element are elevated. Preferentially the one front wall of the shoe element is not elevated. On the contrary, in particular the front wall is entirely or partly removed so as to achieve a better product presentation. In particular the lefthand wall, the righthand wall and the rear wall may be elevated. If part of the walls are/is fully elevated, products can be supported up to the upper edge. It would also be conceivable that the walls increasingly rise towards the rear, such that the rear wall is high and a height of the side walls increases rearwards. Principally, the walls could also be implemented with a height progression. The walls may furthermore be implemented having recesses. The shoe element may in particular at least partially form a sales display. For this purpose, the shoe element may in particular be printed, thus optimizing a presentation at the point of sale. The hood element is in particular implemented by a folded hood. The hood element is in particular merely laid in and/or put on. Preferably the hood element is in particular configured, on a rear side or on a front side, to slide into the shoe element. If the shoe element has a rear wall, it would in particular be conceivable that the hood element has the inverse shape of the shoe element, the hood element having a wall, in particular a high wall, in particular on the front side. The wall in particular serves for a support. The hood element is in particular implemented in a rectangular-cuboid shape, and is configured to be put over the products, respectively the brush product packaging devices, and the shoe element. Preferably, the hood element is fastened by means of glue or adhesive tape, wherein in particular auxiliary means are provided for releasing the hood element from the shoe element. Different possibilities of removing the hood element are conceivable. For example, a perforation may be provided in the hood element for removing the cover and for exposing the brush product packaging devices. The perforation may, for example, be reinforced by a tape in order to avoid rupture of a perforation strip. The perforation may also extend in particular around the longitudinal axis of the packaging and/or may extend obliquely if the side walls of the shoe element are oblique. It would also be conceivable that it is possible for the gluing points to be ripped off and/or to be separated from the hood element. It would also be conceivable that no connection is provided between the hood element and the shoe element and the hood element can be simply lifted off. Principally it would also be conceivable that, during manufacturing and filling, the hood element and the shoe element are embodied in a one-part implementation. It would in particular be conceivable that the hood element and the shoe element are realized as a cardboard box, which is filled and/or in which a filled packaging insert is inserted. Herein it would in particular be conceivable that the hood element and the shoe element are separable via a perforation. This in particular allows providing an advantageous tray packaging. It is in particular possible to provide a tray packaging that is advantageously usable for a transport and a presentation of brush product packaging devices, respectively of brush products.

The at least one packaging insert is in particular implemented in such a way that it is merely laid into the shoe element. Herein it is in particular possible that a number of packaging inserts in a secondary packaging base body varies. In particular, it would be conceivable that only one row of brush product packaging devices is provided for being accommodated, and thus only one packaging insert is provided, and it would as well be conceivable that a plurality of rows of packaging inserts are provided for a plurality of rows of brush product packaging devices, like for example in two or three rows. A multiple number of rows is in particular not limited. Herein in particular rows of respectively one packaging insert, with a plurality of brush product packaging devices accommodated therein, may be arranged next to one another as well as above one another. In particular, a further packaging insert may also be arranged on a row of brush product packaging devices. For stability reasons, it would moreover be conceivable that, for example, respectively two packaging inserts are arranged together in a holding member, and/or that individual packaging inserts are connected, in particular glued, with each other. Furthermore, it would also be conceivable that for keeping the shape of an interface, in particular for stabilization, one packaging insert is hooked into a further packaging insert, these packaging inserts thus mutually supporting each other. Beyond this it would be conceivable that the secondary packaging base body is implemented merely by a ring or a tape supporting the packaging insert. It would also be conceivable that separate, additional shoes are configured for a bundling.

A shoe element is capable of accommodating along its length in particular 4 to 20, preferably 5 to 12 brush product packaging devices behind one another, which are in particular accommodated in a packaging insert. Furthermore, 1 to 9, preferably 1 to 4, packaging inserts filled with brush product packaging devices can be accommodated in the shoe element. In particular in the case of brush product packaging devices having low elevations, like in particular for dental floss, flossers or the like, in particular 1 to 3 rows of brush product packaging devices are arrangeable in a packaging insert above one another. The packaging insert in particular has a length of 100 mm to 350 mm, preferably of 115 mm to 250 mm. A width of the packaging insert is in particular in the range of 20 mm to 120 mm, preferably in the range of 30 mm to 100 mm. The width herein in particular depends directly on the width of the brush product packaging devices, the brush product packaging devices being adapted to standards. Standard widths for brush product packaging devices are in particular 42 mm, 70 mm and 92 mm. The blank width of the packaging insert therefore respectively depends on the provided accommodation width as well as on the desired guiding height. In a folded state, the height of the packaging insert is in particular 15 mm to 80 mm, preferably 25 mm to 60 mm. The secondary packaging base body in particular has a length of 100 mm to 400 mm, preferably of 120 mm to 350 mm. Furthermore, the secondary packaging base body in particular has a width of 30 mm to 300 mm, preferably of 35 mm to 250 mm. Furthermore, the secondary packaging base body in particular has a height of 80 mm to 400 mm, preferably of 120 mm to 350 mm.

In a production of the tray packaging, the packaging insert is produced in a first step. For this corrugated fiberboard is rolled out and then longitudinal creasings are introduced in the corrugated fiberboard. Later on, the creasings will in particular form the edges of the packaging insert. The corrugated fiberboard is then cut to the appropriate length. The corrugated fiberboard is in particular delivered in rolls having already the correct width. After that, the corrugated fiberboard is die-formed and held, and is thus made into the packaging insert. Following this, the packaging insert is placed in a shuttle, in which the packaging insert is held in shape and is filled manually or by a robot. In a second step the secondary packaging base body is formed. Then the filled packaging insert is placed in the shoe element of the secondary packaging base body. The packaging insert is held in shape by the shoe element, wherein the packaging insert directly adjoins the shoe element. In particular, the packaging insert is held and clamped merely via a friction fit. However, fastening members for a securing of the packaging insert are also conceivable. After this, the secondary packaging base body is closed. There are in particular different variants of the secondary packaging base body. In particular in the case of a separate implementation of the shoe element and the hood element, the packaging insert is inserted into the shoe element without the hood element. Herein the packaging insert may in particular be loaded only in the shoe element. The hood element is formed only then and is put onto the filled shoe element. Following this, the hood element is connected to the shoe element, in particular by gluing.

In the present context, the terms "axial" and "radial" in particular refer to a main extension axis of the electrical brush handpiece, such that the term "axial" in particular designates a direction extending parallel to or coaxially with one of the main extension axes. Furthermore, the term "radial" will in the following in particular designate a direction extending perpendicularly to one of the main extension axes. By a "main extension axis" of an object is herein in particular an axis to be understood which runs parallel to a longest edge of a smallest geometrical rectangular cuboid just still enclosing the object completely, and which in particular intersects with a geometrical center point of the object.

Furthermore, in this context, the terms "upper side or "front side" of the toothbrush are in particular to mean the side of the toothbrush which the thumb is laid upon. The upper or front side is usually also the side which the bristle region, in particular the bristle region of the brush head of the plug-on brush, faces towards. As an "underside" or "rear side" of the toothbrush is in particular the side to be understood which faces away from the bristle region of the brush head. Furthermore, the terms "lefthand side" and "righthand side" in each case refer to a view of the front side.

DRAWINGS

Further advantages will become apparent from the following description of the drawings. In the drawings seven exemplary embodiments of the invention are illustrated. The drawings, the description and the claims contain a plurality of features in combination. Someone skilled in the art will purposefully also consider the features individually and will find further expedient combinations.

Figure 2:
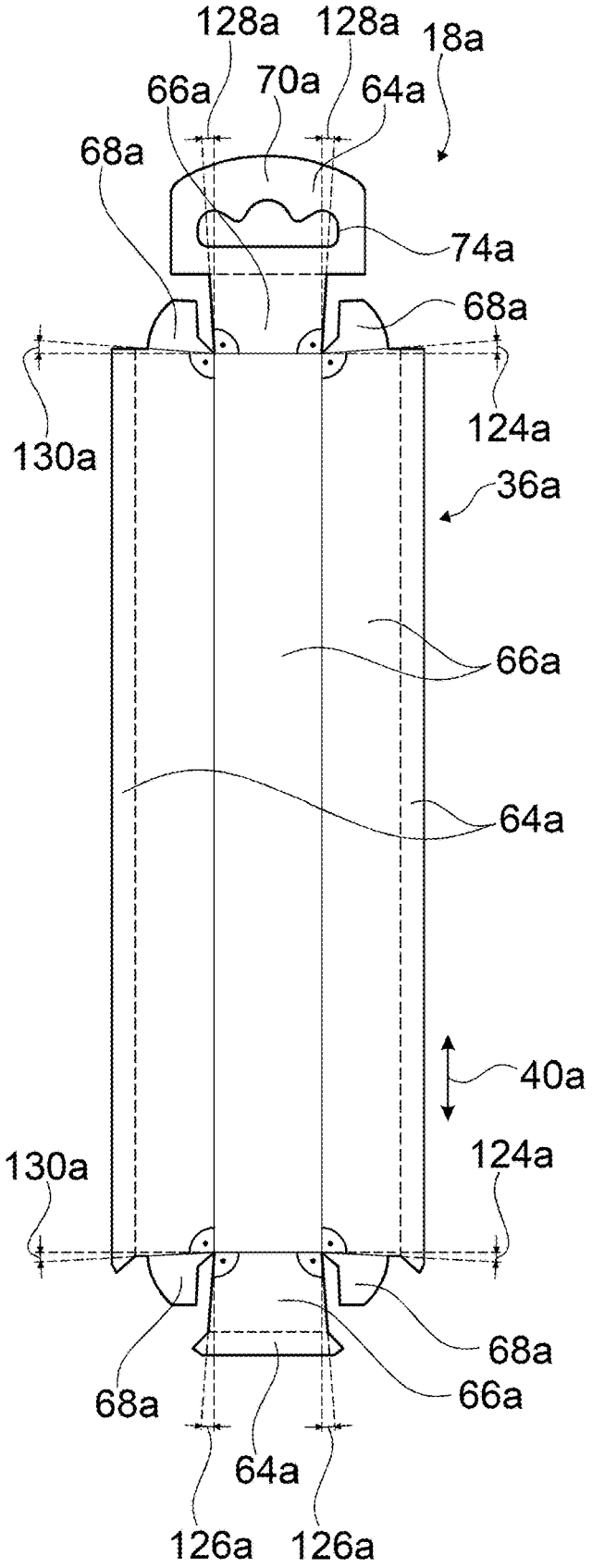
Figure 3A:
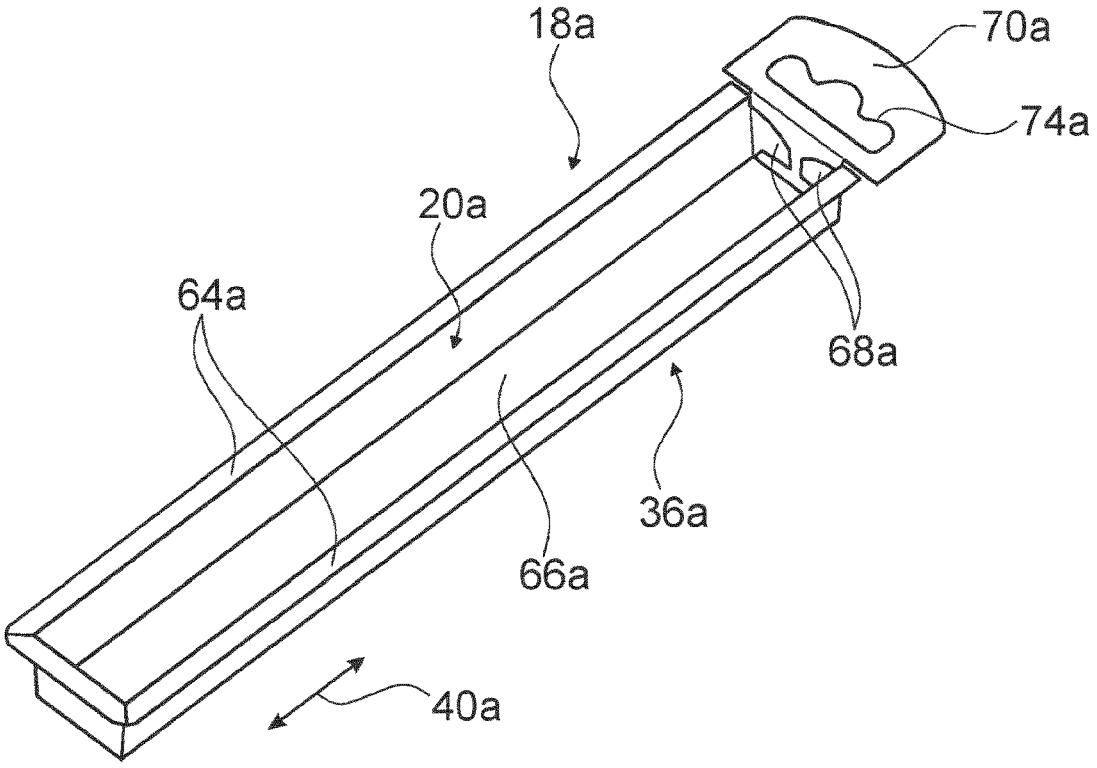
Figure 3B:
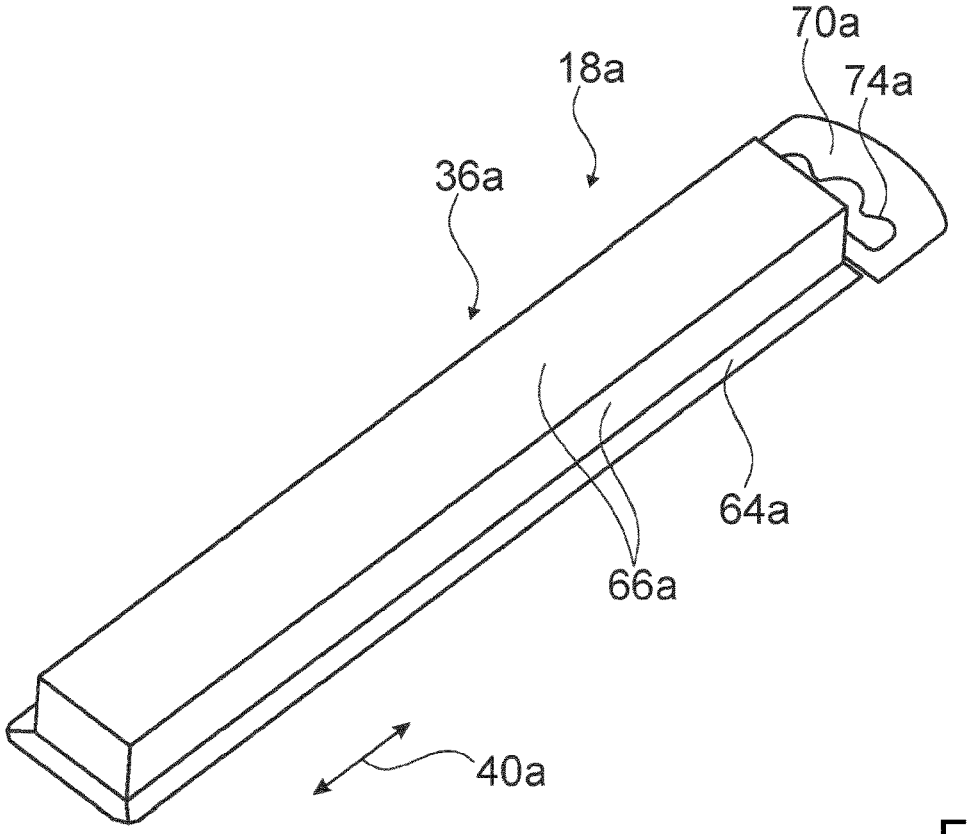
Figure 3C:
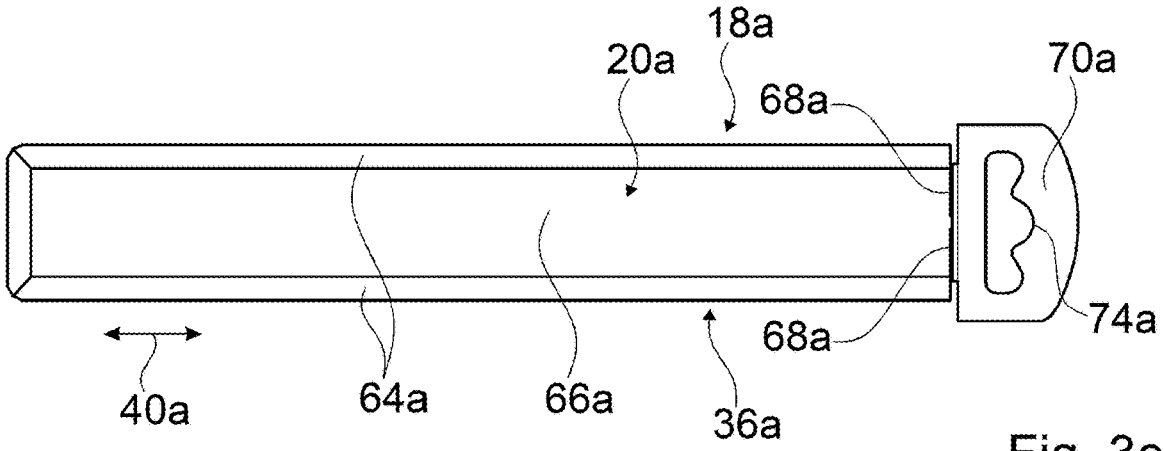
Figure 3D:
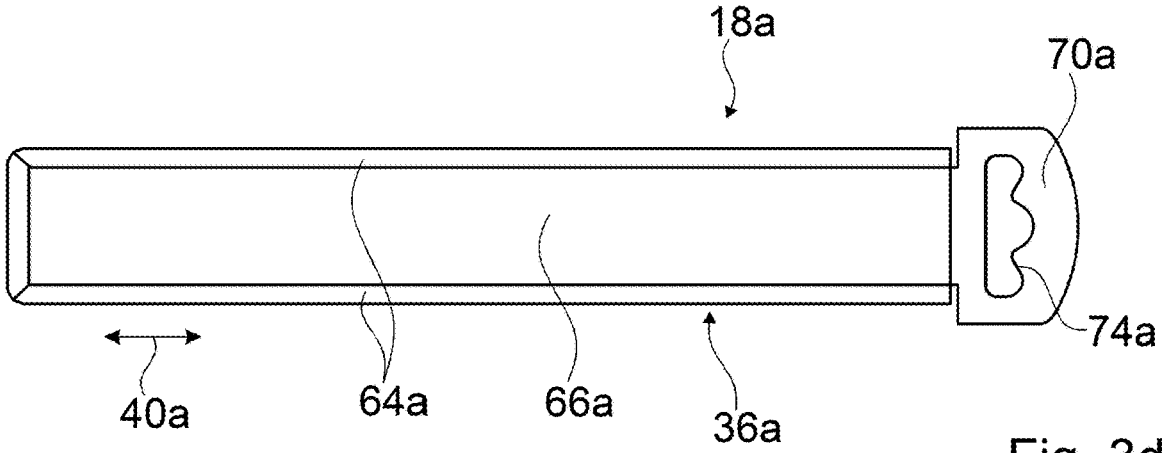
Figure 3E:
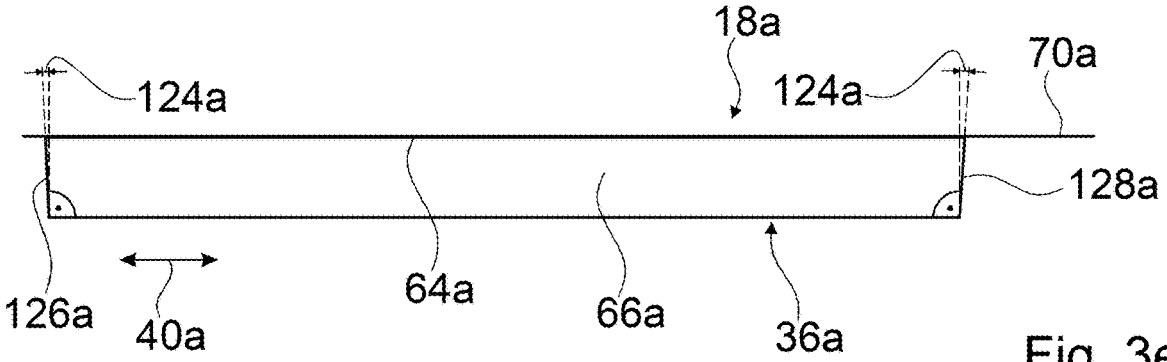
Figure 3F:
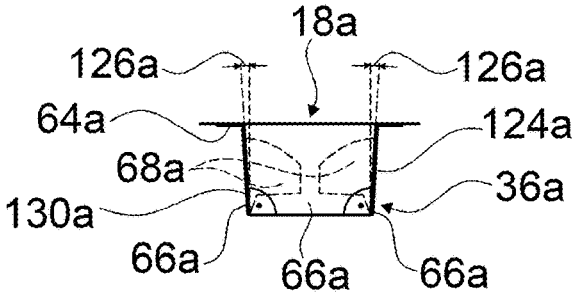
Figure 4A:
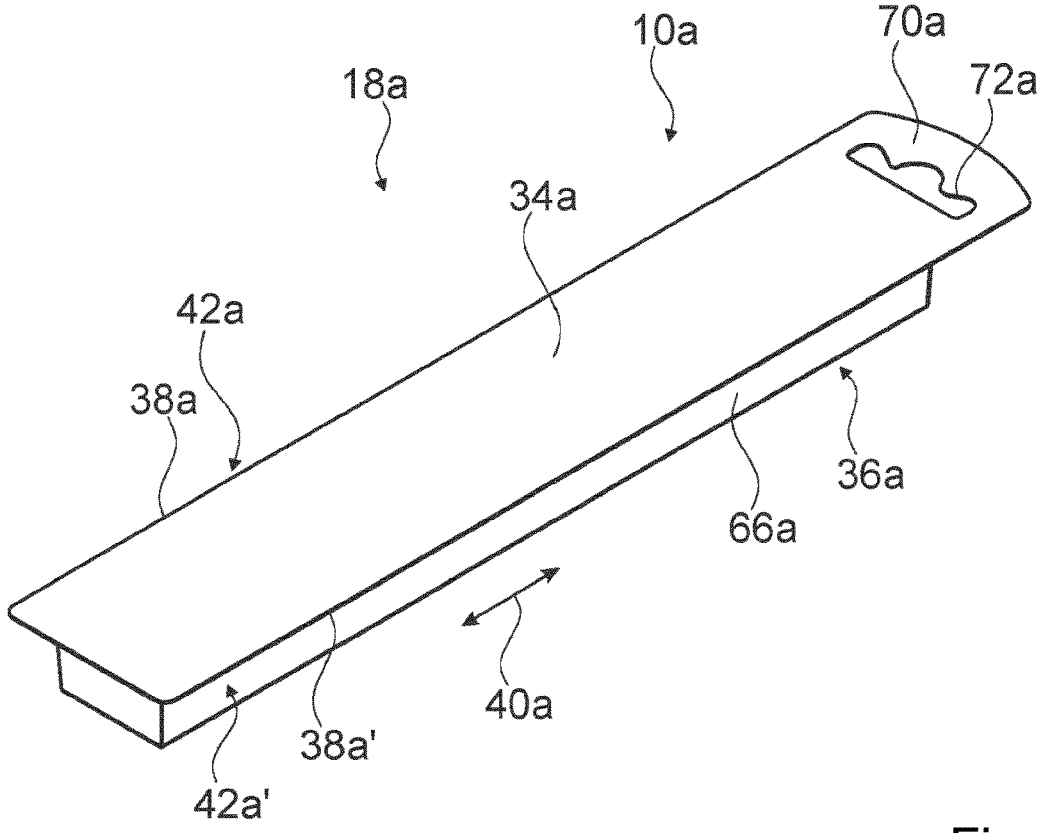
Figure 4B:
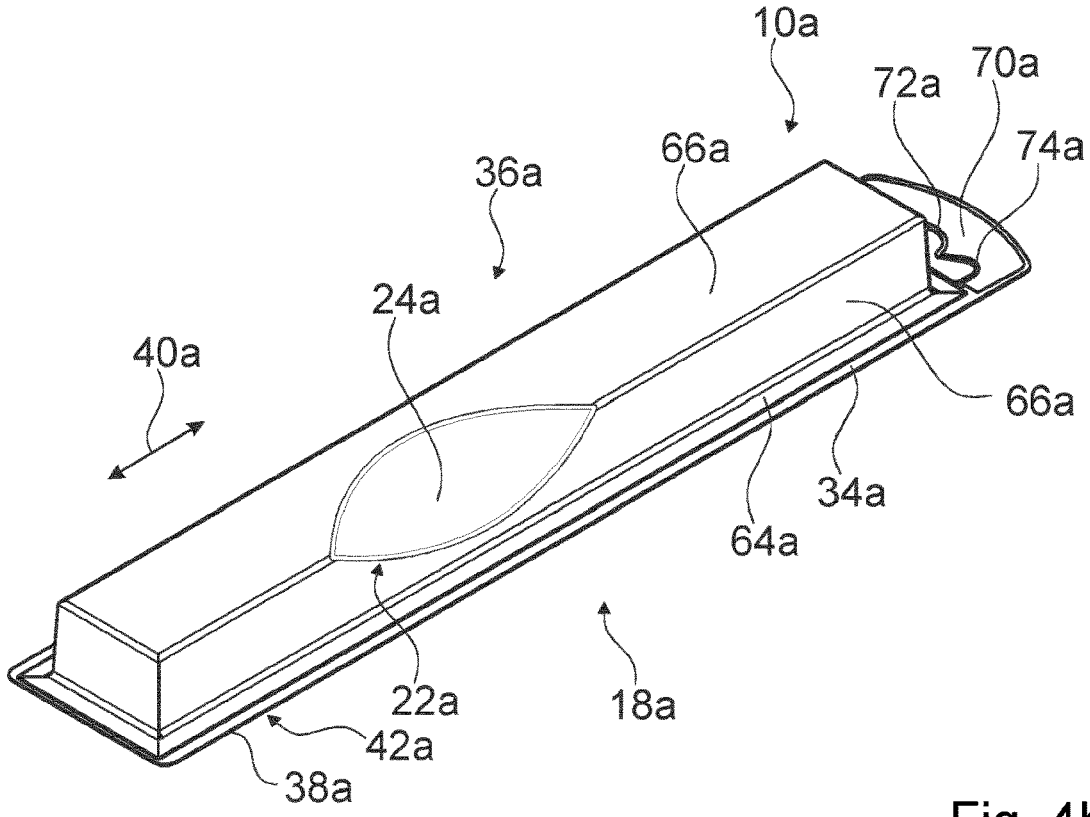
Figure 4C:
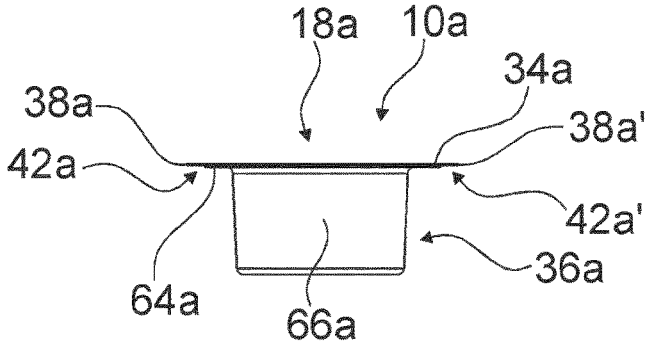
Figure 4D:
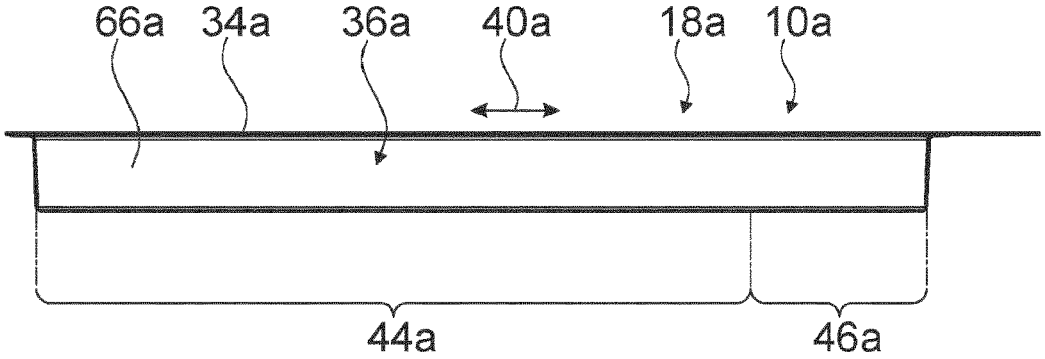
Figure 5A:
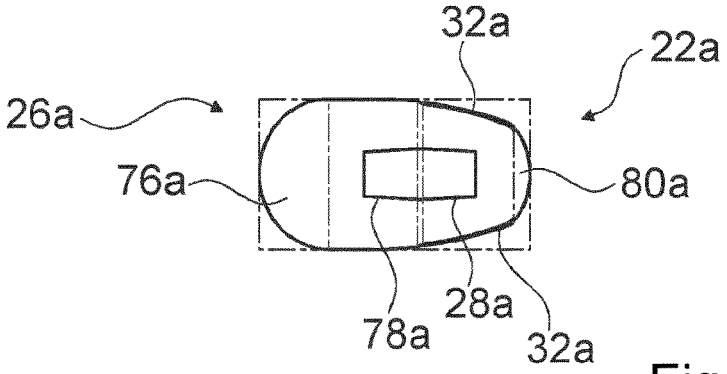
Figure 5B:
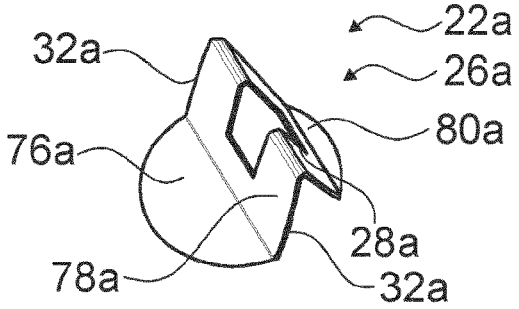
Figure 5C:
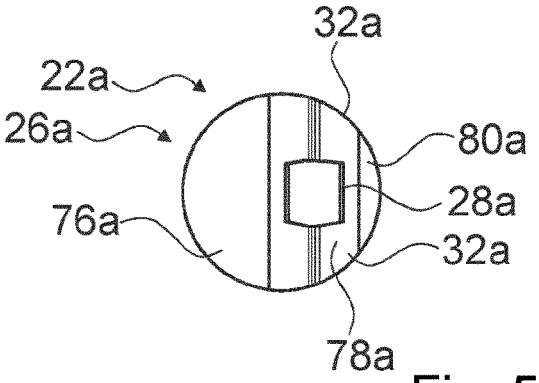
Figure 5D:
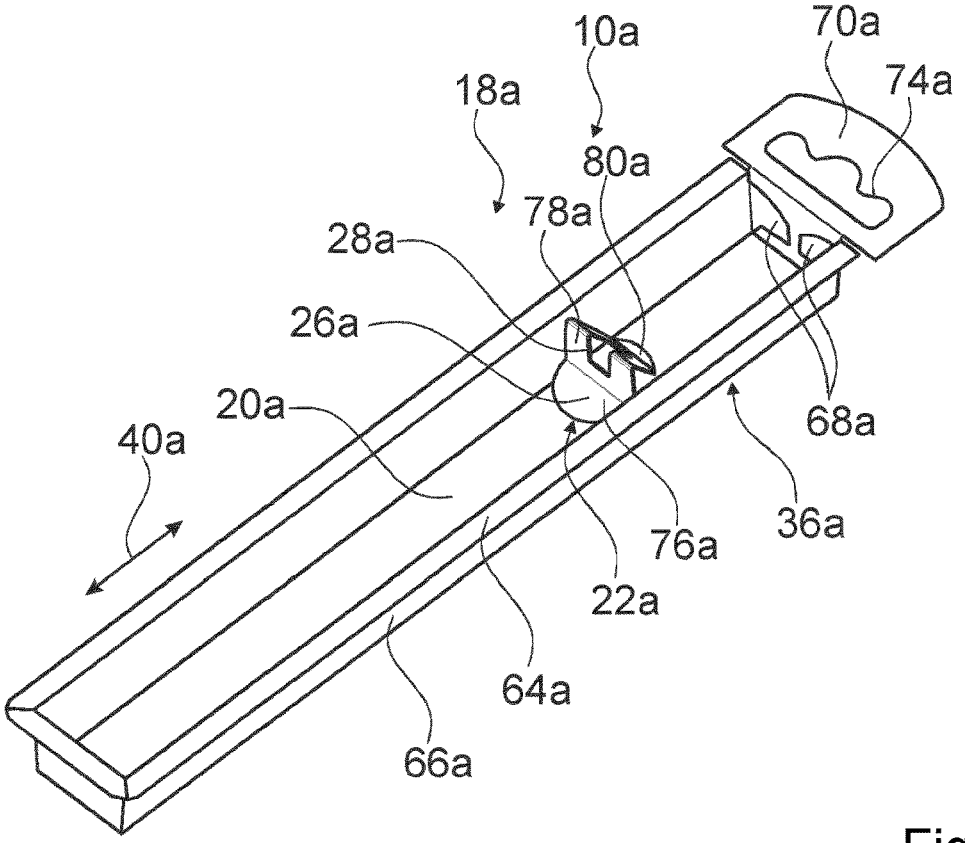
Figure 5E:
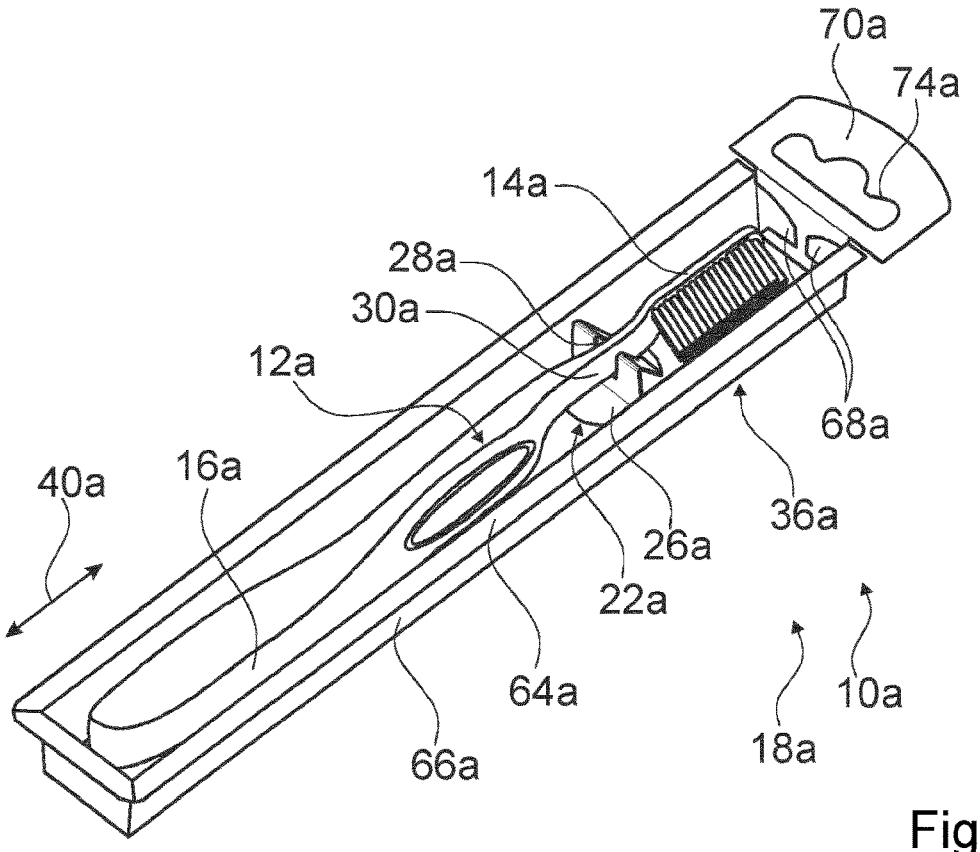
Figure 6:
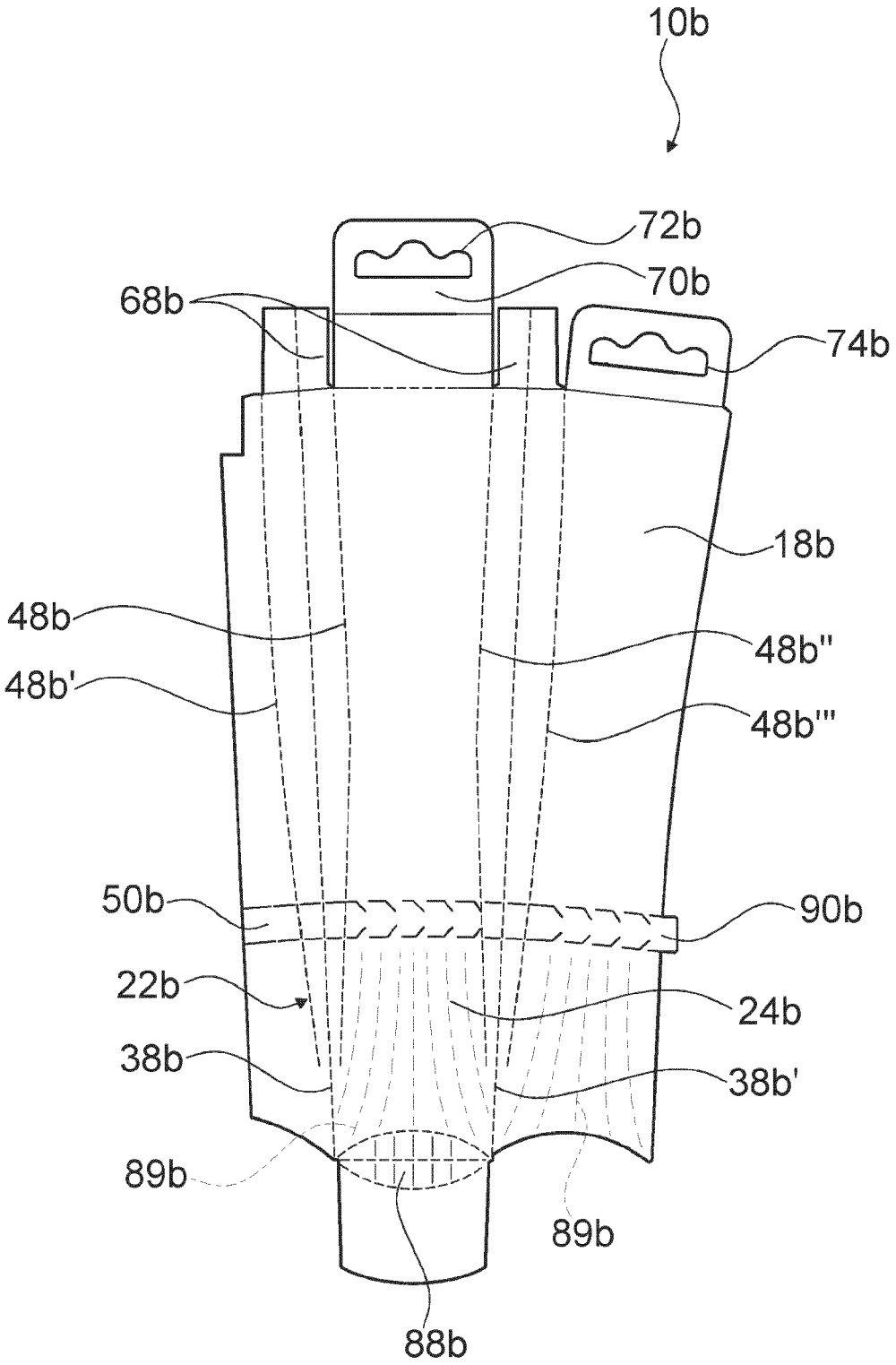
Figure 7A:
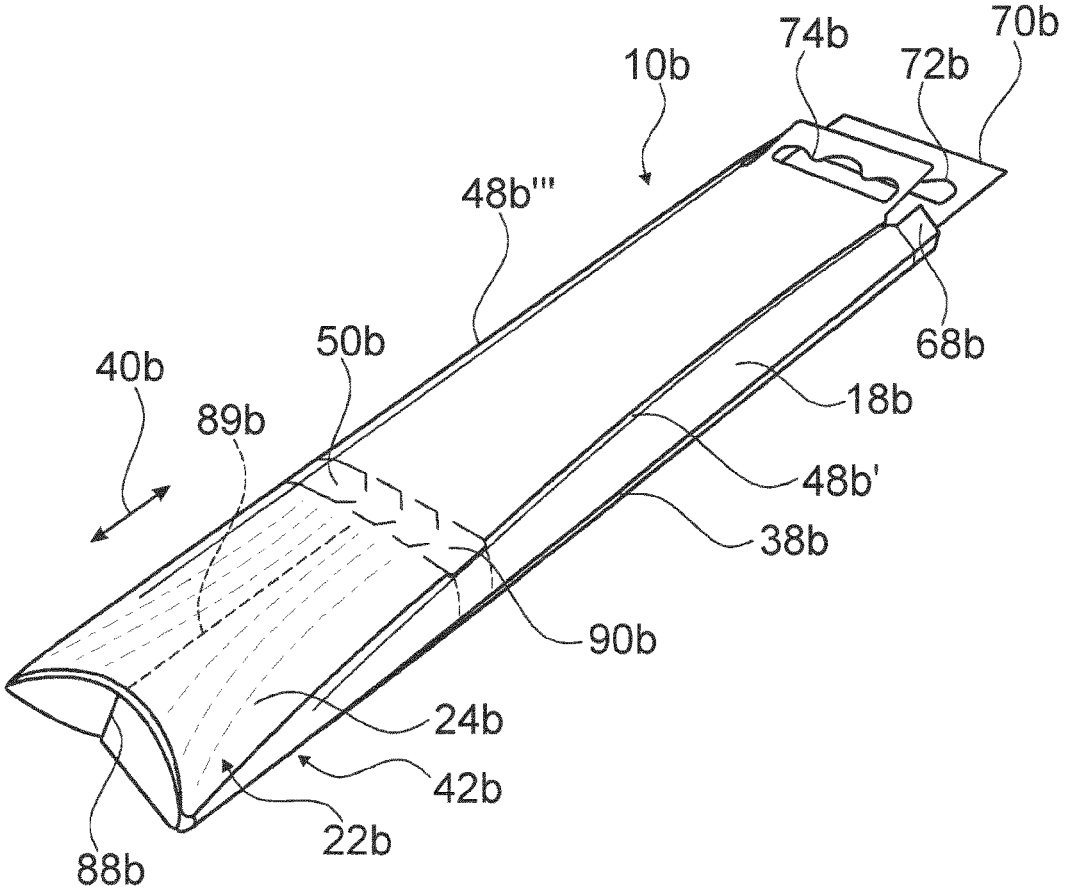
Figure 7B:
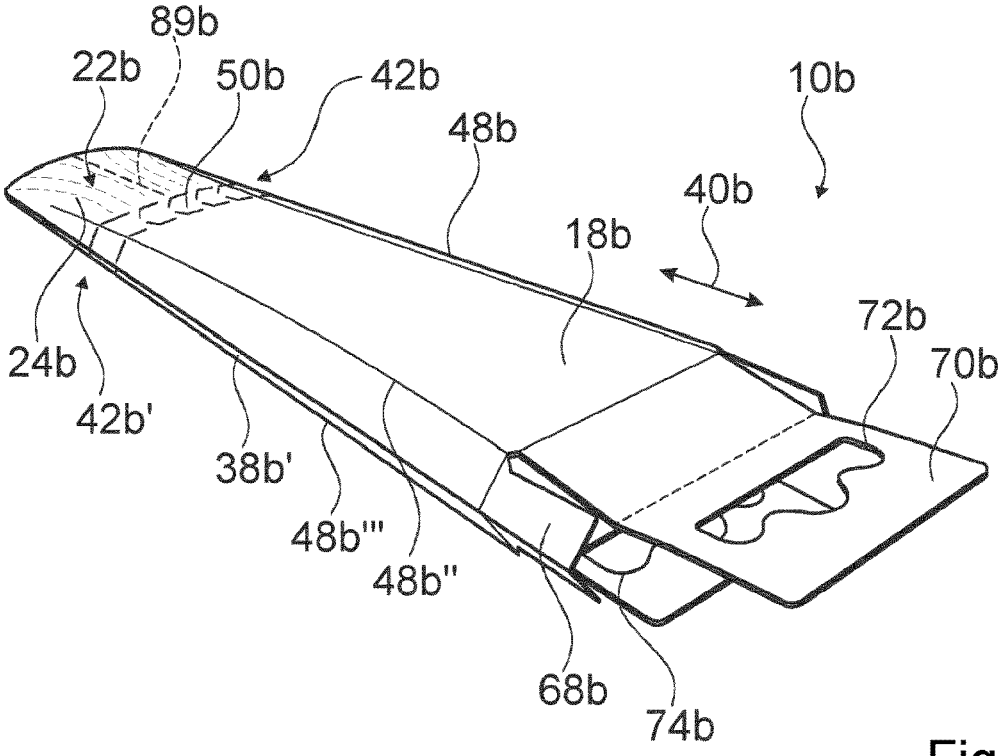
Figure 7C:
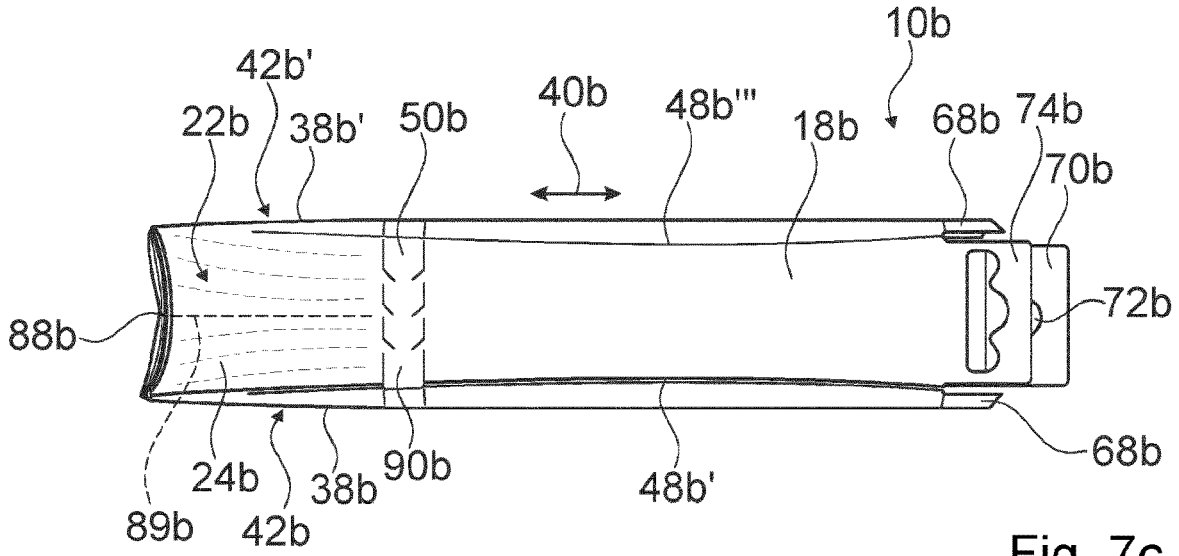
Figure 7D:
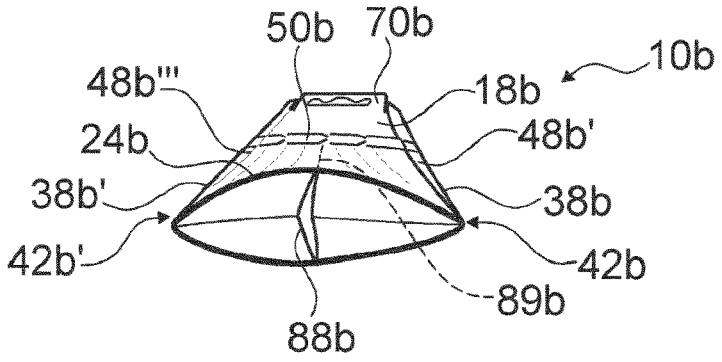
Figure 7E:
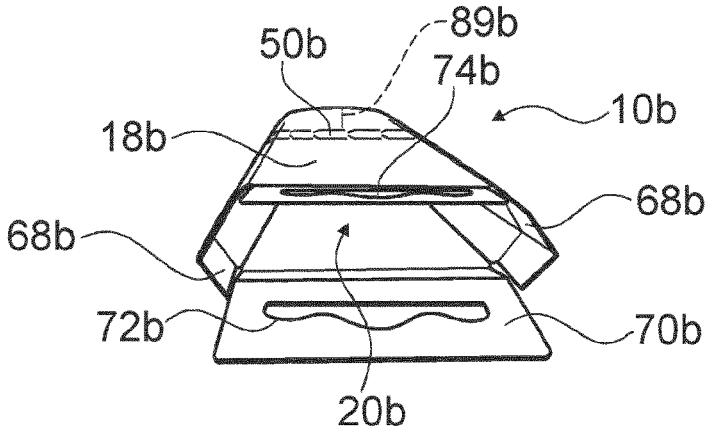
Figure 7F:
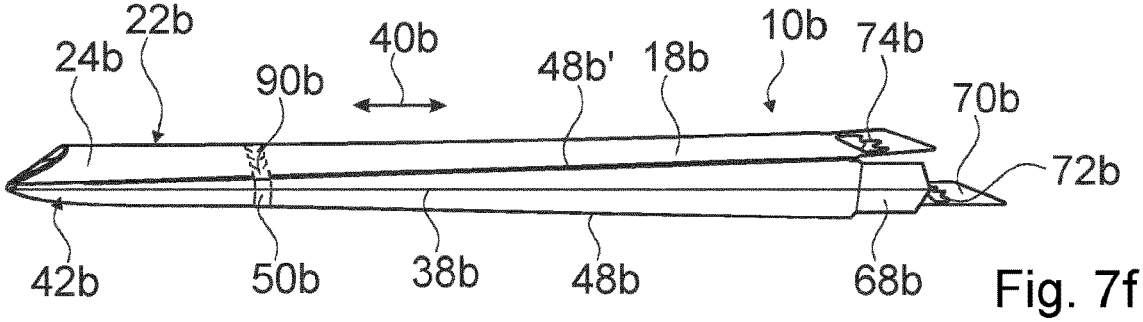
Figure 8A:
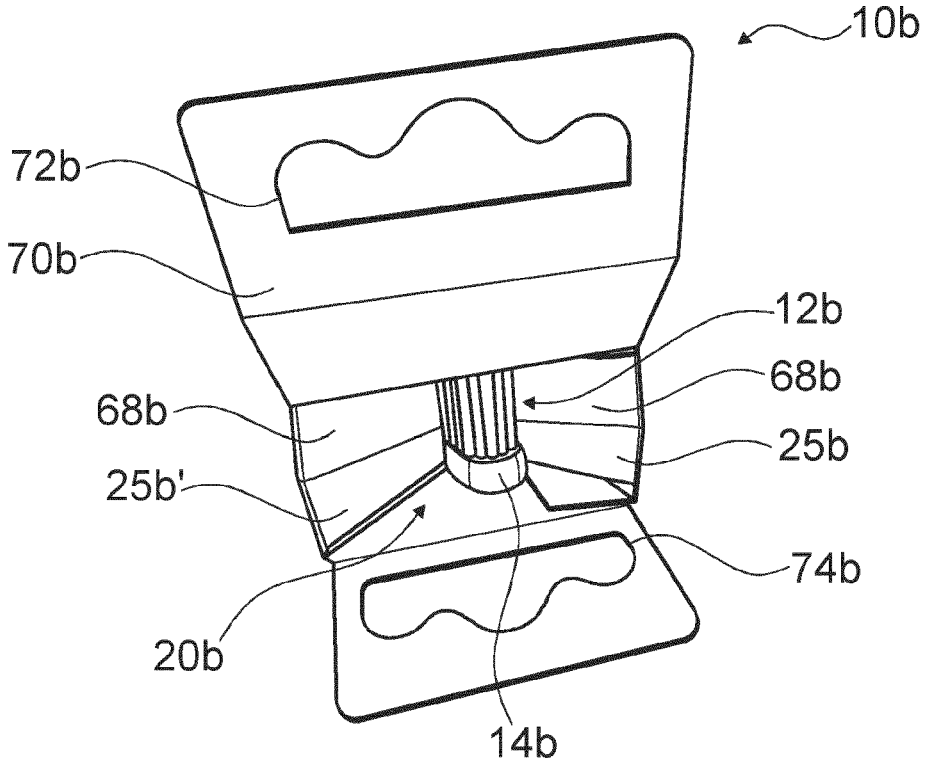
Figure 8B:
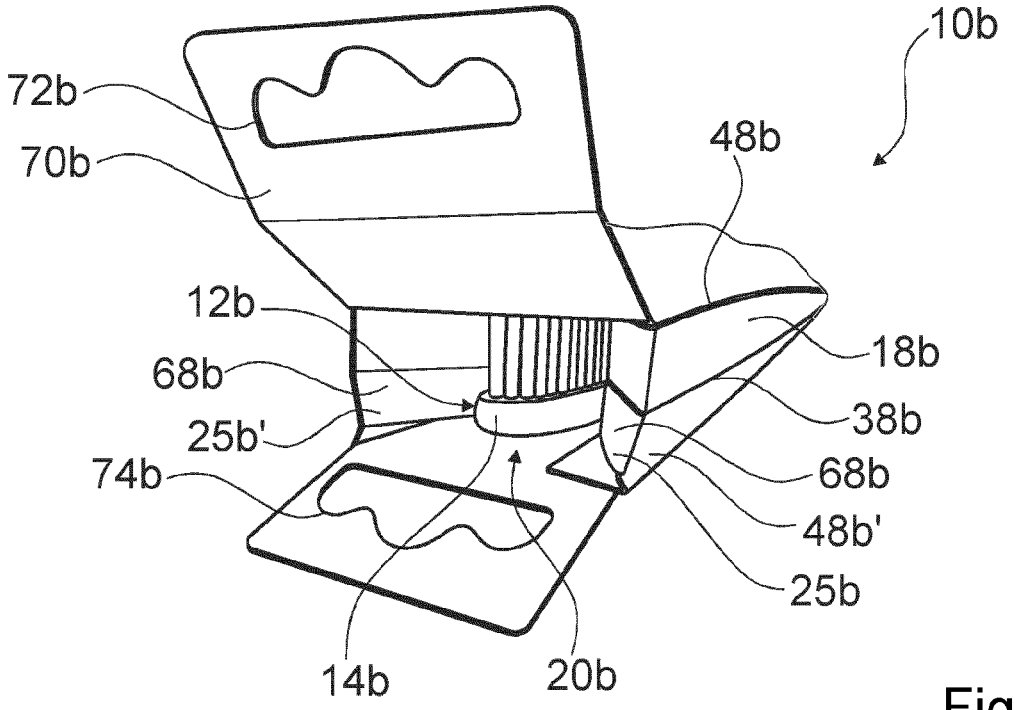
Figure 9A:
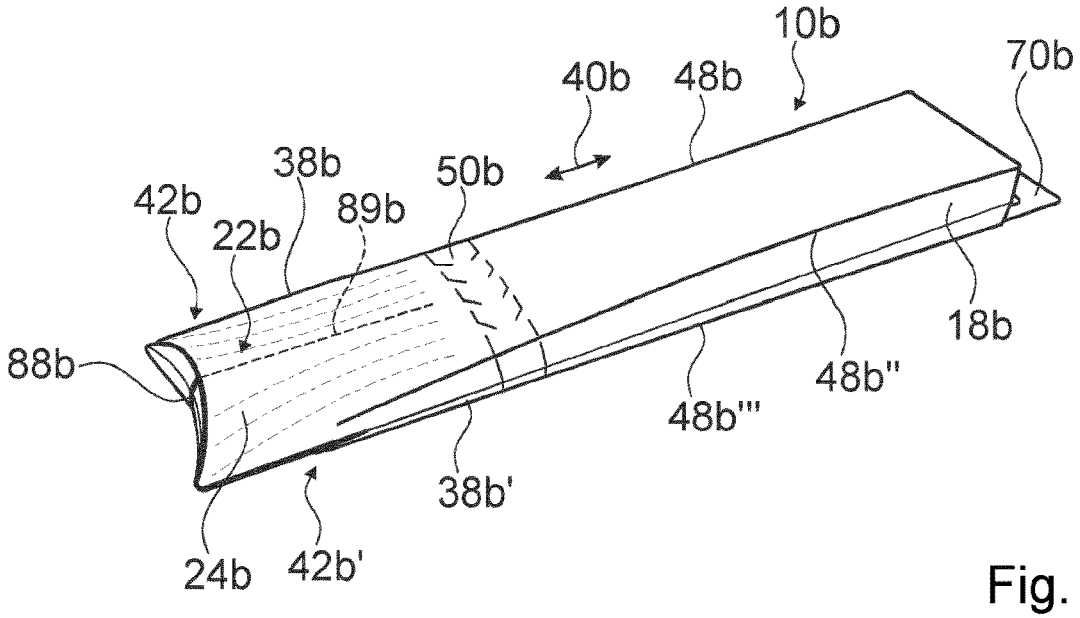
Figure 9B:
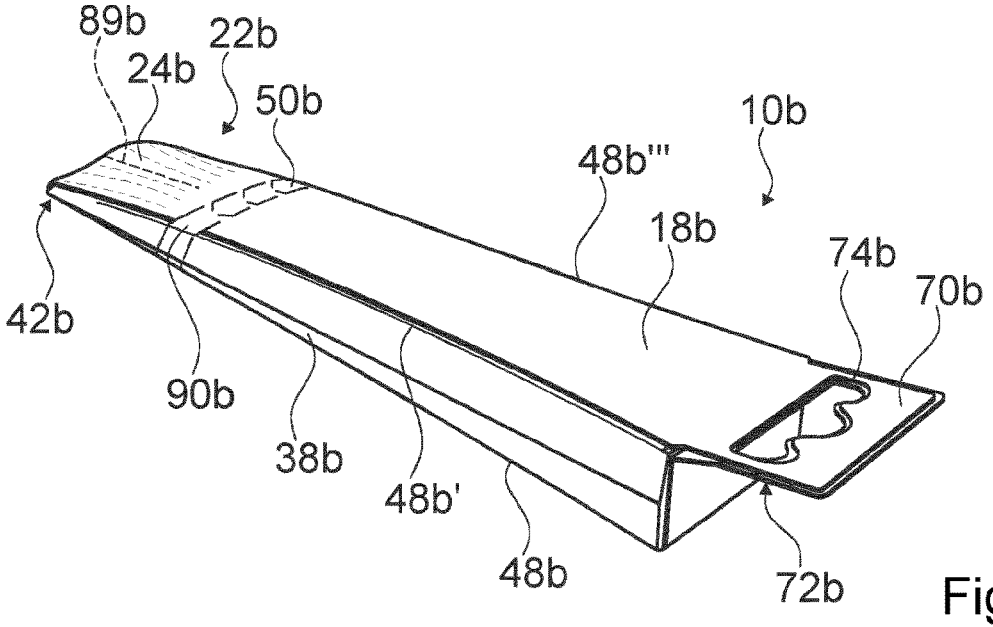
Figure 9C:
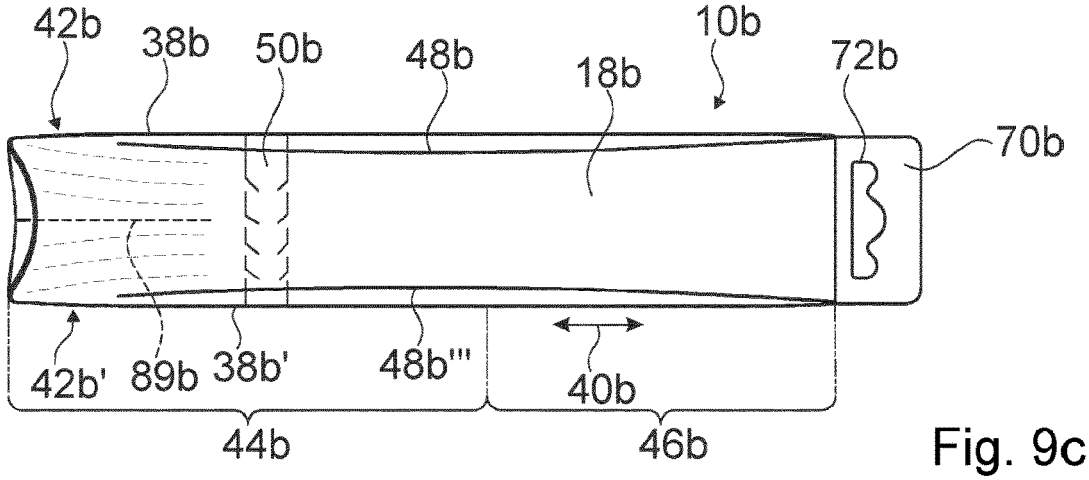
Figure 9D:
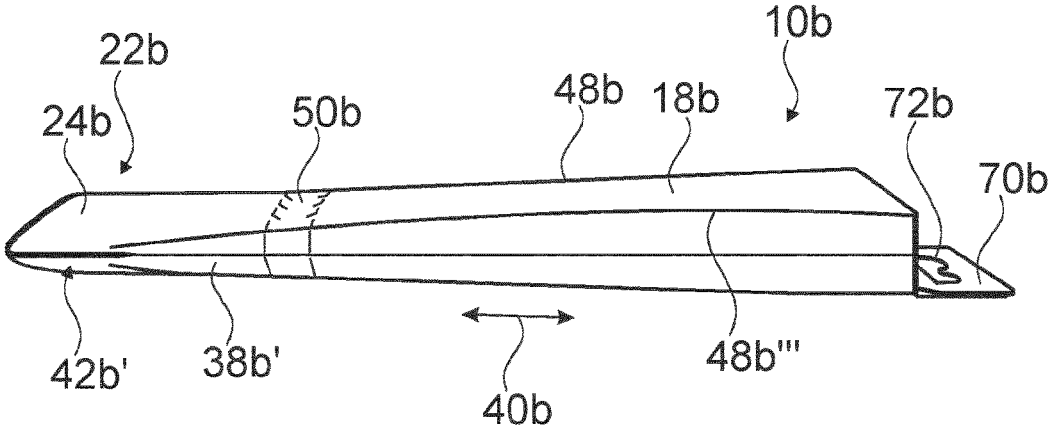
Figure 10:
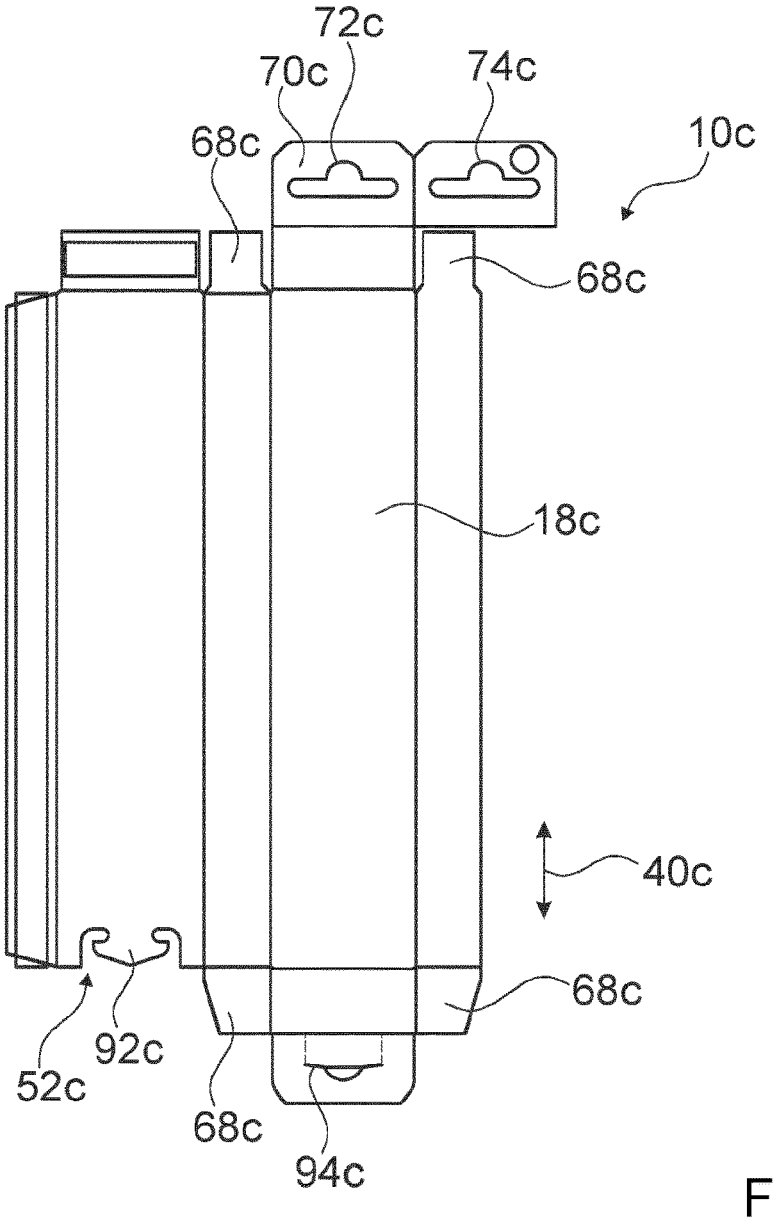
Figure 11A:
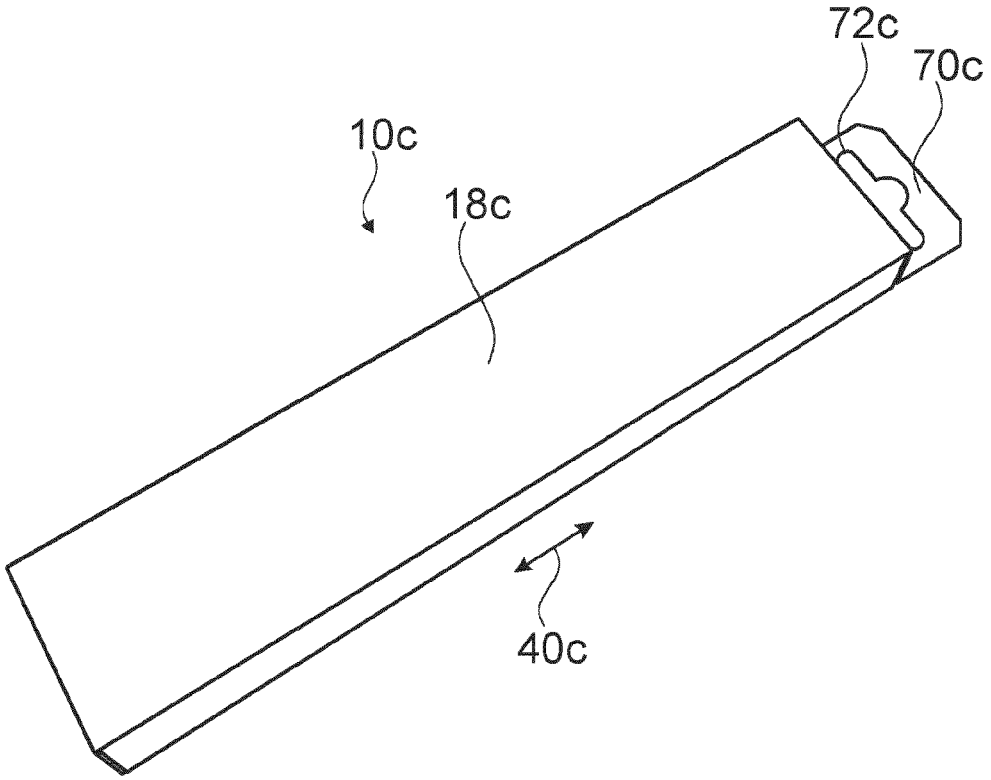
Figure 11B:
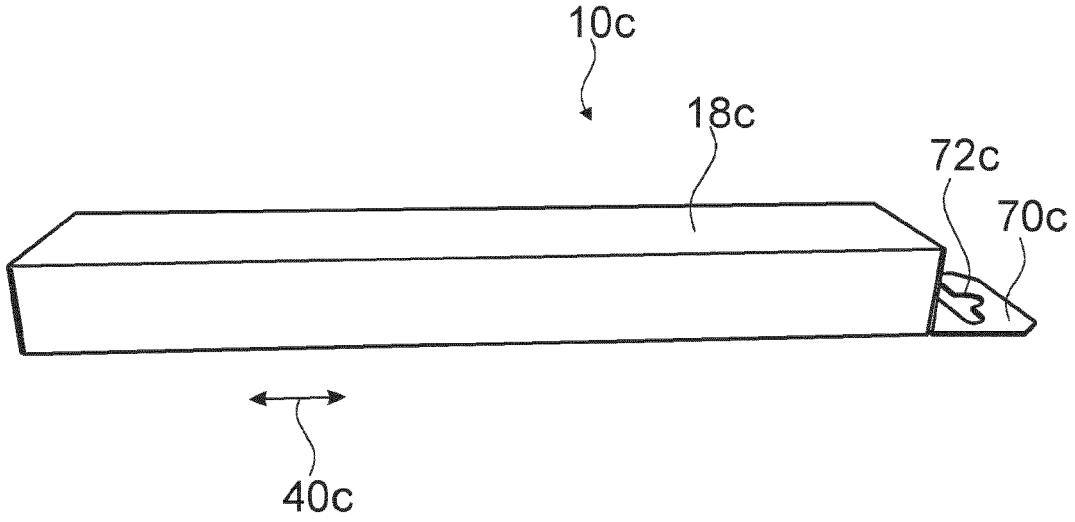
Figure 12A:
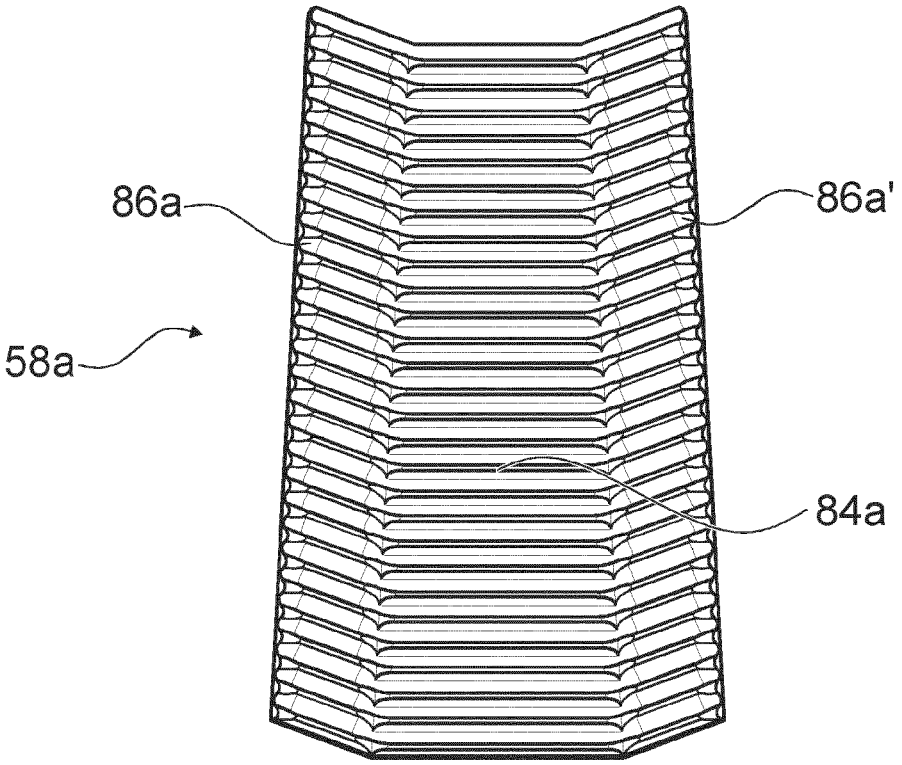
Figure 12B:
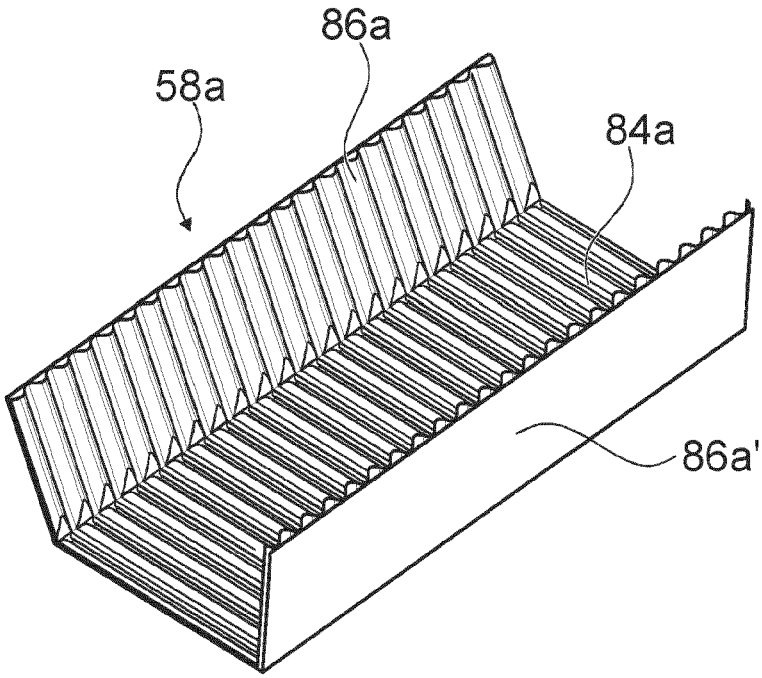
Figure 12C:
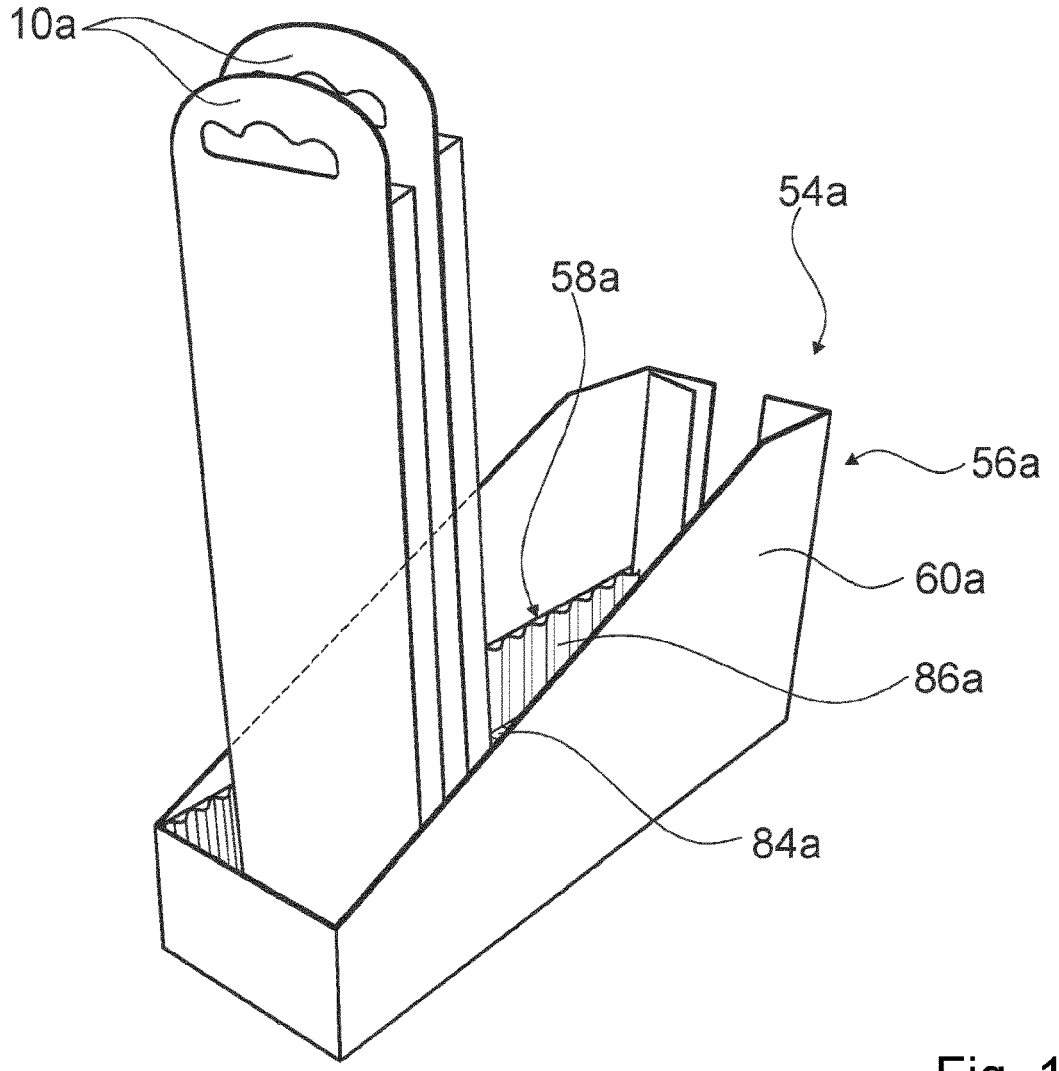
Figure 12D:
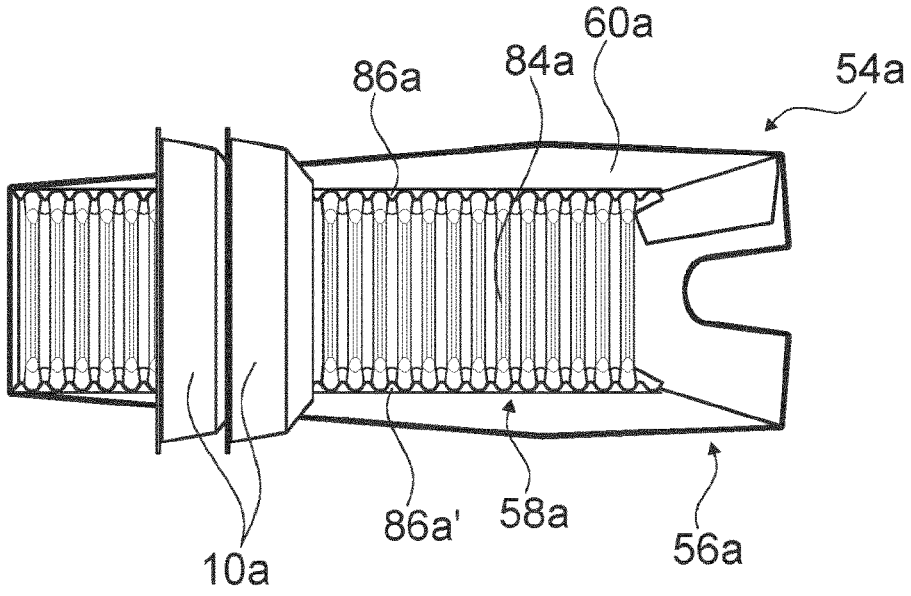
Figure 12E:
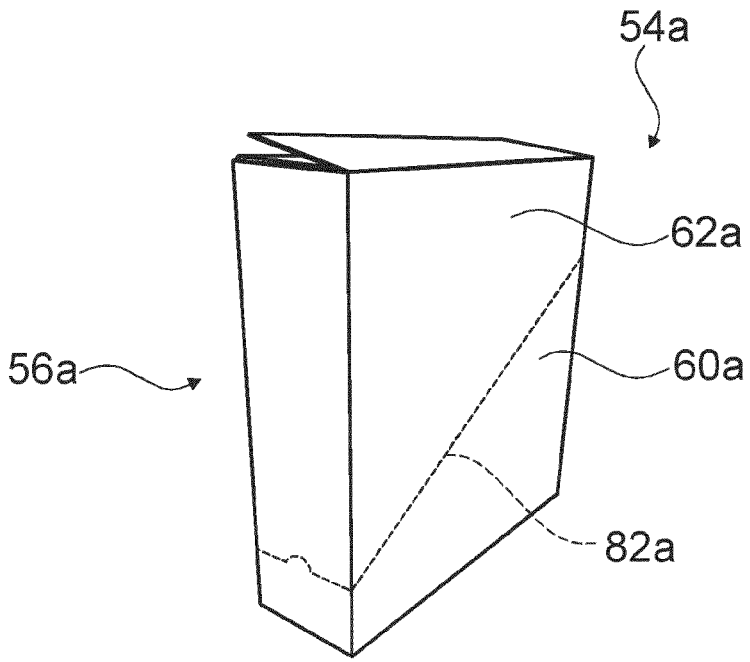
Figure 13:
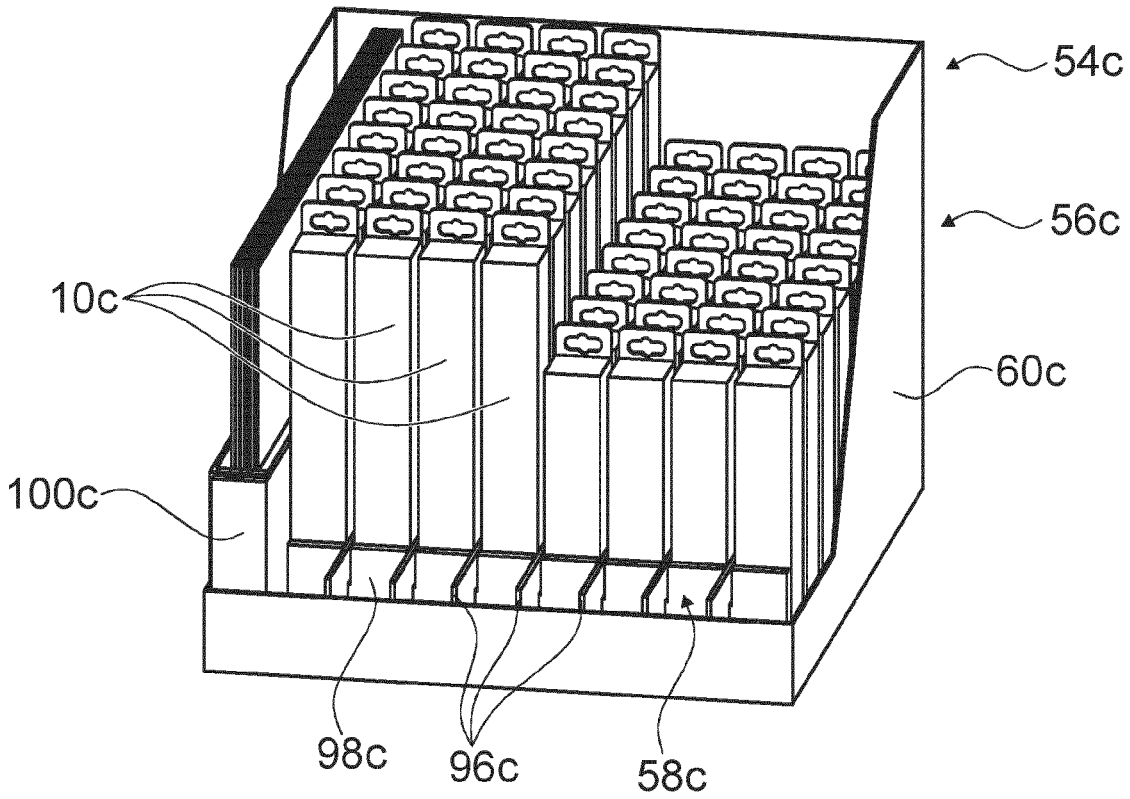
Figure 14:
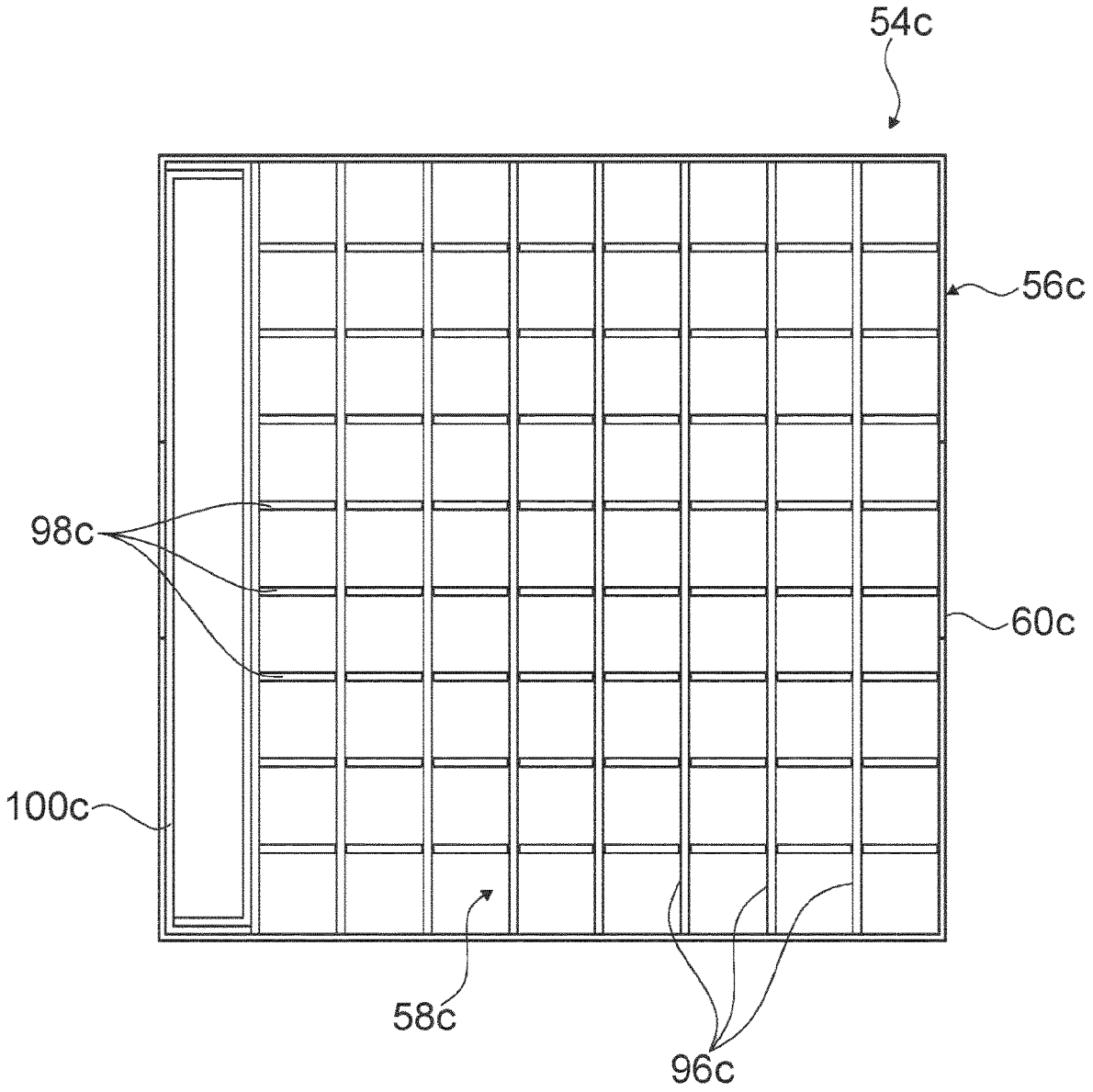
Figure 15A:
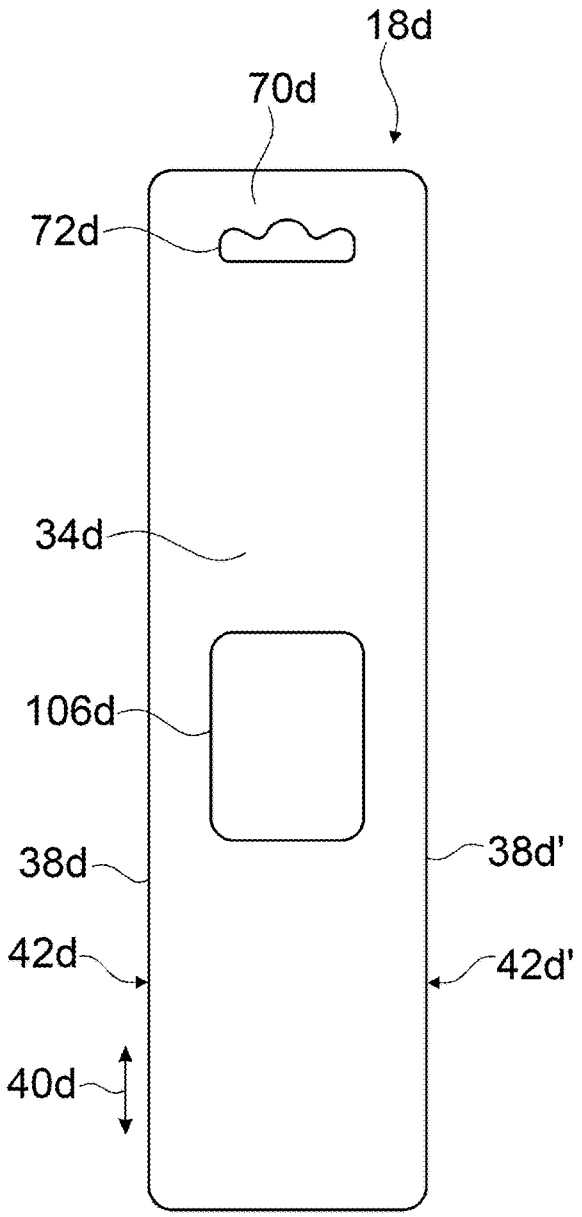
Figure 15B:
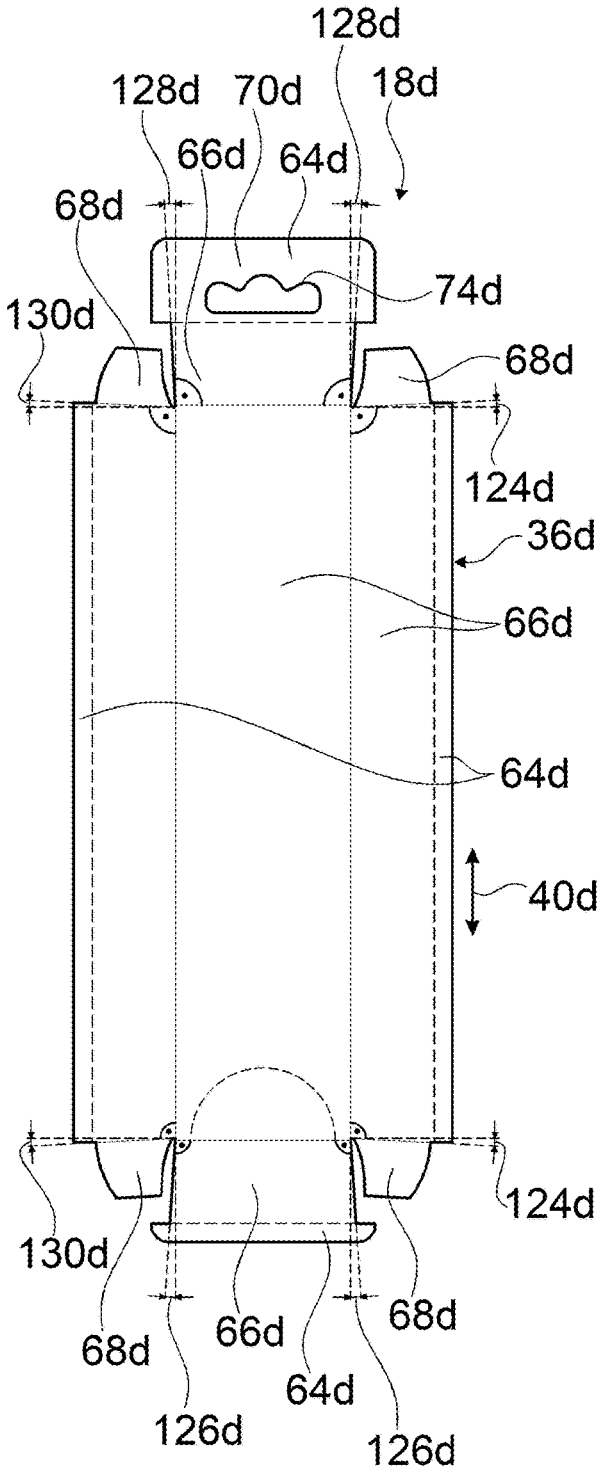
Figure 15C:
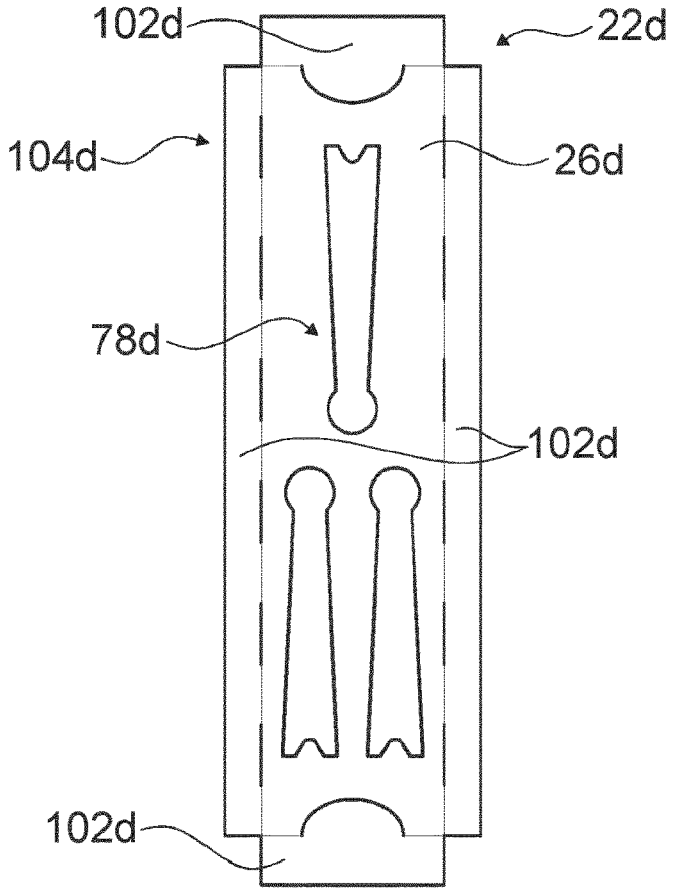
Figure 15D:
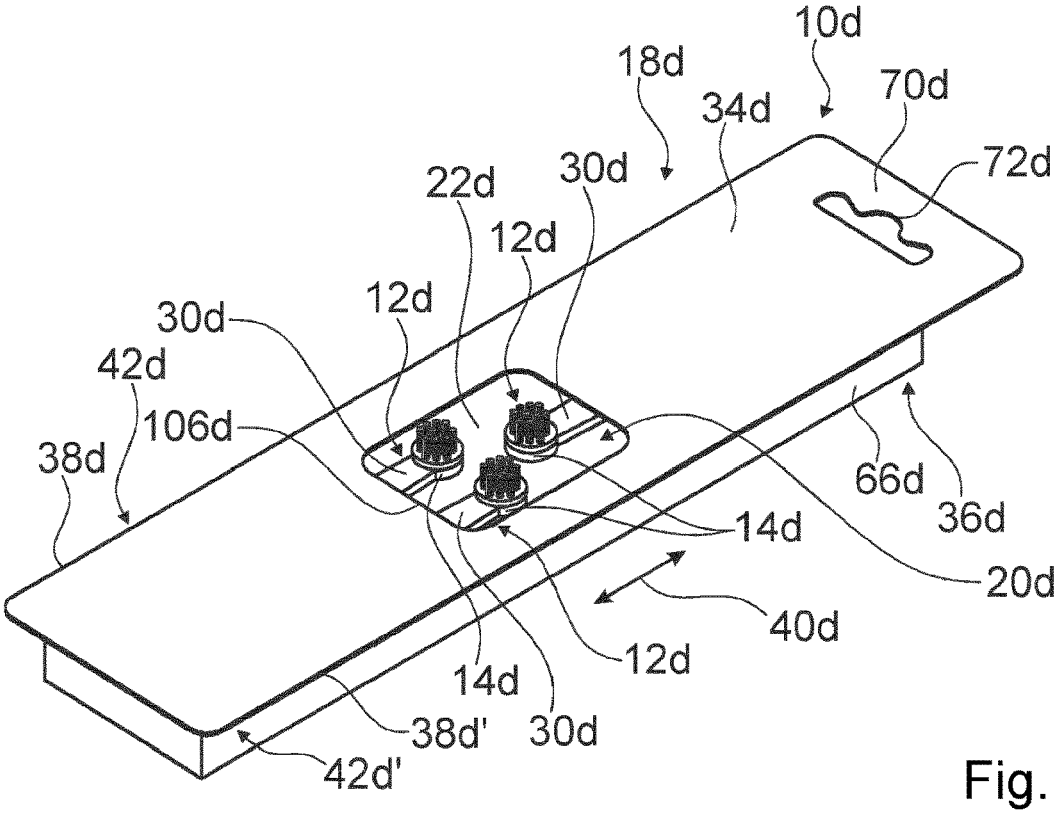
Figure 16A:
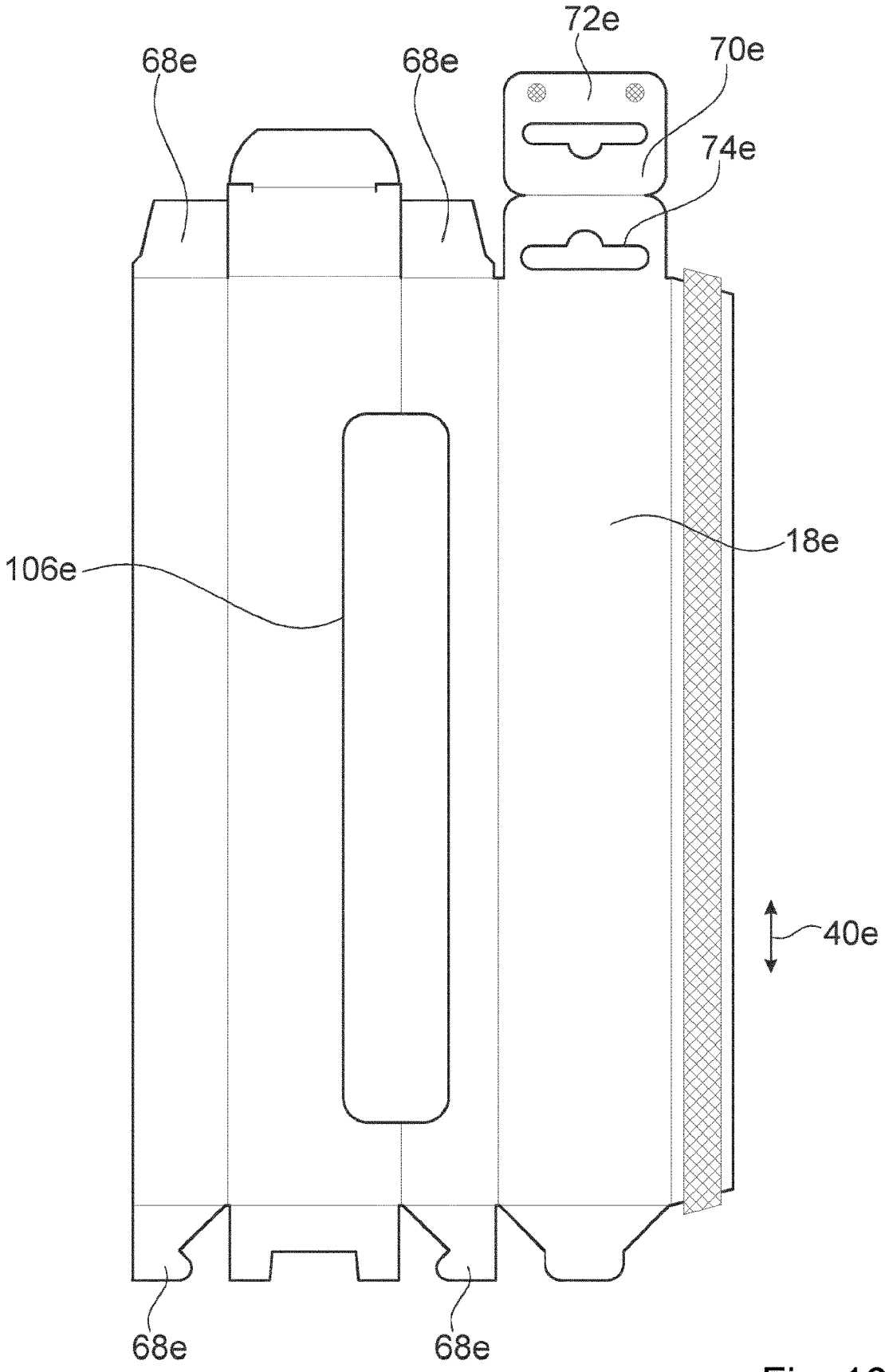
Figure 16B:
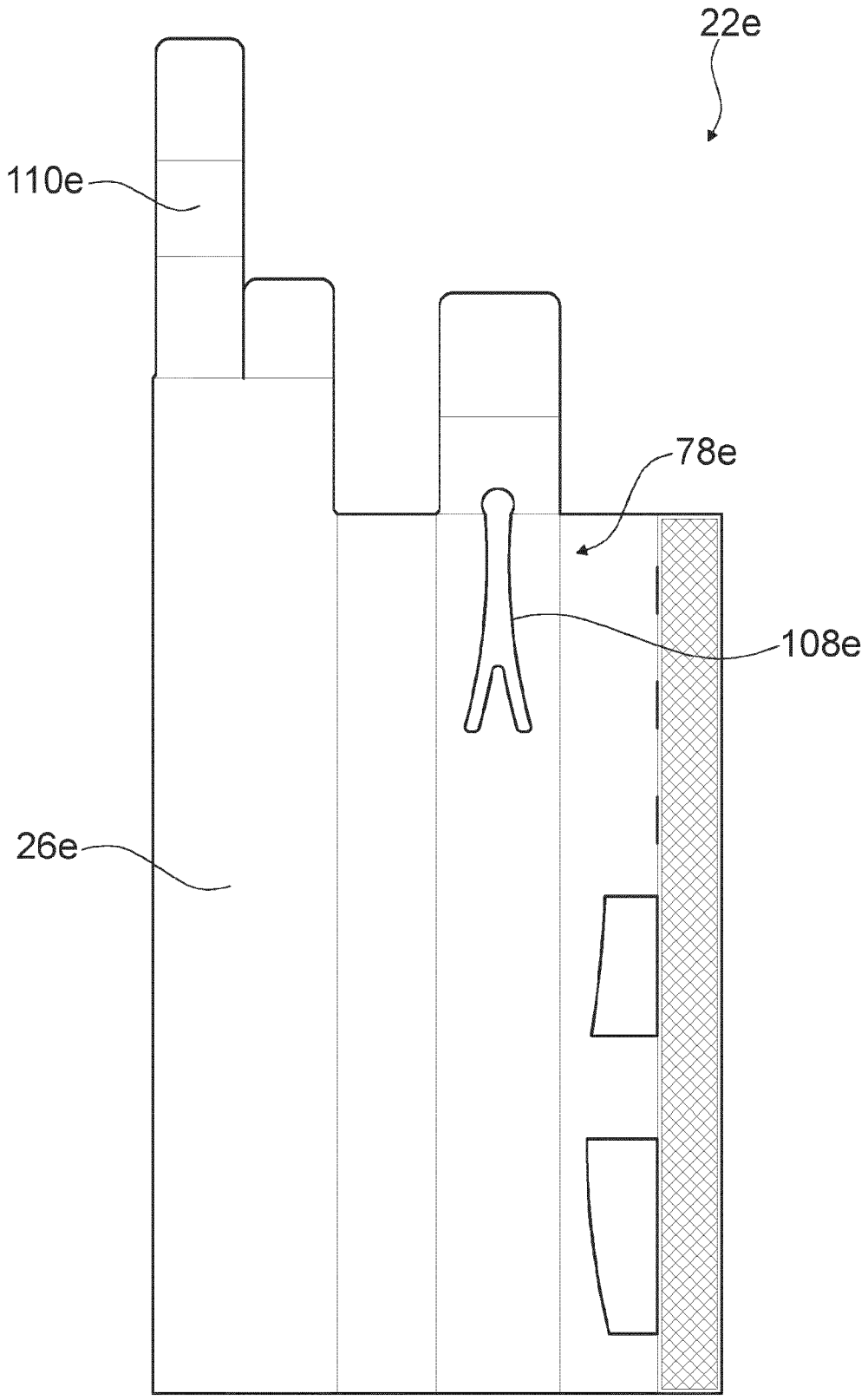
Figure 16C:
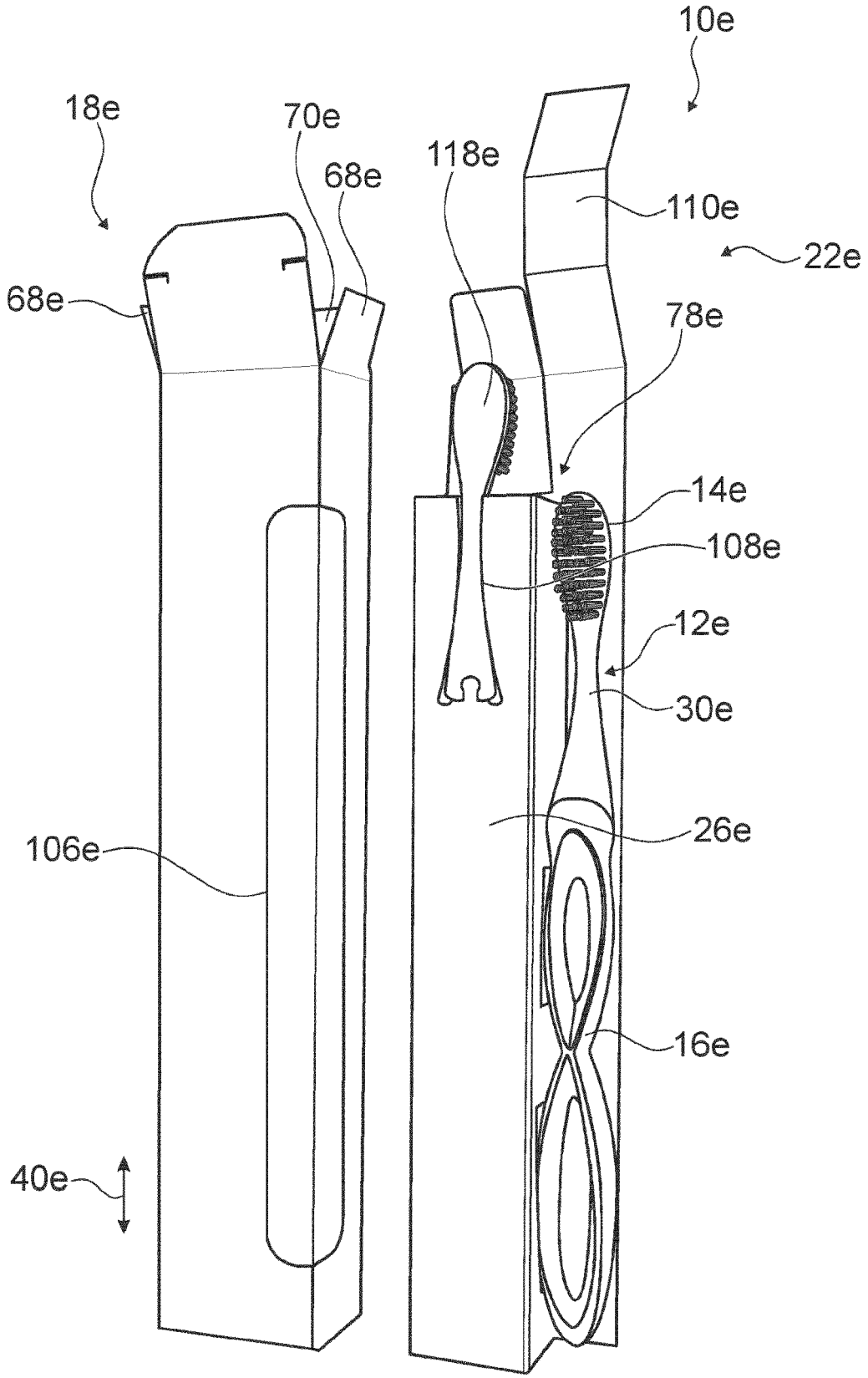
Figure 17:
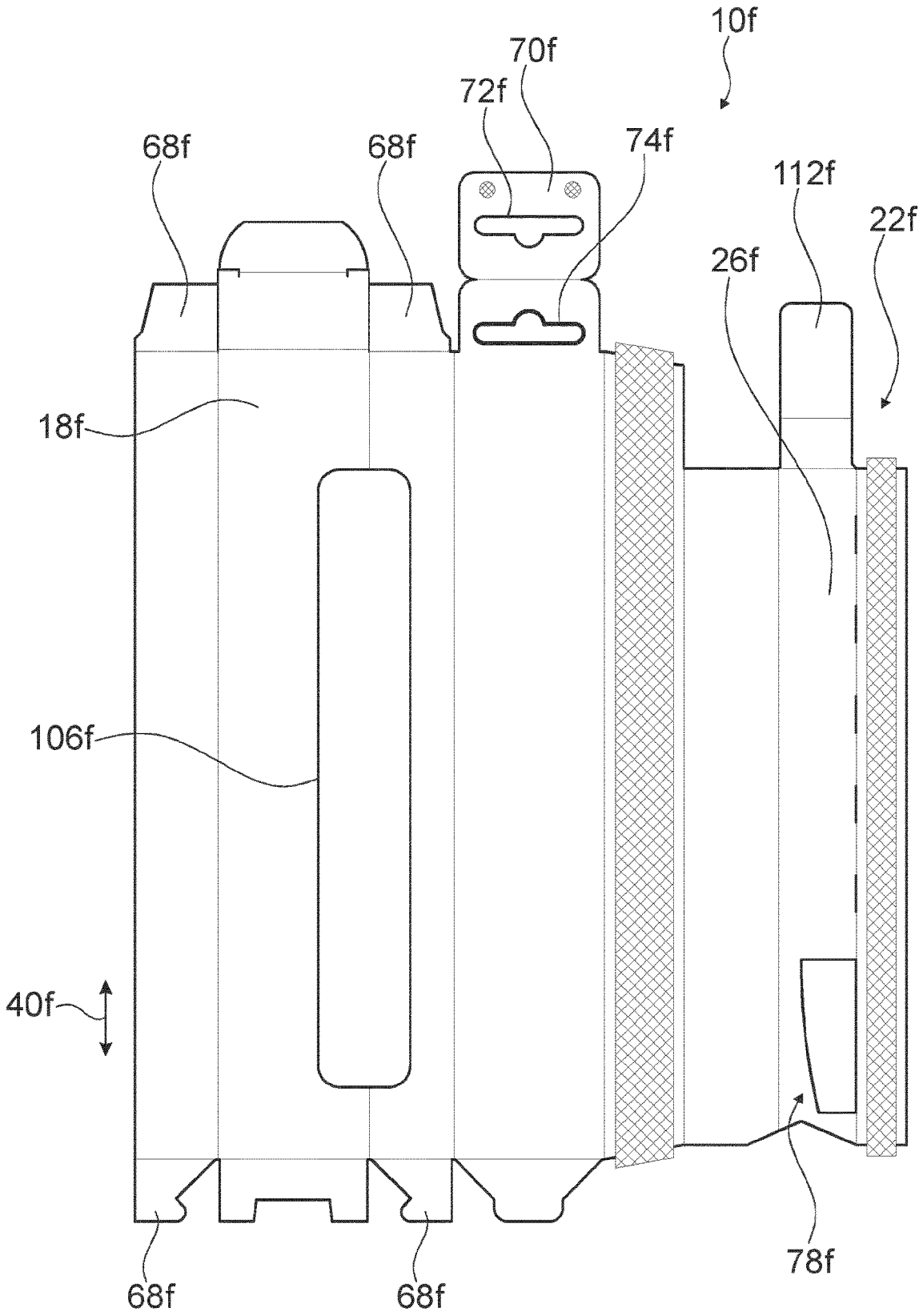
Figure 18A:
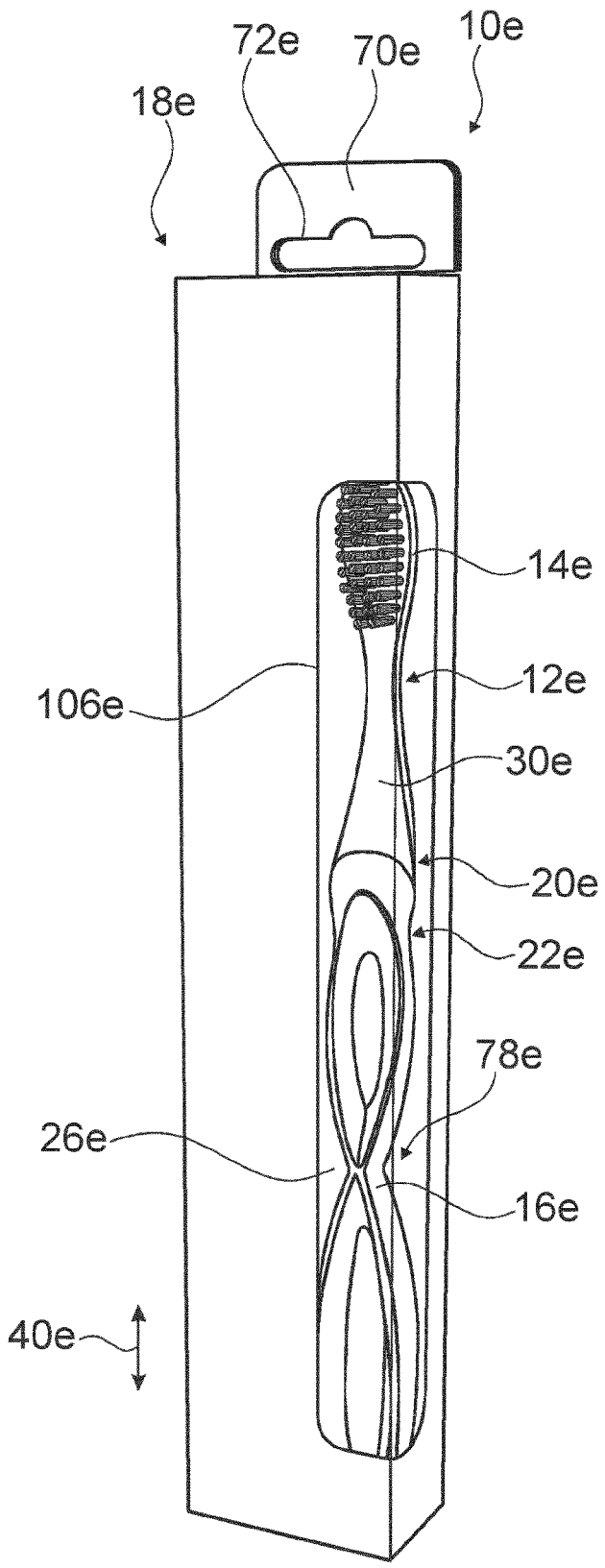
Figure 18B:
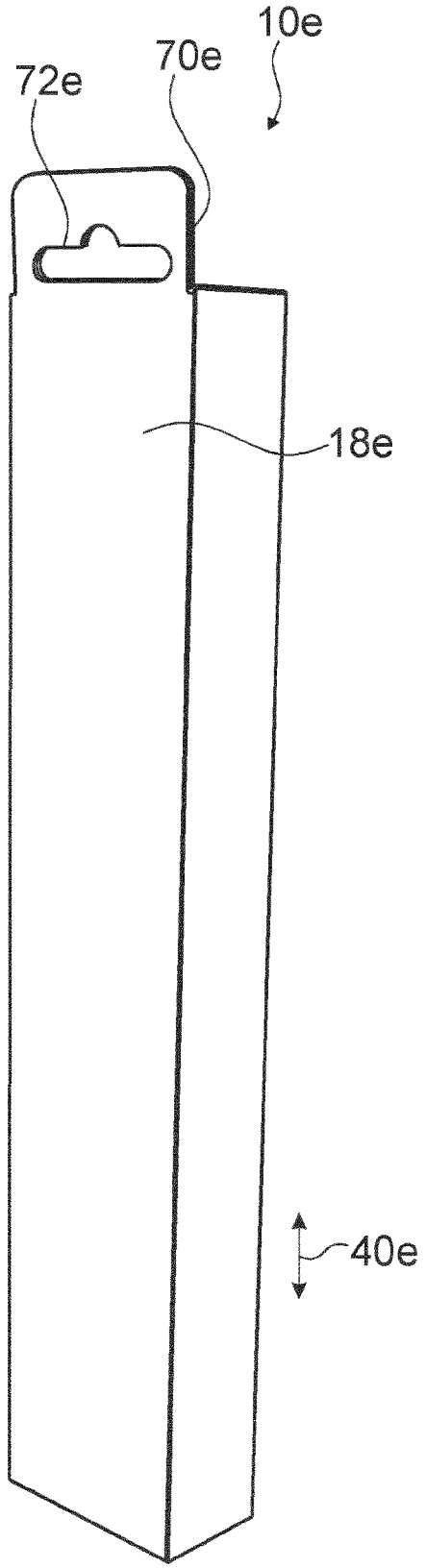
Figure 19A:
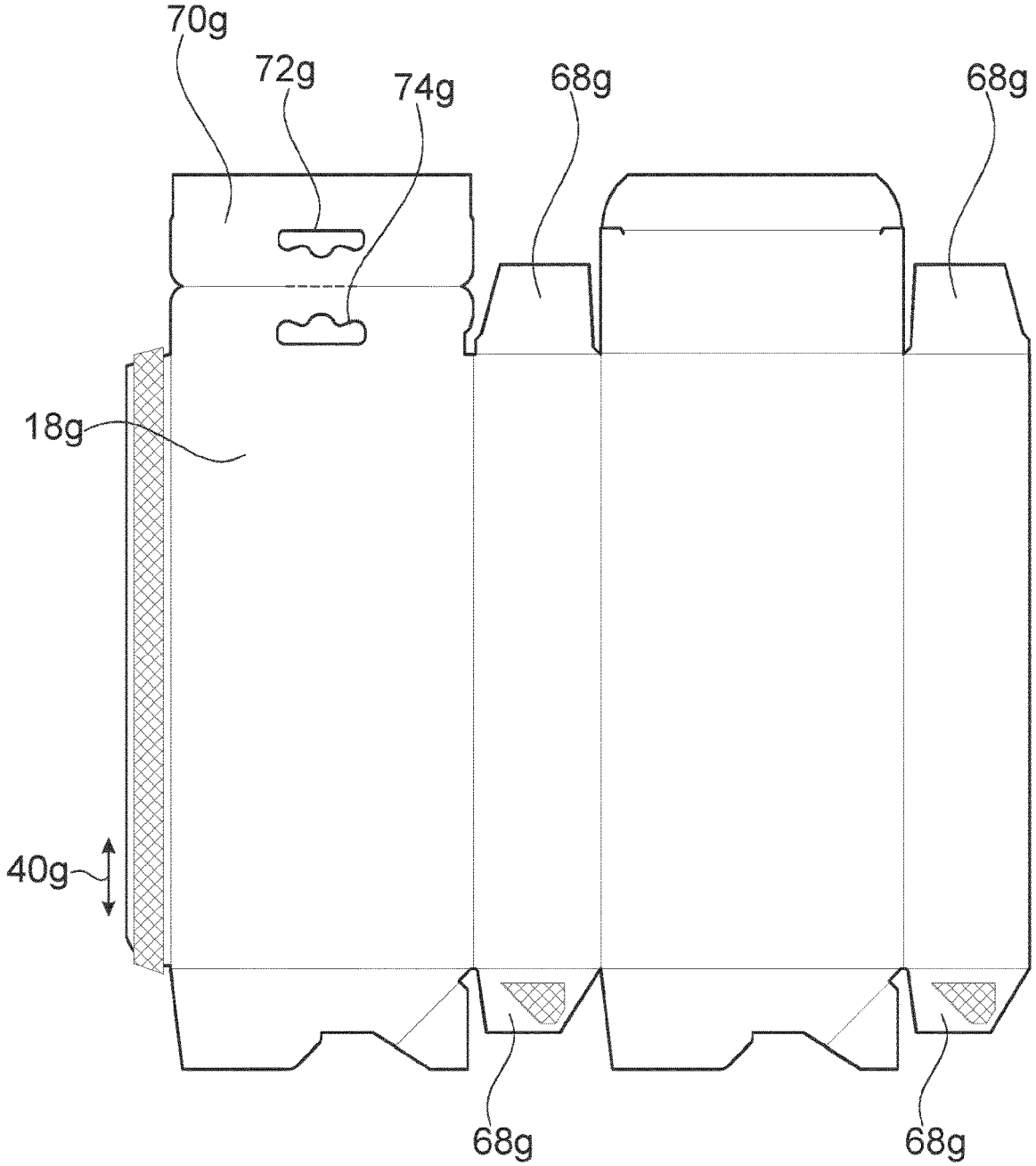
Figure 19B:
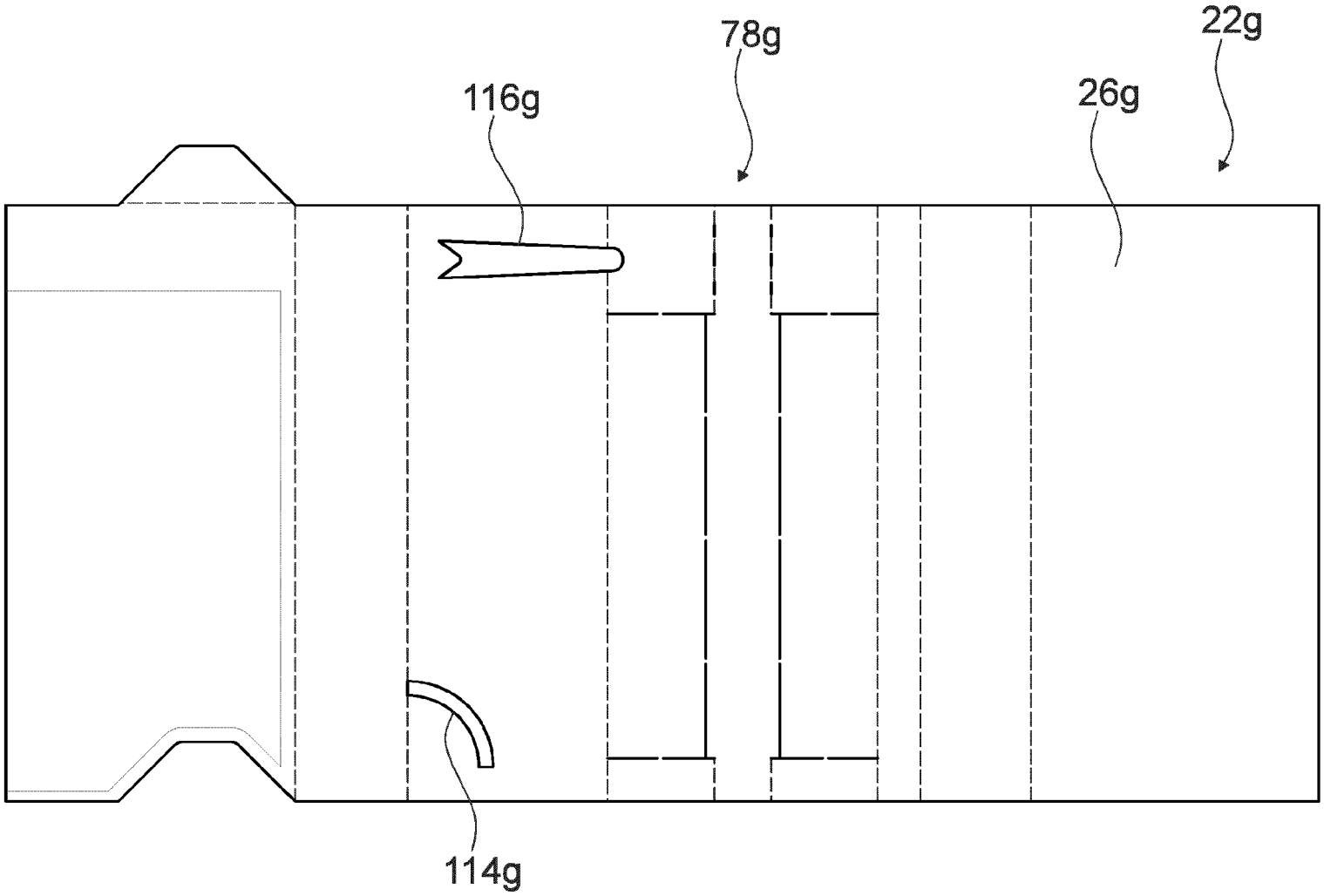
Figure 19C:
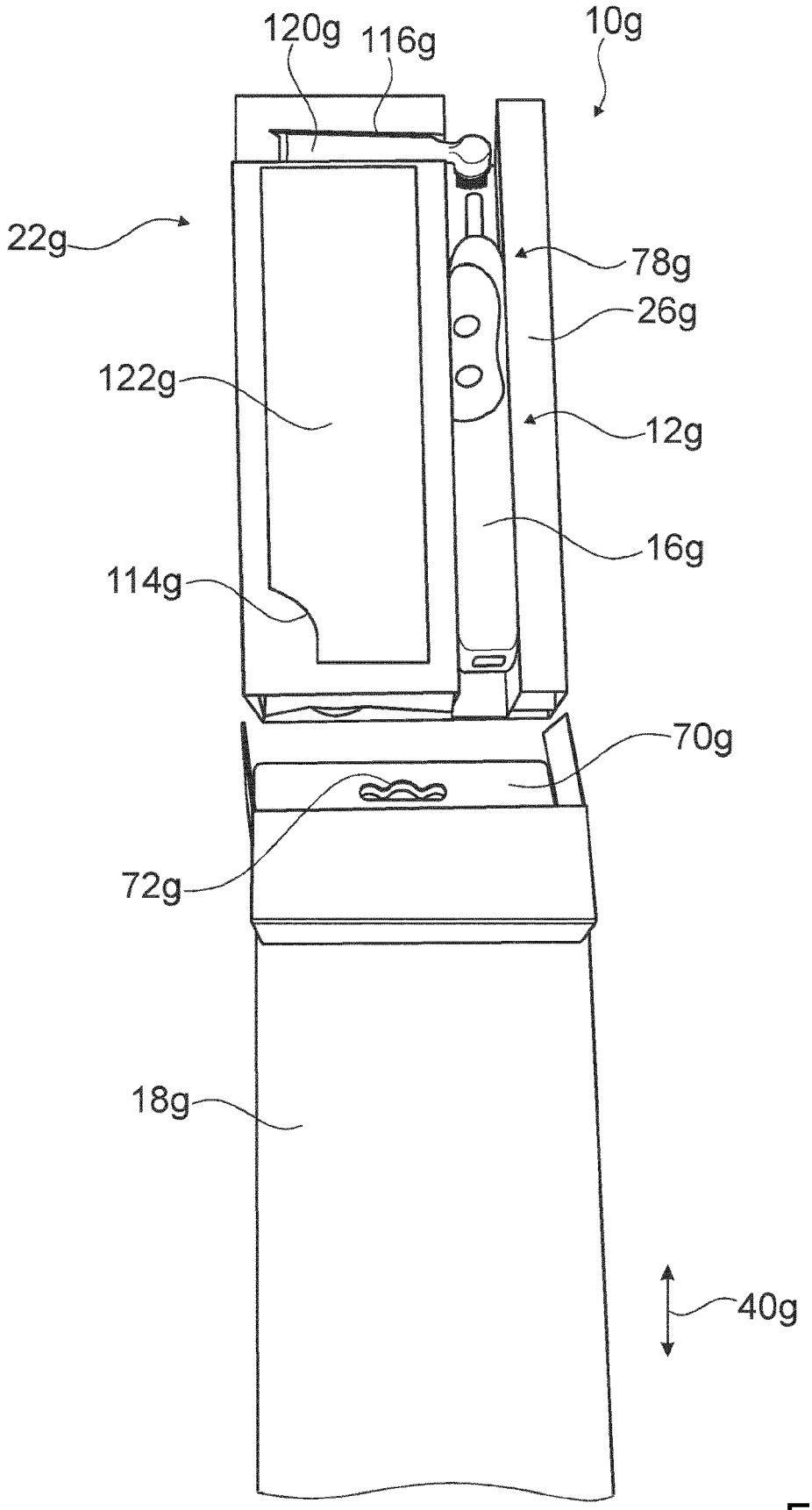

It is shown in:

FIG. 1 a blank of a card element of a packaging base body of a brush product packaging device according to the invention, in a plan view, FIG. 2 a blank of a hood element of the packaging base body of the brush product packaging device according to the invention, in a plan view, FIG. 3*a* the hood element of the packaging base body of the brush product packaging device according to the invention in a folded state, in a three-dimensional view from above, FIG. 3*b* the hood element of the packaging base body of the brush product packaging device according to the invention in a folded state, in a three-dimensional view from below, FIG. 3*c* the hood element of the packaging base body of the brush product packaging device according to the invention in a folded state, in a plan view, FIG. 3*d* the hood element of the packaging base body of the brush product packaging device according to the invention in a folded state, in a bottom view, FIG. 3*e* the hood element of the packaging base body of the brush product packaging device according to the invention in a folded state, in a side view onto a long side, FIG. 3*f* the hood element of the packaging base body of the brush product packaging device according to the invention in a folded state, in a side view onto a short side, FIG. 4*a* the brush product packaging device according to the invention, in a three-dimensional view from above, FIG. 4*b* the brush product packaging device according to the invention with a holding unit comprising a holding member, in a three-dimensional view from below, FIG. 4*c* the brush product packaging device according to the invention, in a side view onto a short side, FIG. 4*d* the brush product packaging device according to the invention, in a side view onto a long side, FIG. 5*a* a blank of a folding element of the holding unit of the brush product packaging device according to the invention, in a plan view, FIG. 5*b* the folding element of the holding unit of the brush product packaging device according to the invention in a folded state, in a three-dimensional view, FIG. 5*c* the folding element of the holding unit of the brush product packaging device according to the invention in a folded state, in a plan view, FIG. 5*d* the folding element of the holding unit and the hood element of the packaging base body of the brush product packaging device according to the invention in a folded state, in a three-dimensional view, FIG. 5*e* the folding element of the holding unit, the hood element of the packaging base body and a brush product accommodated in the hood element, in a three-dimensional view, FIG. 6 a blank of an alternative brush product packaging device according to the invention, in a plan view, FIG. 7*a* the alternative brush product packaging device according to the invention in a folded, open state, in a three-dimensional view from the front, FIG. 7*b* the alternative brush product packaging device according to the invention in a folded, open state, in a three-dimensional view, from the rear, FIG. 7*c* the alternative brush product packaging device according to the invention in a folded, open state, in a plan view, FIG. 7*d* the alternative brush product packaging device according to the invention in a folded, open state, in a side view onto a short side (upper side), FIG. 7*e* the alternative brush product packaging device according to the invention in a folded, open state, in a side view onto a short side (underside), FIG. 7*f* the alternative brush product packaging device according to the invention in a folded, open state, in a side view onto a long side, FIG. 8*a* the alternative brush product packaging device according to the invention in a folded, open state, in a side view onto a short side (upper side) with an accommodated brush product, FIG. 8*b* the alternative brush product packaging device according to the invention in a folded, open state, in a side view onto a short side (upper side with an accommodated brush product, FIG. 9*a* the alternative brush product packaging device according to the invention in a folded, closed state, in a three-dimensional view from the front, FIG. 9*b* the alternative brush product packaging device according to the invention in a folded, closed state, in a three-dimensional view from the rear, FIG. 9*c* the alternative brush product packaging device according to the invention in a folded, closed state, in a plan view, FIG. 9*d* the alternative brush product packaging device according to the invention in a folded, closed state, in a side view onto a long side, FIG. 10 a blank of a further alternative brush product packaging device according to the invention, in a plan view, FIG. 11*a* the further alternative brush product packaging device according to the invention in a folded, closed state, in a three-dimensional view from the front, FIG. 11*b* the further alternative brush product packaging device according to the invention in a folded, closed state, in a three-dimensional view from the side, FIG. 12*a* a packaging insert of a tray packaging in a three-dimensional view from the front, FIG. 12*b* the packaging insert of the tray packaging in a three-dimensional view from the side, FIG. 12*c* the tray packaging with a shoe element of a secondary packaging base body and with the packaging insert and with two brush product packaging devices accommodated in the tray packaging, in a three-dimensional view, FIG. 12*d* the tray packaging with the shoe element of the secondary packaging base body and with the packaging insert, and with two brush product packaging devices accommodated in the tray packaging, in a three-dimensional view from above, FIG. 12*e* the tray packaging with the secondary packaging base body comprising a hood element, in a three-dimensional view, FIG. 13 an alternative tray packaging with a secondary packaging base body and with a packaging insert, in a three-dimensional view, FIG. 14 the alternative tray packaging with the secondary packaging base body and with the packaging insert, in a plan view, FIG. 15*a* a blank of a card element of a further alternative brush product packaging device according to the invention, in a plan view, FIG. 15*b* a blank of a hood element of a packaging base body of the further brush product packaging device according to the invention, in a plan view, FIG. 15*c* a blank of a holding unit of the packaging base body of the further brush product packaging device according to the invention, in a plan view, FIG. 15*d* the further alternative brush product packaging device according to the invention, in a three-dimensional view from above, FIG. 16*a* a blank of a further alternative brush product packaging device according to the invention, in a plan view, FIG. 16*b* a blank of a holding unit of a packaging base body of the further alternative brush product packaging device according to the invention, in a plan view, FIG. 16*c* the further alternative brush product packaging device according to the invention in a state when not combined and loaded with a brush product and a plug-on brush, in a three-dimensional view, FIG. 17 a blank of a further alternative brush product packaging device according to the invention, in a plan view, FIG. 18*a* the further alternative brush product packaging devices according to the invention of FIGS. 16*a-c* and 17, in a three-dimensional view from above, FIG. 18*b* the further alternative brush product packaging devices according to the invention of FIGS. 16*a-c* and 17, in a three-dimensional view from the rear, FIG. 19*a* a blank of a further alternative brush product packaging device according to the invention, in a plan view, FIG. 19*b* a blank of a holding unit of a packaging base body of the further alternative brush product packaging device according to the invention, in a plan view, and FIG. 19*c* the further alternative brush product packaging device according to the invention loaded with a brush product, a plug-on brush and further accessories, in a state when not combined, in a three-dimensional view.

DESCRIPTION OF THE EXEMPLARY EMBODIMENTS

FIGS. 1 to 5 show a brush product packaging device 10*a* for an accommodation of a brush product 12*a*. The brush product 12*a* comprises an application head 14*a* and a handle 16*a*. The application head 14*a* comprises a bristle region. The brush product 12*a* further comprises a neck 30*a*, which connects the handle 16*a* to the application head 14*a*. The brush product 12*a* is realized as a toothbrush, in particular a manual hand toothbrush. The brush product packaging device 10*a* is exemplarily configured to receive a toothbrush. The brush product packaging device 10*a* forms a primary packaging for the brush product 12*a*. The brush product packaging device 10*a* is embodied as a sales packaging. The brush product packaging device 10*a* comprises a receiving region 20*a* for receiving the brush product 12*a*. The receiving region 20*a* is approximately rectangular-cuboid-shaped. The receiving region 20*a* is implemented such that it is substantially closed. The receiving region 20*a* is in particular implemented such that it is not completely tight.

The brush product packaging device 10*a* and the brush product 12*a* accommodated in the brush product packaging device 10*a* form a system, in particular a sales system.

The brush product packaging device 10*a* comprises a packaging base body 18*a*. The packaging base body 18*a* implements a base body of the brush product packaging device 10*a*. The packaging base body 18*a* is configured to form the substantially closed receiving region 20*a* for the brush product 12*a*. The packaging base body 18*a* delimits the receiving region 20*a* materially. Furthermore, the packaging base body 18*a* is implemented largely of a paper material. The packaging base body 18*a* is implemented of solid fiberboard.

The packaging base body 18*a* comprises a planar card element 34*a* and a folded hood element 36*a*, which is superimposed on the card element 34*a*. The card element 34*a* and the hood element 36*a* are implemented largely of a paper material. The card element 34*a* and the hood element 36*a* are implemented of solid fiberboard. The card element 34*a* and the hood element 36*a* have the same material thickness. The hood element 36*a* is in a mounted state fixedly connected to the card element 34*a*. Furthermore, an extent of the hood element 36*a* along a main extension direction 40*a* of the brush product packaging device 10*a* substantially corresponds to an extent of the card element 34*a* along the main extension direction 40*a* of the brush product packaging device 10*a*. The card element 34*a* is arranged on a front side of the brush product packaging device 10*a*. The card element 34*a* is implemented so as to be substantially rectangular. The card element 34*a* has a length of 50 mm to 300 mm, preferably of 100 mm to 260 mm. The card element 34*a* further has a width of 20 mm to 150 mm, preferably of 35 mm to 135 mm. The grammage of the card element 34*a* is 200 g/m$^2$ to 500 g/m$^2$, preferably 250 g/m$^2$ to 450 g/m$^2$. The hood element 36*a* is arranged on a rear side of the brush product packaging device 10*a*. The hood element 36*a* has delimiting surfaces 66*a* delimiting the receiving region 20*a* and has sealing margins 64*a* connected to the delimiting surfaces 66*a* and configured for a connection to the card element 34*a*. The sealing margins 64*a* are connected to the delimiting surfaces 66*a* of the hood element 36*a* via perforations and creasings. The hood element 36*a* is produced from a blank (FIG. 2). The blank of the hood element 36*a* has several delimiting surfaces 66*a*, which comprise a rectangular base side and four trapezoid-shaped side portions. On the side portions respectively one sealing margin 64*a* is arranged, wherein in a region of the tab 70*a*, the sealing margin 64*a* comprises the entire tab 70*a*. Furthermore, respectively one dust tab 68*a* is arranged on the two long trapezoid-shaped side portions, in each case on both free edges. In a flat state, the hood element 36*a* has a length of 70 mm to 320 mm, preferably of 110 mm to 280 mm. The hood element 36*a* further has in a flat state a width of 40 mm to 150 mm, preferably of 50 mm to 120 mm. In a formed state of the hood element 36*a*, the inner dimensions of the tub that forms the receiving region 20*a* are, on a side facing toward the card element 34*a*, a length of 50 mm to 250 mm, preferably of 100 mm to 200 mm, and a width of 15 mm to 60 mm, preferably of 20 mm to 40 mm. The hood element 36*a* has a conicity 124*a*, 126*a*, 128*a*, 130*a* from a side facing towards the card element 34*a* toward a bottom, the conicity 124*a*, 126*a*, 128*a*, 130*a* being identical on opposite-situated sides, in particular on all four sides. An angle of the conicity 124*a*, 126*a*, 128*a*, 130*a* is 2° to 20°, preferably 2° to 10°. Furthermore, the height of the hood element 36*a* is in a formed state 10 mm to 25 mm, preferably 14 mm to 20 mm. The total height of the packaging base body 18*a* is 8 mm to 35 mm, preferably 12 mm to 25 mm. The front side and the rear side of the packaging base body 18*a* are substantially parallel.

The packaging base body 18*a* comprises the dust tabs 68*a*. The hood element 36*a* comprises the dust tabs 68*a*. The dust tabs 68*a* are provided in order to prevent or reduce entry of dust. The dust tabs 68*a* are fixed, like in particular by sealing, folded and flattened in order to form the hood element 36*a*, they may however also be arranged in a non-fixed manner and just be adjacent. In production the dust tabs 68*a* are in particular sealed with the short side portions of the delimiting surfaces 66*a* of the hood element 36*a*.

The packaging base body 18*a* moreover has a euro hole recess on its upper end. The euro hole recess is introduced in a forward-protruding tab 70*a*. The tab 70*a* has a double cardboard guidance. The tab 70*a* for the euro hole recess is implemented having two layers, wherein one layer of the tab 70*a* is formed by the card element 34*a* and one layer of the tab 70*a* is formed by the hood element 36*a*. The hood element 36*a* and the card element 34*a* are sealed in the region of the tab 70*a*. The tab 70*a* is implemented partly integrally with the hood element 36*a* and partly integrally with the card element 34*a*. A frontward cardboard layer of the card element 34*a* of the tab 70*a* has a smaller euro hole recess 72*a* than the rearward cardboard layer of the hood element 36*a* of the tab 70*a*, such as to visually obtain an overlap from the front and to allow compensation of folding tolerances. In the rear cardboard layer of the hood element 36*a* of the tab 70*a*, a larger euro hole recess 74*a* is provided. The euro hole recesses 72*a*, 74*a* have a difference in size of 0.5 mm. In order to ensure stability, the euro hole recess is closed and is not open sidewards. Principally, if the packaging base body 18*a* is not suspended, the euro hole recess may also be dispensed with, thus saving material and volume.

The packaging base body 18*a* furthermore has, on two opposite-situated edges 38*a*, 38*a*' extending parallel to the main extension direction 40*a* of the brush product packaging device 10*a*, in each case a guiding section 42*a*, 42*a*' with a reduced depth extent. The guiding sections 42*a*, 42*a*' in each case have a reduced depth extent relative to the total depth extent. The packaging base body 18*a* has straight parallel outer edges in the guiding sections 42*a*, 42*a*'. The packaging base body 18*a* is in the guiding sections 42*a*, 42*a*' in each case implemented at least partly with several layers. In the guiding sections 42*a*, 42*a*', the card element 34*a* and the hood element 36*a* are arranged respectively overlapping. The card element 34*a* is in the guiding sections 42*a*, 42*a*' in each case sealed with the hood element 36*a* via the sealing margins 64*a*, wherein the sealing margins 64*a* and the card element 34*a* are sealed planarly in the guiding sections 42*a*, 42*a*'. The guiding sections 42*a*, 42*a*' in each case form a plug-in plane of the brush product packaging device 10*a*. The guiding sections 42*a*, 42*a*' serve for an accommodation of the brush product packaging device 10*a* in a tray packaging 54*a*. For sales purposes, the brush product packaging device 10*a* is inserted into guides of the tray packaging 54*a*. A maximum thickness of the packaging base body 18*a* is in the guiding sections 42*a*, 42*a*' respectively 0.2 mm to 2.5 mm, preferably 0.3 mm to 1 mm.

The brush product packaging device 10*a* further comprises a holding unit 22*a*. The holding unit 22*a* protrudes into the receiving region 20*a* and is configured to hold the brush product 12*a* in a position relative to the receiving region 20*a*. The holding unit 22*a* is configured to hold the brush product 12*a* in its position relative to the receiving region 20*a* by its handle 16*a* and/or by its neck 30*a*, respectively to reduce a movement of the brush product 12*a*. The holding unit 22*a* is configured to reduce a movement tolerance of the brush product 12*a*. The holding unit 22*a* is implemented largely of a paper material.

In one implementation the holding unit 22*a* may be implemented partly integrally with the packaging base body 18*a*. The holding unit 22*a* is, by way of example, implemented partly integrally with the packaging base body 18*a*. The holding unit 22*a* comprises a holding member 24*a*, which is realized by an indentation in the packaging base body 18*a*. The holding member 24*a* is implemented directly in the packaging base body 18*a* and is embodied integrally with the packaging base body 18*a*. The holding member 24*a* is implemented in the hood element 36*a*. The holding member 24*a* is exemplarily shown only in FIG. 4*b* as the indentation is in particular implemented subsequently, after packaging, and is therefore visible only in a fully manufactured state. However, it would principally also be conceivable that the holding member 24*a* is implemented already when folding the hood element 36*a* as shown in FIG. 3*a* or 3*b*. The holding member 24*a* is formed by a waisting in the hood element 36*a* of the packaging base body 18*a*. The brush product 12*a* is pressed into a correct position by means of the holding member 24*a*. The brush product 12*a* is pressed to an inner face of the packaging base body 18*a* by means of the holding member 24*a*. Principally, it would also be conceivable that several, in particular two or three, corresponding holding members 24*a* are provided. The holding member 24*a* is produced by two corresponding creasings in the packaging base body 18*a* (FIG. 4*b*).

In an alternative implementation, the holding unit 22*a* comprises a folding element 26*a*. The folding element 26*a* is made of solid fiberboard. The folding element 26*a* is implemented by a separate component that differs from the packaging base body 18*a*. The folding element 26*a* is produced from a flat blank, in which the folding possibilities are already integrated in the form of creases. The folding element 26*a* is implemented by an insert piece for the packaging base body 18*a*. The folding element 26*a* comprises three regions: a first fastening region 76*a*, in which the folding element 26*a* is connected to the packaging base body 18*a*, a fixation region 78*a*, in which the folding element 26*a* is configured to fix the brush product 12*a*, and a second fastening region 80*a*, in which the folding element 26*a* is connected to the packaging base body 18*a*. The fixation region 78*a* is arranged between the first fastening region 76*a* and the second fastening region 80*a*. The fixation region 78*a* of the folding element 26*a* forms an elevation. The fixation region 78*a* forms a saddle-roof-shaped elevation. Depending on a folding angle of the folding element 26*a*, different heights of the folding element 26*a* can be realized. The position for a fixation of the brush product 12*a* is variable. In particular, the position depends on a geometry of the receiving region 20*a* and on a geometry of the brush product 12*a*. The brush product 12*a* is exemplarily fixed in a neck region 30*a* of the brush product 12*a* (FIGS. 5*a*, 5*b*, 5*c*, 5*d*, 5*e*).

The folding element 26*a* is implemented so as to be glued into the packaging base body 18*a*. The folding element 26*a* is glued planarly with the packaging base body 18*a* in the two fastening regions 76*a*, 80*a*. The folding element 26*a* is glued to a base side of the hood element 36*a* on an inner face of the packaging base body 18*a*. Preferably, in a state when arranged in the packaging base body 18*a*, the folding element 26*a* furthermore has an approximately circular base surface. In a state when arranged in the packaging base body 18*a*, the folding element 26*a* is implemented so as to be mounted and folded. The folding element 26*a*, in particular a blank of the folding element 26*a*, has in a planar state an egg-shaped outer shape, the outer shape being implemented such as to provide a circular base surface in a folded state. A circular base surface has the advantage that the folding element 26*a* can be arranged in a position in any desired orientation. Moreover, in a state when arranged in the packaging base body 18*a*, the at least one folding element 26*a* has a maximum extent of 10 mm to 50 mm. A non-folded blank of the folding element 26*a* has a length of 20 mm to 50 mm, preferably of 30 mm to 40 mm. The non-folded blank of the folding element 26*a* further has a width of 10 mm to 30 mm, preferably of 15 mm to 25 mm. In a folded and mounted state, the folding element 26*a* has a circular base surface, wherein a diameter of the base surface is 10 mm to 30 mm, preferably 15 mm to 25 mm. In a folded and mounted state, a height of the folding element 26*a* is 8 mm to 16 mm, preferably 9 mm to 13 mm.

The folding element 26*a* forms a groove 28*a* for receiving a neck 30*a* of the brush product 12*a*. The folding element 26*a* forms a groove-shaped recess. The groove 28*a* is implemented in two surfaces of the folding element 26*a*. The groove 28*a* is implemented in two surfaces of the fixation region 78*a* of the folding element 26*a*. For a realization of the groove 28*a*, two surfaces of the folding element 26*a* respectively have a recess, the recesses being connected to each other on at least one side. The recesses are herein approximately rectangular. The recesses taper conically from a free end, which results in improved clamping. The recesses are trapezoid-shaped. The resulting groove 28*a* has in its lower region a width of 3 mm to 10 mm, preferably of 3 mm to 6 mm. At a free open end, the groove 28*a* further has a width of 4 mm to 15 mm, preferably of 5 mm to 10 mm. The depth of the groove 28*a*, measured on the surface of the folding element 26*a*, is in particular 3 mm to 12 mm, preferably 5 mm to 10 mm.

The folding element 26*a* further comprises an optional fixation section 32*a*, which is configured to tension the neck 30*a* of the brush product 12*a* against the packaging base body 18*a*. The fixation section 32*a* is implemented by a side contour of the fixation region 78*a* of the folding element 26*a*. Together with a side wall of the hood element 36*a*, the fixation section 32*a* forms a narrowing in the receiving region 20*a*, in which the brush product 12*a* can be fixed. The fixation section 32*a* in particular serves for an alternative fixation of the brush product 12*a*, for example if the neck 30*a* of the brush product 12*a* is positioned unfavorably or the groove 28*a* is too narrow for a respective neck 30*a*. The folding element 26*a* may therefore in particular be used for different brush products 12*a* (FIGS. 5*a*, 5*b*, 5*c*, 5*d*, 5*e*).

In the production of the brush product packaging device 10*a*, in a first method step a blank of the card element 34*a* and of the hood element 36*a* is produced. Then the hood element 36*a* is formed. Herein a tub is formed from the flat blank of the hood element 36*a*. Herein the formed tub may optionally be glued and/or sealed. Furthermore, the folding element 26*a* of the holding unit 22*a* is introduced in the hood element 36*a*. After this the formed tub is filled with the brush product 12*a*, which is fixed in or with the folding element 26*a*. After this, the card element 34*a* is laid upon the filled tub of the hood element 36*a*. The card element 34*a* is then laid upon the filled tub of the hood element 36*a*. The card element 34*a* is sealed with the sealing margins 64*a* of the hood element 36*a* via hot sealing.

In FIGS. 12*a* to 12*e*, a tray packaging 54*a* is illustrated. The tray packaging 54*a* is configured for an accommodation of at least two, in particular a plurality of, brush product packaging devices 10*a*. The tray packaging 54*a* is exemplarily configured to receive the brush product packaging device 10*a*, wherein other brush product packaging devices may also be received by the tray packaging 54*a*. The tray packaging 54*a* is realized by a secondary packaging that is configured for transport as well as for a presentation of a plurality of brush product packaging devices 10*a*.

The tray packaging 54*a* comprises a secondary packaging base body 56*a* and a packaging insert 58*a*, which is arranged in the secondary packaging base body 56*a* for a positioning of the brush product packaging devices 10*a*. The secondary packaging base body 56*a* comprises a shoe element 60*a* for receiving the packaging insert 58*a* and a hood element 62*a* for a closure of the shoe element 60*a*. The shoe element 60*a* is implemented by a rectangular cuboid that is open on one side. The shoe element 60*a* is implemented as an open box. The shoe element 60*a* is implemented of a paper material. The shoe element 60*a* is implemented of corrugated fiberboard. The front wall of the shoe element 60*a* has been partly removed in order to achieve better product presentation. Furthermore, the lefthand, righthand and rear walls of the shoe element 60*a* are realized in an elevated fashion. Here the rear wall is high while a height of the side walls of the shoe element 60*a* increases rearwards. The walls have a height progression. The hood element 62*a* is in particular realized by a folded hood. The hood element 62*a* is realized by a rectangular cuboid that is open on one side. The hood element 62*a* is realized as an open box. The hood element 62*a* is implemented of a paper material. The hood element 62*a* is implemented of corrugated fiberboard. In production and filling, the hood element 62*a* and the shoe element 60*a* are embodied in a one-part implementation. The hood element 62*a* and the shoe element 60*a* are implemented as a cardboard box which is filled and/or is inserted into a filled packaging insert 58*a*. The hood element 62*a* and the shoe element 60*a* may in particular be separated subsequently by a perforation 82*a* (FIGS. 12*c*, 12*d*, 12*e*).

Furthermore, the packaging insert 58*a* is implemented largely of a paper material. The packaging insert 58*a* is made of corrugated fiberboard. The packaging insert 58*a* is made of a one-sided corrugated fiberboard, i. e. a corrugated fiberboard consisting of a linerboard and a corrugated fluted layer. The flutes of a fluted layer of the corrugated fiberboard of the packaging insert 58*a* are configured to respectively form a guiding groove for the guiding sections 42*a*, 42*a*' of the brush product packaging devices 10*a*. Each flute valley of the fluted layer of the packaging insert 58*a* forms a guiding groove. The packaging insert 58*a* is hence arranged in such a way that the fluted layer faces toward the brush product packaging devices 10*a*. Moreover, in a packaged state, the flute crests of the fluted layer of the corrugated fiberboard of the packaging insert 58*a* extend parallel to a main extension plane of the brush product packaging devices 10*a*. The flute distance of the packaging insert 58*a*, i. e. the distance from flute valley to flute valley or from flute crest to flute crest, is 5 mm to 14 mm, preferably 7.5 mm to 11 mm. The flute distance of the packaging insert 58*a* is precisely 9.13 mm. The height of an individual flute of the packaging insert 58*a* is 2 mm to 10 mm, preferably 3.5 mm to 8 mm, wherein in particular always the same height is provided per packaging, and in particular also in all tray packagings 54*a* (FIGS. 12*a*, 12*b*).

The packaging insert 58*a* serves for a uniform accommodation and presentation of the brush product packaging devices 10*a*. For this purpose, the brush product packaging devices 10*a* are inserted in the packaging insert 58*a*. The packaging insert 58*a* serves for a defined accommodation and guidance of the brush product packaging devices 10*a* in the tray packaging 54*a*. The packaging insert 58*a* is implemented such that it is folded in a U-shape. In a folded state, the packaging insert 58*a* is U-profile-shaped. The packaging insert 58*a* further comprises a planar base side 84*a* as well as two side portions 86*a*, 86*a*' which are arranged on opposite sides of the base side 84*a*, extending perpendicularly to the base side 84*a*. The side portions 86*a*, 86*a*' and the base side 84*a* are folded in one piece, in particular from one cardboard sheet. The side portions 86*a*, 86*a*' are configured for receiving and guiding the guiding sections 42*a*, 42*a*' of the brush product packaging devices 10*a*. Respectively one guiding section 42*a*, 42*a*' of a brush product packaging device 10*a* is guided in a respective side portion 86*a*, 86*a*' (FIGS. 12*c*, 12*d*).

The packaging insert 58*a* is in a laid-in state held in the U-shape by the secondary packaging base body 56*a*. The packaging insert 58*a* is implemented so as to be merely laid into the shoe element 60*a*. However, here a number of packaging inserts 58*a* in a secondary packaging base body 56*a* may in particular vary (FIG. 12*c*).

In a production of the tray packaging 54*a*, the packaging insert 58*a* is produced in a first step. For this purpose, corrugated fiberboard is rolled off and then longitudinal creasings are introduced into the corrugated fiberboard. Later on, the creasings will in particular form the edges of the packaging insert 58*a*. After that, the corrugated fiberboard is cut to an appropriate length. The corrugated fiberboard in particular already gets delivered on rolls having the correct width. The corrugated fiberboard is then die-formed and held, as a result of which the packaging insert 58*a* is formed. After that the packaging insert 58*a* is put into a shuttle, in which the packaging insert 58*a* is held in shape and is filled manually or by a robot. In a second step, the secondary packaging base body 56*a* is formed. Then the filled packaging insert 58*a* is laid into the shoe element 60*a* of the secondary packaging base body 56*a*. The packaging insert 58*a* is held in shape by the shoe element 60*a*, with the packaging insert 58*a* directly adjoining the shoe element 60*a*. The packaging insert 58*a* is in particular held and clamped just by a friction connection. However, fastening means for a securing of the packaging insert 58*a* are also conceivable. After this, the secondary packaging base body 56*a* is closed. There are in particular different variants of the secondary packaging base body 56*a*. In particular in case of a separate implementation of the shoe element 60*a* and the hood element 62*a*, the packaging insert 58*a* is laid into the shoe element 60*a* without the hood element 62*a*. In particular, it is herein also possible that the packaging insert 58*a* is loaded when in the shoe element 60*a*. The hood element 62*a* is formed afterwards and is then put upon the filled shoe element 60*a*. After that, the hood element 62*a* is connected to the shoe element 60*a*, in particular by gluing.

In FIGS. 6 to 11 and 13 to 19, two further exemplary embodiments of the invention are shown. The following descriptions are limited substantially to the differences between the exemplary embodiments, wherein regarding components, features and functions that remain the same, the description of the other exemplary embodiments, in particular of FIGS. 1 to 5 and 12, may be referred to. In order to distinguish between the exemplary embodiments, the letter a, which has been added to the reference numerals of the exemplary embodiment of FIGS. 1 to 5 and 12, has been replaced by the letters b and c in the reference numerals of the exemplary embodiments of FIGS. 6 to 11 and 13 to 19. Regarding components having the same denomination, in particular regarding components having the same reference numerals, principally the drawings and/or the description of the other exemplary embodiments, in particular of FIGS. 1 to 5 and 12, may be referred to.

FIGS. 6 to 9 show an alternative brush product packaging device 10*b* for receiving a brush product. The brush product packaging device 10*b* comprises a packaging base body 18*b*. The packaging base body 18*b* is configured to form the substantially closed receiving region 20*b* for the brush product. The packaging base body 18*b* is realized from a blank. The brush product packaging device 10*b* is implemented by the packaging base body 18*b*. The packaging base body 18*b* is implemented by a folded and glued box. The packaging base body 18*b* comprises a handle region 44*b* accommodating the handle of the brush product and a head region 46*b* accommodating the application head of the brush product (FIG. 6).

The packaging base body 18*b* further comprises, on two opposite-situated edges 38*b*, 38*b*' which run parallel to a main extension direction 40*b* of the brush product packaging device 10*b*, respectively one guiding section 42*b*, 42*b*' having a reduced depth extent. The guiding sections 42*b*, 42*b*' in each case have a reduced depth extent relative to a total depth extent. The packaging base body 18*b* has straight parallel outer edges in the guiding sections 42*b*, 42*b*'. The packaging base body 18*b* is in the guiding sections 42*b*, 42*b*' respectively implemented partly in a multi-layered fashion. For this, the packaging base body 18*b* is in the guiding sections 42*b*, 42*b*' respectively folded in a comb-like fashion. The guiding sections 42*b*, 42*b*' are arranged exclusively in a handle region 44*b* of the packaging base body 18*b*.

The receiving region 20*b* of the brush product packaging device 10*b* has in the handle region 44*b*, perpendicularly to the main extension direction 40*b*, a cross section which essentially differs from a cross section of the receiving region 20*b* in the head region 46*b*. The receiving region 20*b* has in the handle region 44*b*, perpendicularly to the main extension direction 40*b*, a lentiform cross section. The receiving region 20*b* furthermore has in the head region 46*b* a rectangular cross section perpendicularly to the main extension direction 40*b*. Along the main extension direction 40*b*, a cross section of the receiving region 20*b* perpendicularly to the main extension direction 40*b* transitions, in particular continuously, from the head region 46*b* to the handle region 44*b* from a rectangular cross section into a lentiform cross section. For this the packaging base body 18*b* has at least two converging edges 48*b*, 48*b*', 48*b*", 48*b*" extending in each case substantially parallel to a main extension direction 40*b*. The packaging base body 18*b* has on opposite-situated sides respectively two converging edges 48*b*, 48*b*', 48*b*", 48*b*", which in each case extend substantially parallel to a main extension direction 40*b*. The converging edges 48*b*, 48*b*', 48*b*", 48*b*" in each case extend over a substantial portion of a main extension of the packaging base body 18*b*, wherein the converging edges 48*b*, 48*b*', 48*b*", 48*b*" peter out in the handle region 44*b*. In the head region 46*b*, the four converging edges 48*b*, 48*b*', 48*b*", 48*b*" form respectively one of the four side edges of the rectangular cross section of the packaging base body 18*b*. The edges 48*b*, 48*b*', 48*b*", 48*b*" of the packaging base body 18*b* respectively converge toward the guiding section 42*b*, 42*b*'. For this purpose, the edges 48*b*, 48*b*', 48*b*", 48*b*'" are waisted to the front side and the rear side. Between respectively two converging edges 48*b*, 48*b*', 48*b*", 48*b*" in each case a further folding edge is arranged, the further folding edges extending in each case substantially parallel to a main extension direction 40*b*. The further folding edges respectively form the edges 38*b*, 38' of the guiding sections 42*b*, 42*b*'.

From the front side to the rear side, the packaging base body 18*b* has a decreasing top-to-bottom height profile, wherein there is a wedge shape and additionally a curvature. The packaging base body 18*b* is on its front side and rear side respectively straight at the top and curved at the bottom. An underside of the packaging base body 18*b* has a curvature towards the top. The underside of the packaging base body 18*b* is furthermore slitted from the front side to the rear side, wherein one side is folded upwards and the other side is folded downwards. A slitting 88*b* provides stability. Furthermore, uprighting is simplified by the slitting 88*b*. Furthermore, a left-to-right creasing and a front-to-rear creasing are provided on the underside. The upper side of the packaging base body 18*b* has a straight, planar area, which forms a closure of the rectangular cross section. The packaging base body 18*b* further has a euro hole recess at its upper end. The euro hole recess is implemented in a tab 70*b* protruding toward the top (FIGS. 7*a*, 7*b*, 7*c*, 7*d*, 7*e*, 7*f*).

It would also be conceivable that the packaging base body 18*b* comprises several auxiliary creasings 89*b*, which support a formation of the curvature. The auxiliary creasings 89*b* are implemented on the front side and on the rear side. The auxiliary creasings 89*b* preferably do not extend over the entire length of the packaging base body 18*b*. The auxiliary creasings 89*b* extend from an underside of the packaging base body 18*b* across a portion of the handle region 44*b* of the packaging base body 18*b*. The auxiliary creasings 89*b* extend at least substantially parallel to the main extension direction 40*b* of the brush product packaging device 10*b*. The auxiliary creasings 89*b* support the formation of a curvature optimally when they form a portion of the surface in the curved portion. The auxiliary creasings 89*b* are implemented partly in a straight manner and partly in a bent manner. However, it would also be conceivable that all the auxiliary creasings 89*b* are bent or are formed in a combination of straight and bent. The auxiliary creasings 89*b* are preferably implemented on the respective surface symmetrically to the central longitudinal axis of the respective surface.

The packaging base body 18*b* moreover comprises a circumferential perforated strip 50*b*, extending transversely to the main extension direction 40*b*, for an opening of the packaging base body 18*b*. The perforated strip 50*b* is embodied as a rip-up perforation. The perforated strip 50*b* is implemented by two perforations extending parallel to each other. The perforated strip 50*b* extends circumferentially around a longitudinal axis of the packaging base body 18*b*. The perforated strip 50*b* is furthermore arranged in the handle region 44*b* of the packaging base body 18*b*. The perforated strip 50*b* moreover comprises in one position a rip-open tab 90*b* providing a possibility of starting the rip-up.

Beyond this the brush product packaging device 10*b* comprises a holding unit 22*b*. The holding unit 22*b* protrudes into the receiving region 20*b* and is configured to hold the brush product 12*b* in a position relative to the receiving region 20*b*. The holding unit 22*b* is configured to hold the brush product 12*b* in a position relative to the receiving region 20*b* by its handle 16*b*, respectively to reduce a movement of the brush product 12*b*. The holding unit 22*b* is implemented integrally with the packaging base body 18*b*. The holding unit 22*b* comprises a holding member 24*b*, which is implemented by the lentiform tapering in the packaging base body 18*b*. The holding member 24*b* is introduced directly in the packaging base body 18*b* and is implemented integrally with the packaging base body 18*b*. The holding member 24*b* is realized by a shaping of the packaging base body 18*b*. The lentiform implementation allows a fixation of a handle of the brush product in the handle region 44*b*. The brush product is clamped in the handle region 44*b* without any insert. In the lentiform cross section, the packaging base body 18*b* forms part of the holding unit 22*b*.

The holding unit 22*b* further comprises two further holding members 25*b*, 25*b*"""" auf, which are formed from existing parts of the brush product packaging device 10*b*. The further holding members 25*b*, 25*b*"""" are herein exemplarily formed of dust tabs 68*b* of the packaging base body 18*b*. The dust tabs 68*b* are herein used for supporting the brush product 12*b* in the brush product packaging device 10*b*. The dust tabs 68*b* may therefore be used in a manner diverted from their original function. This means that the dust tabs 68*b* are no longer used as dust tabs 68*b* but are folded into the receiving region 20*b* of the packaging base body 18*b* and are thus used as holding members 25*b*, 25*b*"""". The holding members 25*b*, 25*b*"""" fixate the brush product 12*b* by its neck. By way of example, the dust tabs 68*b* have an implementation as holding members 25*b*, 25*b*"""" of the holding unit 22*b* and are configured to partly hold the brush product 12*b* by its neck in a position relative to the receiving region 20*b* (FIGS. 8*a*, 8*b*).

In a flat unformed state, the brush product packaging device 10*b* has a length of 120 mm to 300 mm, preferably of 60 mm to 280 mm. The brush product packaging device 10*b* further has, in the flat unformed state, a width of 120 mm to 200 mm, preferably of 150 mm to 180 mm. In a formed state, the brush product packaging device 10*b* has a length with the tab of 100 mm to 260 mm, preferably of 140 mm to 240 mm. Furthermore, the brush product packaging device 10*b* has in its formed state a width of 25 mm to 90 mm, preferably of 35 mm to 75 mm, wherein a width of the brush product packaging device 10*b* in a handle region 44*b* is adapted to an interface of a tray packaging. A height of the brush product packaging device 10*b* is in a formed state 8 mm to 35 mm, preferably 12 mm to 25 mm.

In a production and filling of the brush product packaging device 10*b*, a ready-glued sleeve is bought in addition, which must merely be uprighted, filled and closed. A handling of the brush product packaging device 10*b* may herein be done both manually and automatedly. The ready-glued sleeve of the brush product packaging device 10*b* already has creasings in its side surface as well as the gluing, wherein the blanks may in particular be delivered in a flat state. In the flat state, the creases in the side surfaces of the packaging base body 18*b* form the edge 38*b*, 38*b*' on the lefthand and righthand sides. Herein the sleeve is uprighted in a first method step. Then the sleeve is filled and closed. A closure is realized by gluing the tabs at the top or by insertion.

FIGS. 10, 11*a* and 11*b* show an alternative brush product packaging device 10*c* for receiving a brush product. The brush product packaging device 10*c* comprises a packaging base body 18*c*. The packaging base body 18*c* is configured to form the substantially closed receiving region for the brush product. The packaging base body 18*c* is formed from a blank. The brush product packaging device 10*c* consists of the packaging base body 18*c*. The packaging base body 18*c* is implemented by a folded and glued box. The brush product packaging device 10*c* is implemented by a rectangular-cuboid-shaped cardboard box having a tab 70*c* with a euro hole recess. The brush product packaging device 10*c* has straight side surfaces at right angles, wherein the tab 70*c* with the euro hole recess is provided in an upper region. A width, a height and a length are therefore constant. The brush product packaging device 10*c* with the tab 70*c* has a length of 100 mm to 260 mm, preferably of 140 mm to 240 mm. Without the tab 70*c* the length is 75 mm to 235 mm, preferably 115 mm to 215 mm. A width of the brush product packaging device 10*c* is 25 mm to 90 mm, preferably 35 mm to 75 mm. An overall height of the brush product packaging device 10*c* is in particular 8 mm to 35 mm, preferably 12 mm to 25 mm.

The brush product packaging device 10*c* comprises a reclosure unit 52*c*, which is configured for a reclosure of the packaging base body 18*c*. The reclosure unit 52*c* is implemented integrally with the packaging base body 18*c*. The reclosure unit 52*c* comprises a reclosure tab 92*c*, which is insertable in a tab receptacle 94*c*. The reclosure tab 92*c* is configured to latch with the tab receptacle 94*c*. The tab receptacle 94*c* is arranged at a folding tab of the packaging base body 18*c*.

In a production and filling of the brush product packaging device 10*c*, a ready-glued sleeve is bought in addition, which can be filled manually or automatedly. The folding tabs at the top and bottom of the brush product packaging device 10*c* may herein in particular be inserted as well as glued. Herein the sleeve is uprighted in a first method step and the lower end is closed. Then the sleeve is filled and is closed at the top. Closure is realized manually by latching, respectively inserting or gluing the folding tab. Depending on a process, the orientation of the brush product packaging device 10*c* and the closing sequence may vary.

The filling of the brush product packaging device 10*c* is done along the main extension direction 40*c* from the bottom or from the top.

In FIGS. 13 and 14 a tray packaging 54*c* is illustrated. The tray packaging 54*c* is configured to accommodate at least two, in particular a plurality of, brush product packaging devices 10*c*. The tray packaging 54*c* is exemplarily configured for an accommodation of the brush product packaging device 10*c*, wherein different brush product packaging devices may also be accommodated in the tray packaging 54*c*. The tray packaging 54*c* is implemented of a secondary packaging, which is configured for a transport and for a presentation of a plurality of brush product packaging devices 10*c*.

The tray packaging 54*c* comprises a secondary packaging base body 56*c*, in particular a shoe element 60*c* and a packaging insert 58*c* arranged in the secondary packaging base body 56*c*, for a positioning of the brush product packaging devices 10*c*. The packaging insert 58*c* is herein embodied as a grid. Herein the brush product packaging devices 10*c* may, for example, be inserted individually into the packaging insert 58*c* that is implemented as a grid. The packaging insert 58*c* comprises a plurality of longitudinal walls 96*c* and transversal walls 98*c* respectively forming a grid pattern. The secondary packaging base body 56*c* forms an outer cardboard box. The grid pattern of the packaging insert 58*c* may herein be adapted to a size, in particular a width and a height, of the brush product packaging devices 10*c* which are to be accommodated. The grid openings correspond in size to a cross section shape of the brush product packaging devices 10*c*. The tray packaging 54*c* is configured for an accommodation of 10 items to 100 items, preferably 15 items to 50 items, of the brush product packaging devices 10*c*. The tray packaging 54*c* is configured to accommodate along its length 5 items to 12 items of the brush product packaging devices 10*c*. Furthermore, the tray packaging 54*c* is in particular configured to accommodate along its width 2 items to 10 items of the brush product packaging devices 10*c*. The width of the recess of the grid of the packaging insert 58*c* is 15 mm to 75 mm, preferably 20 mm to 50 mm, the empty space corresponding to the width of a brush product packaging device 10*c* plus a tolerance. The length of the recess of the grid of the packaging insert 58*c* is 12 mm to 40 mm, preferably 15 mm to 30 mm. The grids of the packaging insert 58*c* in particular extend approximately over the entire inner dimensions of the tray packaging 54*c*, such that it is clamped or at least cannot slip at the front and rear as well as on the lefthand and righthand sides. The tray packaging 54*c* moreover exemplarily comprises a leaflet receptacle 100*c* that is accommodated in the secondary packaging base body 56*c*. The leaflet receptacle 100*c* is inserted in the secondary packaging base body 56*c* next to the packaging insert 58*c*. The leaflet receptacle 100*c* exemplarily serves for an accommodation of leaflets.

FIGS. 15*a* to 15*d* show a brush product packaging device 10*d* for an accommodation of a brush product 12*d* in a holding unit 22*d*. The brush product 12*d* comprises an application head 14*d* and a neck 30*d* and is implemented as a plug-on brush for an electrical toothbrush. The brush product packaging device 10*d* is exemplarily configured to receive at least one brush product 12*d* that is implemented as a plug-on brush. The brush product packaging device 10*d* is exemplarily configured to receive three brush products 12*d*, which are in each case realized as a plug-on brush. The brush product packaging device 10*d* forms a primary packaging for the brush product 12*d*. The brush product packaging device 10*d* is embodied as a sales packaging. The brush product packaging device 10*d* comprises a receiving region 20*d* for an accommodation of the brush product 12*d* in the holding unit 22*d*. The receiving region 20*d* is approximately rectangular-cuboid-shaped. The receiving region 20*d* is implemented substantially closed. The receiving region 20*d* is in particular implemented so as to be not completely tight.

The brush product packaging device 10*d* and the brush product 12*d* accommodated in the brush product packaging device 10*d* form a system, in particular a sales system.

The brush product packaging device 10*d* comprises a packaging base body 18*d*. The packaging base body 18*d* forms a base body of the brush product packaging device 10*d*. The packaging base body 18*d* is configured to form the substantially closed receiving region 20*d* for the brush product 12*d*. The packaging base body 18*d* delimits the receiving region 20*d* materially. The packaging base body 18*d* is furthermore implemented largely of a paper material. The packaging base body 18*d* is made of solid fiberboard.

The packaging base body 18*d* comprises a planar card element 34*d* and a folded hood element 36*d* that is superimposed on the card element 34*d*. The card element 34*d* and the hood element 36*d* are largely made of a paper material. The card element 34*d* and the hood element 36*d* are made of solid fiberboard. The card element 34*d* and the hood element 36*d* have the same material thickness. In a mounted state, the hood element 36*d* is firmly connected to the card element 34*d*. Furthermore, an extension of the hood element 36*d* along a main extension direction 40*d* of the brush product packaging device 10*d* substantially corresponds to an extension of the card element 34*d* along the main extension direction 40*d* of the brush product packaging device 10*d*. The card element 34*d* is arranged on a front side of the brush product packaging device 10*d*. The card element 34*d* is implemented substantially rectangular. The hood element 36*d* is arranged on a rear side of the brush product packaging device 10*d*. The hood element 36*d* has delimiting surfaces 66*d* which delimit the receiving region 20*d*, and sealing margins 64*d* which are connected to the delimiting surfaces 66*d* and are configured for a connection to the card element 34*d*. The sealing margins 64*d* are connected to the delimiting surfaces 66*d* of the hood element 36*d* via perforations and creasings. The hood element 36*d* is produced from a blank (FIG. 15*b*). The blank of the hood element 36*d* comprises several delimiting surfaces 66*d*, comprising a rectangular base side and four trapezoid-shaped side portions. On the side portions respectively one sealing margin 64*d* is arranged, wherein in a region of the tab 70*d*, the sealing margin 64*d* comprises the entire tab 70*d*. Furthermore, on the two long trapezoid-shaped side portions in each case on both free edges, respectively one dust tab 68*d* is arranged. The hood element 36*d* has a conicity from a side facing toward the card element 34*d* to a bottom, said conicity being identical on opposite sides, in particular on all four sides. The front side and the rear side of the packaging base body 18*d* are substantially parallel.

The packaging base body 18*d* comprises the dust tabs 68*d*. The hood element 36*d* comprises the dust tabs 68*d*. The dust tabs 68*d* are configured to prevent or reduce an entry of dust. The dust tabs 68*d* are fixated, like in particular by sealing, folded and flattened in order to form the hood element 36*d*; they may however also be arranged in a non-fixed or unfixed manner and be merely adjacent. During production the dust tabs 68*d* are in particular sealed with the short side portions of the delimiting surfaces 66*d* of the hood element 36*d*.

The packaging base body 18*d* further comprises a euro hole recess at its upper end. The euro hole recess is implemented in an upwards-protruding tab 70*d*. The tab 70*d* has a double cardboard guidance. The tab 70*d* for the euro hole recess is implemented in two layers, wherein one layer of the tab 70*d* is formed by the card element 34*d* and one layer of the tab 70*d* is formed by the hood element 36*d*. The hood element 36*d* and the card element 34*d* are sealed in the region of the tab 70*d*. The tab 70*d* is implemented partly integrally with the hood element 36*d* and partly integrally with the card element 34*d*. A front cardboard layer of the card element 34*d* of the tab 70*d* has a smaller euro hole recess 72*d* than the rear cardboard layer of the hood element 36*d* of the tab 70*d*, in order to visually obtain an overlap at the front and to enable compensation of folding tolerances. In the rear cardboard layer of the hood element 36*d* of the tab 70*d*, a larger euro hole recess 74*d* is provided. In order to ensure stability, the euro hole recess 74*d* is closed and is not open sidewards. Principally the euro hole recess 74*d* may also be dispensed with if the packaging base body 18*d* is not to be suspended, thus saving material and volume. In the case shown the card element 34*d* has a viewing window 106*d*.

The packaging base body 18*d* further comprises, on two opposite-situated edges 38*d*, 38*d*' extending parallel to the main extension direction 40*d* of the brush product packaging device 10*d*, respectively one guiding section 42*d*, 42*d*' having a reduced depth extent. The guiding sections 42*d*, 42*d*' in each case have a reduced depth extent relative to the total depth extent. In the guiding sections 42*d*, 42*d*', the packaging base body 18*d* has straight parallel outer edges. The packaging base body 18*d* is in the guiding sections 42*d*, 42*d*' in each case implemented at least partly in a multi-layered fashion. In the guiding sections 42*d*, 42*d*', the card element 34*d* and the hood element 36*d* are respectively arranged with overlap. The card element 34*d* is in the guiding sections 42*d*, 42*d*' respectively sealed with the hood element 36*d* via the sealing margins 64*d*, the sealing margins 64*d* and the card element 34*d* being sealed planarly in the guiding sections 42*d*, 42*d*'. The guiding sections 42*d*, 42*d*' in each case form an insertion plane of the brush product packaging device 10*d*. The guiding sections 42*d*, 42*d*' serve for an accommodation of the brush product packaging device 10*d* in a tray packaging 54*d*. The brush product packaging device 10*d* is inserted in guides of the tray packaging for sales purposes.

The brush product packaging device 10*d* moreover comprises the holding unit 22*d*. The holding unit 22*d* is arranged in the receiving region 20*d* and is configured to hold the brush product 12*d* or the brush product packaging device 10*d* in a position relative to the receiving region 20*d*. The holding unit 22*d* is configured to hold the brush product 12*d* relative to the receiving region, respectively to reduce a movement of the brush product 12*d*. The holding unit 22*d* is configured to reduce a movement tolerance of the brush product 12*d*. The holding unit 12*d* is implemented largely of a paper material.

In an exemplary implementation, the holding unit 22*d* further comprises a folding element 26*d*. The folding element 26*d* is made of solid fiberboard. The folding element 26*d* is implemented by a separate component that differs from the packaging base body 18*d*. The folding element 26*d* is produced from a flat blank, in which the folding options are already integrated as creases, for a folding of sidewise tabs 102*d*. The folding element 26*d* is implemented by an insert piece for the packaging base body 18*d*. The folding element 26*d* comprises two regions, a fastening region 104*d* interacting with the packaging base body 18*d* surrounding the blank, and a fixation region 78*d*. The fastening region 104*d* ensures the precise positioning and at least a first part of the stable fixation in the receiving region 20*d*. The fixation is ensured via the tabs 102*d*. The tabs 102*d* may be implemented from the base plane frontwards and rearwards, for example also combined to form tabs 102*d* extending across the creasing of the folding. In this way a fixation of the holding unit 22*d* is achievable in the height direction.

The fixation region 78*d* of the folding element 26*d* is configured to fix the brush product 12*d*. The fixation region 78*d* is arranged in the interior of the fastening region 104*d*. The fixation region 78*d* of the folding element 26*d* forms at least one recess. The fixation region 78*d* of the folding element 26*d* forms several recesses. The recesses are adapted to the brush product 12*d*, allowing optimum laying-in or insertion of the brush product 12*d*. A plug-on brush is preferably fixated in its neck region and/or interface region (FIGS. 15*a*, 15*b*, 15*c*, 15*d*).

The folding element 26*d* is implemented so as to be laid into the packaging base body 18*d*. The folding element 26*d*, in particular a blank of the folding element 26*d*, has in a planar state a rectangular base area with tabs 102*d* that are attached thereto and are connected thereto via creases or something like that, as a shape. A non-folded blank of the folding element 26*d* has a length of 170 mm to 250 mm, preferably of 190 mm to 220 mm. The non-folded blank of the folding element 26*d* further has a width of 40 mm to 80 mm, preferably of 55 mm to 70 mm. In a folded and mounted state, a height of the folding element 26*d* corresponds to the height of the receiving region.

In the production of the brush product packaging device 10*d*, a blank of the card element 34*d* and of the hood element 36*d* is produced in a first method step. Then the hood element 36*d* is formed. Herein a tub is formed from the flat blank of the hood element 36*d*. Optionally, the formed tub may be glued and/or sealed. Furthermore, the folding element 26*d* of the holding unit 22*d* is introduced into the hood element 36*d*. The folding element 26*d* may be already loaded with the brush product 12*d* and may be thus introduced, or the folding element 26*d* is introduced into the formed tub and is then filled with the brush product 12*d*. After this, the card element 34*d* is laid upon the filled tub of the hood element 36*d*. The card element 34*d* is sealed with the sealing margins 64*d* of the hood element 36*d* by hot sealing.

FIGS. 16*a* and 16*b* show blanks of an alternative brush product packaging device 10*e* for receiving a brush product 12*e* as well as a plug-on brush, respectively an exchangeable head. The brush product packaging device 10*e* is embodied in a two-part implementation of a packaging base body 18*e* and a holding unit 22*e*. While the packaging base body 18*e* forms the outer sleeve, the holding unit 22*e* is implemented as a slide-in element. The packaging base body 18*e* is configured to form the substantially closed receiving region for the brush product. The packaging base body 18*e* is formed from a blank. The packaging base body 18*e* is implemented by a folded and glued box. The brush product packaging device 10*e* is implemented of a rectangular-cuboid-shaped cardboard box comprising a tab 70*e* with a euro hole recess 72*e*. The brush product packaging device 10*e* has straight side surfaces at right angles, wherein the tab 70*e* with the euro hole recess 72*e* is provided in an upper region. A width, a height and a length are therefore constant. The brush product packaging device 10*e* with the tab 70*e* has a length of 100 mm to 260 mm, preferably of 140 mm to 240 mm. Without the tab 70*e*, the length is 75 mm to 235 mm, preferably 115 mm to 215 mm. A width of the brush product packaging device 10*e* is 25 mm to 90 mm, preferably 35 mm to 75 mm. An overall height of the brush product packaging device 10*e* is in particular 8 mm to 35 mm, preferably 12 mm to 25 mm.

In the case shown the packaging base body 18*e* comprises a viewing window 106*e*. The construction of the packaging base body 18*e* is adapted to the shaping of the holding unit 22*e*, such that the brush product 12*e* is optimally presented in the viewing window 106*e*.

The holding unit 22*e* is implemented separately and creates an inner geometry that is slid into the packaging base body 18*e*. The holding unit 22*e* may comprise elements for holding a brush product 12*e*, which is for example presented in a viewing window of the packaging base body 18*e*. The holding unit 22*e* may moreover comprise elements for holding accessory parts or replacement parts, like plug-on brushes. The holding unit 22*e* is already loaded with the products before it is slid into the packaging base body 18*e*.

In FIG. 16*c* the two blanks shown in FIGS. 16*a* and 16*c* are illustrated in a prepared, uprighted and loaded state. The holding unit 22*e* is here already loaded with the brush product 12*e* and with a plug-on brush/an exchangeable head 118*e*. It can be perceived that the exchangeable head 118*e* has been laid into a formed recess 108*e*. The brush product 12*e* has been got ready and has also been introduced into two recesses. In the present case, with the holding unit 22*e* introduced in the packaging base body 18*e*, the brush product 12*e* partly adjoins the holding unit 22*e* and partly adjoins the packaging base body 18*e*. For holding the brush product 12*e*, the holding unit 22*e* has formed a tab 110*e*, which must be folded several times, on the side of the brush head in the prolongation of the longitudinal axis of the brush product 12*e*. This tab 110*e* forms a stopper preventing the brush product 12*e* from slipping back and forth in a direction of the longitudinal axis. In the finished state, the tab 110*e* adjoins, on the other hand, the holding unit 22*e* and, on the other hand, the packaging base body 18*e*.

In the production and filling of the brush product packaging device 10*e*, a ready-glued sleeve is bought in addition, which can be filled manually or automatedly. The folding tabs at the top and bottom of the brush product packaging device 10*e* may in particular be inserted as well as glued. Here, in a first method step the sleeve is uprighted and the bottom end is closed. Then the sleeve is filled with the holding unit 22*e* and is closed at the top. A closure is realized manually by latching in, respectively insertion or gluing of the folding tab. Depending on a process, the orientation of the brush product packaging device 10*e* and the closing sequence may vary.

FIG. 17 shows a blank of an alternative brush product packaging device 10*f* for receiving a brush product 12*f*. The brush product packaging device 10*f* is implemented in a one-part implementation; the blank forms both a packaging base body 18*f* and a holding unit 22*f*. The packaging base body 18*f* and the holding unit 22*f* are embodied in a one-part implementation.

The holding unit 22*f* is realized by a righthand part of the blank. For this purpose, the blank is folded and a sidewise tab is glued on the rear side. The lefthand part of the blank is then laid over the already-glued geometry. In this way a receiving region for a brush product 12*f* is created, which is situated directly in the region of the viewing window of the packaging base body 18*f*. Next to this, an empty space is formed which may remain empty or may serve as a receptacle for further products/parts.

The brush product packaging device 10*f* with a tab 70*f* has a length of 100 mm to 260 mm, preferably of 140 mm to 240 mm. Without the tab 70*f*, the length is 75 mm to 235 mm, preferably 115 mm to 215 mm. A width of the brush product packaging device 10*f* is 25 mm to 90 mm, preferably 35 mm to 75 mm. An overall height of the brush product packaging device 10*f* is in particular 8 mm to 35 mm, preferably 12 mm to 25 mm.

In the case shown, the packaging base body 18*f* comprises a viewing window. This construction of the packaging base body 18*f* is adapted to the shaping of the holding unit 22*f*, such that the brush product 12*f* is optimally presented in the viewing window.

The holding unit 22*f* may comprise elements for holding the brush product 12*f* in an optimum position. A recess is implemented for holding the product. In the present case, when the brush product 12*f* has been introduced into the brush product packaging device 10*f*, the brush product 12*f* adjoins different planes of the brush product packaging device 10*f*. For holding the brush product 12*f*, the holding unit 22*f* has formed a tab 112*f*, which must be folded several times, on the side of the brush head in the prolongation of the longitudinal axis of the brush product 12*f*. This tab 112*f* forms a stopper preventing the brush product 12*f* from slipping back and forth in a direction of the longitudinal axis. In the finished state, the tab 112*f* adjoins, on the one hand, the holding unit 22*f* and, on the other hand, the outer wall.

In a production and filling of the brush product packaging device 10*f*, a ready-glued sleeve is bought in addition, which can be filled manually or automatedly. The folding tabs at the top and bottom of the brush product packaging device 10*f* may in particular be inserted as well as glued. Herein, in a first method step, the sleeve with the integrated holding unit 22*f* is uprighted and the bottom end is closed. Then the sleeve is filled and is closed at the top. A closure is effected manually by latching in, respectively insertion or gluing of the folding tab. Depending on a process, the orientation of the brush product packaging device 10*f* and the closing sequence may vary.

In FIGS. 18*a* and 18*b* the brush product packaging device 10*e* is shown, which is visually identical for the construction according to FIGS. 16*a* to 16*c* and 17. FIGS. 18*a* and 18*b* are exemplarily described by the exemplary embodiment of FIGS. 16*a* to 16*c*, wherein the description may principally also be applied to the exemplary embodiment of FIG. 17. The brush product packaging device 10*e* is implemented as a rectangular-cuboid-shaped cardboard box. The brush product packaging device 10*e* is implemented by a rectangular-cuboid-shaped cardboard box having a tab 70*e* with a euro hole recess 72*e*. The brush product packaging device 10*e* has straight side surfaces at right angles, wherein a tab 70*e* with the euro hole recess 72*e* is provided in an upper region. A width, a height and a length are therefore constant.

FIGS. 19*a* and 19*b* show a blank of an alternative brush product packaging device 10*g* for receiving a brush product 12*g*, in particular an electrical toothbrush, a plug-on brush, a charging station and a manual 122*g*. The brush product packaging device 10*g* is built in two parts, of a packaging base body 18*g* and a holding unit 22*g*. While the packaging base body 18*g* forms the outer sleeve, the holding unit 22*g* is embodied as a slide-in element. The packaging base body 18*g* is configured to form the substantially closed receiving region for the brush product 12*g*. The packaging base body 18*g* is formed from a blank. The packaging base body 18*g* is implemented by a folded and glued box. The brush product packaging device 10*g* is implemented by a rectangular-cuboid-shaped cardboard box having a tab 70*g* with a euro hole recess 72*g*. The brush product packaging device 10*g* has straight side surfaces at right angles, wherein the tab 70*g* with the euro hole recess 72*g* is provided in an upper region. A width, a height and a length are therefore constant. The packaging may be implemented with or without (a) viewing window/s.

The holding unit 22*g* is implemented separately and creates an inner geometry which is slid into the packaging base body 18*g*. The holding unit 22*g* may comprise elements for holding a brush product 12*g* and other comprised items. The holding unit 22*g* is loaded with the products already before it is slid into the packaging base body 18*g*.

The holding unit 22*g* may comprise a slit-shaped, circle-arc-shaped recess 114*g*, which serves for holding the manual 122*g*. The manual 122*g* is accordingly introduced into the slit-shaped recess 114*g* with a corner and is thus held in the cardboard box. A further recess 116*g* is shaped for receiving a plug-on brush 120*g*. The recess 116*g* is implemented across a folded edge such that the plug-on brush 120*g*, respectively its bristle region, protrudes into the ledge formed by the edge and thus lies free and cannot be damaged. The recesses 114*g*, 116*g* for the manual 122*g* and for the plug-on brush 120*g* are preferably located on the same side of the holding unit 22*g*, in particular even in the same area of the holding unit 22*g*. Furthermore, for holding the handpiece of the electrical brush product 12*g*, a larger recess is formed. This recess is created by folded edges in the holding unit 22*g*, such that a clamping of the handpiece is realized by the sides of the recess, a further clamping being induced in the longitudinal direction by projecting edges. In this way the brush product 12*g* is held optimally. The charging apparatus is then merely laid into the corresponding shaped empty space behind the manual and is not specifically fixated.

In FIG. 19*c* the blank of the holding unit 22*g* is illustrated in its prepared, uprighted and loaded form, and next to this the blank of FIG. 19*a* is shown in its uprighted and prepared form. The holding unit 22*g* is here already loaded with the brush product 12*g* and a plug-on brush. Furthermore, a manual 122*g* is inserted in a surface. The brush product 12*g* is clamped between two folded planes, such that it is fixedly held in the packaging and will not slip during transport. The charging station is introduced in the empty space behind the manual 122*g*. All in all, a very compact brush product packaging device 10*g* is created in this way. Due to this compactness, the center of gravity of the packaging is displaced downwards, as a result of which stableness is considerably improved. This means that the product sits on its short side in a comparably stable manner.

The brush product packaging device 10*g* of FIGS. 19*a* to 19*g* may of course also be equipped with one or several viewing window/s to make the product recognizable. It is further possible to prolongate the packaging and to plug the plug-on brush 120*g* directly onto the handpiece of the brush product 12*g*. The recess for the brush product 12*g* would then be superfluous.

It is of course also possible to transfer the descriptions given for specific figures to other figures which illustrate the same or similar implementations and in which the implementations are not described in the same detail.

The embodiment versions shown in the present disclosure are of course given by way of examples. Within the scope of the invention, individual implementations and elements of these embodiment versions may be combined with other embodiment versions without leaving the scope of the present invention.

The invention claimed is:

1. A toothbrush packaging device for receiving a toothbrush, the toothbrush packaging device comprising:

at least one packaging base body which is configured to form an at least substantially closed receiving region for the toothbrush and which is implemented at least largely of a paper material, at least one holding unit, which protrudes at least partly into the receiving region and is configured to hold the toothbrush at least partly in a position relative to the receiving region, and which is implemented at least largely of a paper material, wherein:

the at least one holding unit comprises at least one folding element, the at least one folding element is configured for a fixation of the toothbrush in the receiving region, the at least one folding element is implemented by a separate component that differs from the packaging base body, the at least one folding element is implemented by an insert piece for the packaging base body and is configured to be arranged in the receiving region of the toothbrush packaging device, the at least one packaging base body comprises a planar card element and a folded hood element superimposed on the planar card element, the planar card element and the folded hood element both implemented at least largely of a paper material, the planar card element has a viewing window, the at least one folding element is glued and/or sealed on an inner face of the packaging base body on a base side of the folded hood element, and the hood element has, from a side facing the card element toward a bottom, a conicity on all four sides, the conicity being identical on all four sides, an angle of the conicity being 2° to 10°, the at least one packaging base body comprises, on at least two opposite-situated edges extending at least substantially parallel to a main extension direction, respectively one guiding section having a reduced depth extent relative to a total depth extent, the at least one packaging base body is in the guiding sections in each case implemented at least partly in a multi-layered manner, in the guiding sections, the card element and the hood element are arranged respectively overlapping, and the card element protrudes outwards from the hood element.

2. The toothbrush packaging device according to claim 1, wherein the at least one holding unit is implemented at least partly integrally with the packaging base body.

3. The toothbrush packaging device according to claim 1, wherein the at least one holding unit comprises at least one holding member, which is formed by an indentation in the packaging base body.

4. The toothbrush packaging device according to claim 1, wherein the at least one folding element forms at least one groove for receiving a neck of a brush product.

5. The toothbrush packaging device according to claim 1, wherein the at least one folding element comprises at least one fixation section, which is configured to tension a neck of the toothbrush against the packaging base body.

6. The toothbrush packaging device according to claim 1, wherein the at least one folding element is implemented so as to be connected to the packaging base body.

7. The toothbrush packaging device according to claim 1, wherein in a state when arranged in the packaging base body, the at least one folding element has a circular base surface.

8. The toothbrush packaging device according to claim 1, wherein in a state when arranged in the packaging base body, the at least one folding element has a maximum extension of 10 mm to 50 mm.

9. The toothbrush packaging device according to claim 1, wherein the planar card element and the folded hood element superimposed on the card element are arranged in the guiding sections in each case at least partly overlapping.

10. The toothbrush packaging device according to claim 1, wherein the packaging base body comprises a handling region configured to accommodate a handle of the toothbrush and a head region accommodating an application head of the toothbrush, wherein the guiding sections are arranged exclusively in a handle region of the packaging base body.

11. A method for producing the toothbrush packaging device according to claim 1, the method comprising:

producing a blank of the card element and of the hood element; and forming the hood element and forming a tub from a flat of the hood element, wherein the folding element of the holding unit is introduced in the hood element.

12. A system with a toothbrush packaging device according to claim 1, and with the toothbrush, which is accommodated in the toothbrush packaging device.

13. A tray packaging for receiving at least two toothbrush packaging devices according to claim 1, with at least one secondary packaging base body and with at least one packaging insert, which is arranged in the secondary packaging base body, for a positioning of the toothbrush packaging devices, wherein the at least one packaging insert is implemented at least largely of a paper material.

14. The tray packaging according to claim 13, wherein the at least one packaging insert is implemented such that it is folded at least substantially in a U shape.

15. The tray packaging according to claim 13, wherein the at least one packaging insert is implemented of a corrugated fiberboard.

16. The tray packaging according to claim 13, wherein the at least one secondary packaging base body comprises at least one shoe element for an accommodation of the at least one packaging insert and at least one hood element for a closure of the shoe element.

17. The toothbrush packaging device according to claim 1, wherein:

in a state when arranged in the packaging base body, the folding element has a circular base surface, a blank of the folding element has in a planar state an egg-shaped outer shape, and the outer shape is implemented such as to provide the circular base surface in a folded state.

18. The toothbrush packaging device according to claim 1, wherein the base body is made of solid cardboard.

* * * * *